US011788012B2

(12) United States Patent
Quanci et al.

(10) Patent No.: US 11,788,012 B2
(45) **Date of Patent: *Oct. 17, 2023**

(54) INTEGRATED COKE PLANT AUTOMATION AND OPTIMIZATION USING ADVANCED CONTROL AND OPTIMIZATION TECHNIQUES

(71) Applicant: SUNCOKE TECHNOLOGY AND DEVELOPMENT LLC, Lisle, IL (US)

(72) Inventors: John Francis Quanci, Haddonfield, NJ (US); Parthasarathy Kesavan, Lisle, IL (US); Jack Ziegler, Lisle, IL (US); Katie Russell, Lisle, IL (US); Mike Muhlbaier, Lisle, IL (US); Rakshak Khanna, Lisle, IL (US); Sharla Evatt, Lisle, IL (US); Milos Kaplarevic, Lisle, IL (US); Peter Chun, Lisle, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/172,476

(22) Filed: Feb. 10, 2021

(65) Prior Publication Data

US 2021/0163823 A1 Jun. 3, 2021

Related U.S. Application Data

(62) Division of application No. 14/987,625, filed on Jan. 4, 2016, now Pat. No. 11,060,032.
(Continued)

(51) Int. Cl.
*C10B 15/02* (2006.01)
*C10B 41/00* (2006.01)

(52) U.S. Cl.
CPC ..... *C10B 41/00* (2013.01); *C10B 15/02* (2013.01)

(58) Field of Classification Search
CPC ..... C10B 15/00; C10B 15/02; C10B 5/00–20
See application file for complete search history.

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 8/1984
CA 2775992 5/2011
(Continued)

OTHER PUBLICATIONS

"Middletown Coke Company Application for Major New Source Permit to Install", Ohio EPA, Apr. 1, 2009 (date obtained using Google search tools), URL: https://www.epa.state.oh.us/portals/27/transfer/ptiApplication/mcc/new/262825.pdf (Year: 2009).*
(Continued)

*Primary Examiner* — Jonathan Luke Pilcher
(74) *Attorney, Agent, or Firm* — Perkins Coie LLP

(57) ABSTRACT

The present technology is generally directed to integrated control of coke ovens in a coke plant in order to optimize coking rate, product recovery, byproducts and/or unit lime consumption Optimization objectives are achieved through controlling certain variables (called control variables) by manipulating available handles (called manipulated variables) subject to constraints and system disturbances that affect the controlled variables.

17 Claims, 39 Drawing Sheets

Related U.S. Application Data

(60) Provisional application No. 62/099,383, filed on Jan. 2, 2015.

(56) References Cited

U.S. PATENT DOCUMENTS

| | | | |
|---|---|---|---|
| 705,926 | A | 7/1902 | Hemingway |
| 760,372 | A | 5/1904 | Beam |
| 845,719 | A | 2/1907 | Schniewind |
| 875,989 | A | 1/1908 | Garner |
| 976,580 | A | 7/1909 | Krause |
| 1,140,798 | A | 5/1915 | Carpenter |
| 1,378,782 | A | 5/1921 | Floyd |
| 1,424,777 | A | 8/1922 | Schondeling |
| 1,429,346 | A | 9/1922 | Horn |
| 1,430,027 | A | 9/1922 | Plantinga |
| 1,486,401 | A | 3/1924 | Van Ackeren |
| 1,530,995 | A | 3/1925 | Geiger |
| 1,572,391 | A | 2/1926 | Klaiber |
| 1,677,973 | A | 7/1928 | Marquard |
| 1,705,039 | A | 3/1929 | Thornhill |
| 1,721,813 | A | 7/1929 | Geipert |
| 1,757,682 | A | 5/1930 | Palm |
| 1,818,370 | A | 8/1931 | Wine |
| 1,818,994 | A | 8/1931 | Kreisinger |
| 1,830,951 | A | 11/1931 | Lovett |
| 1,848,818 | A | 3/1932 | Becker |
| 1,895,202 | A | 1/1933 | Montgomery |
| 1,947,499 | A | 2/1934 | Schrader et al. |
| 1,955,962 | A | 4/1934 | Jones |
| 1,979,507 | A | 11/1934 | Underwood |
| 2,075,337 | A | 3/1937 | Burnaugh |
| 2,141,035 | A | 12/1938 | Daniels |
| 2,195,466 | A | 4/1940 | Otto |
| 2,235,970 | A | 3/1941 | Wilputte |
| 2,340,283 | A | 1/1944 | Vladu |
| 2,340,981 | A | 2/1944 | Otto |
| 2,394,173 | A | 2/1946 | Harris et al. |
| 2,424,012 | A | 7/1947 | Bangham et al. |
| 2,486,199 | A | 10/1949 | Nier |
| 2,609,948 | A | 9/1952 | Laveley |
| 2,641,575 | A | 6/1953 | Otto |
| 2,649,978 | A | 8/1953 | Smith |
| 2,667,185 | A | 1/1954 | Beavers |
| 2,723,725 | A | 11/1955 | Keiffer |
| 2,756,842 | A | 7/1956 | Chamberlin et al. |
| 2,813,708 | A | 11/1957 | Frey |
| 2,827,424 | A | 3/1958 | Homan |
| 2,873,816 | A | 2/1959 | Emil et al. |
| 2,902,991 | A | 9/1959 | Whitman |
| 2,907,698 | A | 10/1959 | Schulz |
| 2,968,083 | A | 1/1961 | Lentz et al. |
| 3,015,893 | A | 1/1962 | McCreary |
| 3,026,715 | A | 3/1962 | Briggs |
| 3,033,764 | A | 5/1962 | Hannes |
| 3,175,961 | A | 3/1965 | Samson |
| 3,199,135 | A | 8/1965 | Trucker |
| 3,224,805 | A | 12/1965 | Clyatt |
| 3,259,551 | A | 7/1966 | Thompson, Jr. |
| 3,265,044 | A | 8/1966 | Juchtern |
| 3,267,913 | A | 8/1966 | Jakob |
| 3,327,521 | A | 6/1967 | Briggs |
| 3,342,990 | A | 9/1967 | Barrington et al. |
| 3,444,046 | A | 5/1969 | Harlow |
| 3,444,047 | A | 5/1969 | Wilde |
| 3,448,012 | A | 6/1969 | Allred |
| 3,453,839 | A | 7/1969 | Sabin |
| 3,462,345 | A | 8/1969 | Kernan |
| 3,511,030 | A | 5/1970 | Brown et al. |
| 3,542,650 | A | 11/1970 | Kulakov |
| 3,545,470 | A | 12/1970 | Paton |
| 3,587,198 | A | 6/1971 | Hensel |
| 3,591,827 | A | 7/1971 | Hall |
| 3,592,742 | A | 7/1971 | Thompson |
| 3,616,408 | A | 10/1971 | Hickam |
| 3,623,511 | A | 11/1971 | Levin |
| 3,630,852 | A | 12/1971 | Nashan et al. |
| 3,652,403 | A | 3/1972 | Knappstein et al. |
| 3,676,305 | A | 7/1972 | Cremer |
| 3,709,794 | A | 1/1973 | Kinzler et al. |
| 3,710,551 | A | 1/1973 | Sved |
| 3,746,626 | A | 7/1973 | Morrison, Jr. |
| 3,748,235 | A | 7/1973 | Pries |
| 3,784,034 | A | 1/1974 | Thompson |
| 3,806,032 | A | 4/1974 | Pries |
| 3,811,572 | A | 5/1974 | Tatterson |
| 3,836,161 | A | 10/1974 | Pries |
| 3,839,156 | A | 10/1974 | Jakobi et al. |
| 3,844,900 | A | 10/1974 | Schulte |
| 3,857,758 | A | 12/1974 | Mole |
| 3,875,016 | A | 4/1975 | Schmidt-Balve |
| 3,876,143 | A | 4/1975 | Rossow et al. |
| 3,876,506 | A | 4/1975 | Dix et al. |
| 3,878,053 | A | 4/1975 | Hyde |
| 3,894,302 | A | 7/1975 | Lasater |
| 3,897,312 | A | 7/1975 | Armour et al. |
| 3,906,992 | A | 9/1975 | Leach |
| 3,912,091 | A | 10/1975 | Thompson |
| 3,912,597 | A | 10/1975 | MacDonald |
| 3,917,458 | A | 11/1975 | Polak |
| 3,928,144 | A | 12/1975 | Jakimowicz |
| 3,930,961 | A | 1/1976 | Sustarsic et al. |
| 3,933,443 | A | 1/1976 | Lohrmann |
| 3,957,591 | A | 5/1976 | Riecker |
| 3,959,084 | A | 5/1976 | Price |
| 3,963,582 | A | 6/1976 | Helm et al. |
| 3,969,191 | A | 7/1976 | Bollenbach |
| 3,975,148 | A | 8/1976 | Fukuda et al. |
| 3,979,870 | A | 9/1976 | Moore |
| 3,984,289 | A | 10/1976 | Sustarsic et al. |
| 3,990,948 | A | 11/1976 | Lindgren |
| 4,004,702 | A | 1/1977 | Szendroi |
| 4,004,983 | A | 1/1977 | Pries |
| 4,025,395 | A | 5/1977 | Ekholm et al. |
| 4,040,910 | A | 8/1977 | Knappstein et al. |
| 4,045,056 | A | 8/1977 | Kandakov et al. |
| 4,045,299 | A | 8/1977 | McDonald |
| 4,059,885 | A | 11/1977 | Oldengott |
| 4,065,059 | A | 12/1977 | Jablin |
| 4,067,462 | A | 1/1978 | Thompson |
| 4,077,848 | A | 3/1978 | Grainer et al. |
| 4,083,753 | A | 4/1978 | Rogers et al. |
| 4,086,231 | A | 4/1978 | Ikio |
| 4,093,245 | A | 6/1978 | Connor |
| 4,100,033 | A | 7/1978 | Holter |
| 4,100,491 | A | 7/1978 | Newman, Jr. et al. |
| 4,100,889 | A | 7/1978 | Chayes |
| 4,111,757 | A | 9/1978 | Carimboli |
| 4,124,450 | A | 11/1978 | MacDonald |
| 4,133,720 | A | 1/1979 | Franzer et al. |
| 4,135,948 | A | 1/1979 | Mertens et al. |
| 4,141,796 | A | 2/1979 | Clark et al. |
| 4,143,104 | A | 3/1979 | van Konijnenburg et al. |
| 4,145,195 | A | 3/1979 | Knappstein et al. |
| 4,147,230 | A | 4/1979 | Ormond et al. |
| 4,162,546 | A | 7/1979 | Shorten et al. |
| 4,176,013 | A | 11/1979 | Garthus et al. |
| 4,181,459 | A | 1/1980 | Price |
| 4,189,272 | A | 2/1980 | Gregor et al. |
| 4,194,951 | A | 3/1980 | Pries |
| 4,196,053 | A | 4/1980 | Grohmann |
| 4,211,608 | A | 7/1980 | Kwasnoski et al. |
| 4,211,611 | A | 7/1980 | Bocsanczy |
| 4,213,489 | A | 7/1980 | Cain |
| 4,213,828 | A | 7/1980 | Calderon |
| 4,222,748 | A | 9/1980 | Argo et al. |
| 4,222,824 | A | 9/1980 | Flockenhaus et al. |
| 4,224,109 | A | 9/1980 | Flockenhaus et al. |
| 4,225,393 | A | 9/1980 | Gregor et al. |
| 4,226,113 | A | 10/1980 | Pelletier et al. |
| 4,230,498 | A | 10/1980 | Ruecki |
| 4,235,830 | A | 11/1980 | Bennett et al. |
| 4,239,602 | A | 12/1980 | La Bate |
| 4,248,671 | A | 2/1981 | Belding |
| 4,249,997 | A | 2/1981 | Schmitz |

(56) References Cited

U.S. PATENT DOCUMENTS 4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,298,497 A 11/1981 Colombo
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,316,435 A 2/1982 Nagamatsu et al.
4,324,568 A 4/1982 Wilcox et al.
4,330,372 A 5/1982 Cairns et al.
4,334,963 A 6/1982 Stog
4,336,107 A 6/1982 Irwin
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,385,962 A 5/1983 Stewen et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,406,619 A 9/1983 Oldengott
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,518,461 A 5/1985 Gelfand
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,749,446 A 6/1988 van Laar et al.
4,793,981 A 12/1988 Doyle et al.
4,821,473 A 4/1989 Cowell
4,824,614 A 4/1989 Jones et al.
4,889,698 A 12/1989 Moller et al.
4,898,021 A 2/1990 Weaver et al.
4,918,975 A 4/1990 Voss
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A * 5/1992 Childress ..... C10B 27/06 201/15
5,213,138 A 5/1993 Presz
5,227,106 A 7/1993 Kolvek
5,228,955 A 7/1993 Westbrook, III
5,234,601 A 8/1993 Janke et al.
5,318,671 A * 6/1994 Pruitt ..... C10B 27/06 201/1
5,370,218 A 12/1994 Johnson et al.
5,398,543 A 3/1995 Fukushima et al.
5,423,152 A 6/1995 Kolvek
5,447,606 A 9/1995 Pruitt
5,480,594 A 1/1996 Wilkerson et al.
5,542,650 A 8/1996 Abel et al.
5,597,452 A 1/1997 Hippe et al.
5,603,810 A 2/1997 Michler
5,622,280 A 4/1997 Mays et al.
5,659,110 A 8/1997 Herden et al.
5,670,025 A 9/1997 Baird
5,687,768 A 11/1997 Albrecht et al.
5,705,037 A 1/1998 Reinke et al.
5,715,962 A 2/1998 McDonnell
5,720,855 A 2/1998 Baird
5,745,969 A 5/1998 Yamada et al.
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,881,551 A 3/1999 Dang
5,913,448 A 6/1999 Mann et al.
5,928,476 A 7/1999 Daniels
5,966,886 A 10/1999 Di Loreto
5,968,320 A 10/1999 Sprague
6,002,993 A 12/1999 Naito et al.
6,003,706 A 12/1999 Rosen
6,017,214 A 1/2000 Sturgulewski
6,022,112 A 2/2000 Isler et al.
6,059,932 A 5/2000 Sturgulewski
6,126,910 A 10/2000 Wilhelm et al.
6,139,692 A 10/2000 Tamura et al.
6,152,668 A 11/2000 Knoch
6,156,688 A 12/2000 Ando et al.
6,173,679 B1 1/2001 Bruckner et al.
6,187,148 B1 2/2001 Sturgulewski
6,189,819 B1 2/2001 Racine
6,290,494 B1 9/2001 Barkdoll
6,412,221 B1 7/2002 Emsbo
6,495,268 B1 12/2002 Harth, III et al.
6,539,602 B1 4/2003 Ozawa et al.
6,596,128 B2 * 7/2003 Westbrook ..... F23J 11/02 202/113
6,626,984 B1 9/2003 Taylor
6,699,035 B2 3/2004 Brooker
6,712,576 B2 3/2004 Skarzenski et al.
6,758,875 B2 7/2004 Reid et al.
6,786,941 B2 9/2004 Reeves et al.
6,830,660 B1 12/2004 Yamauchi et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,547,377 B2 6/2009 Inamasu et al.

(56) References Cited

U.S. PATENT DOCUMENTS 7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,146,376 B1 4/2012 Williams et al.
8,152,970 B2 4/2012 Barkdoll et al.
8,172,930 B2 5/2012 Barkdoll
8,236,142 B2 8/2012 Westbrook
8,266,853 B2 9/2012 Bloom et al.
8,282,786 B2 * 10/2012 Kim ..... C10B 15/02 201/27
8,311,777 B2 11/2012 Suguira et al.
8,383,055 B2 2/2013 Palmer
8,398,935 B2 3/2013 Howell et al.
8,409,405 B2 * 4/2013 Kim ..... C10B 21/10 202/245
8,500,881 B2 8/2013 Orita et al.
8,515,508 B2 8/2013 Kawamura et al.
8,568,568 B2 10/2013 Schuecker et al.
8,640,635 B2 2/2014 Bloom et al.
8,647,476 B2 * 2/2014 Kim ..... C10B 15/02 201/37
8,800,795 B2 8/2014 Hwang
8,956,995 B2 2/2015 Masatsugu et al.
8,980,063 B2 * 3/2015 Kim ..... C10B 21/22 201/37
9,039,869 B2 5/2015 Kim et al.
9,057,023 B2 6/2015 Reichelt et al.
9,103,234 B2 8/2015 Gu et al.
9,169,439 B2 10/2015 Sarpen et al.
9,193,913 B2 11/2015 Quanci et al.
9,193,915 B2 11/2015 West et al.
9,200,225 B2 12/2015 Barkdoll et al.
9,238,778 B2 1/2016 Quanci et al.
9,243,186 B2 1/2016 Quanci et al.
9,249,357 B2 2/2016 Quanci et al.
9,273,249 B2 3/2016 Quanci et al.
9,273,250 B2 3/2016 Choi et al.
9,284,491 B2 * 3/2016 Kim ..... F27D 7/02
9,321,965 B2 4/2016 Barkdoll
9,359,554 B2 6/2016 Quanci et al.
9,404,043 B2 8/2016 Kim
9,463,980 B2 10/2016 Fukada et al.
9,476,547 B2 10/2016 Quanci et al.
9,498,786 B2 11/2016 Pearson
9,580,656 B2 2/2017 Quanci et al.
9,672,499 B2 6/2017 Quanci et al.
9,683,740 B2 6/2017 Rodgers et al.
9,708,542 B2 7/2017 Quanci et al.
9,862,888 B2 1/2018 Quanci et al.
9,976,089 B2 5/2018 Quanci et al.
10,016,714 B2 7/2018 Quanci et al.
10,041,002 B2 * 8/2018 Quanci ..... C10B 45/00
10,047,295 B2 8/2018 Chun et al.
10,047,296 B2 8/2018 Chun et al.
10,053,627 B2 8/2018 Sarpen et al.
10,233,392 B2 3/2019 Quanci et al.
10,308,876 B2 6/2019 Quanci et al.
10,323,192 B2 6/2019 Quanci et al.
10,392,563 B2 8/2019 Kim et al.
10,435,042 B1 10/2019 Weymouth
10,526,541 B2 1/2020 West et al.
10,526,542 B2 1/2020 Quanci et al.
10,578,521 B1 3/2020 Dinakaran et al.
10,611,965 B2 * 4/2020 Quanci ..... C10B 45/00
10,619,101 B2 4/2020 Quanci et al.
10,732,621 B2 8/2020 Cella et al.
10,760,002 B2 9/2020 Ball et al.
10,851,306 B2 12/2020 Crum et al.
10,877,007 B2 12/2020 Steele et al.
10,883,051 B2 1/2021 Quanci et al.
10,920,148 B2 * 2/2021 Quanci ..... C10B 31/02
10,927,303 B2 2/2021 Choi et al.
10,947,455 B2 * 3/2021 Quanci ..... C10B 27/06
10,968,393 B2 4/2021 West et al.
10,968,395 B2 4/2021 Quanci et al.
10,975,309 B2 4/2021 Quanci et al.
10,975,310 B2 4/2021 Quanci et al.
10,975,311 B2 4/2021 Quanci et al.
11,008,517 B2 5/2021 Chun et al.
11,008,518 B2 5/2021 Quanci et al.
11,021,655 B2 6/2021 Quanci et al.
11,053,444 B2 7/2021 Quanci et al.
11,060,032 B2 7/2021 Quanci et al.
11,071,935 B2 7/2021 Quanci et al.
11,098,252 B2 8/2021 Quanci et al.
11,117,087 B2 9/2021 Quanci
11,142,699 B2 10/2021 West et al.
11,186,778 B2 11/2021 Crum et al.
11,193,069 B2 12/2021 Quanci et al.
11,214,739 B2 1/2022 Quanci et al.
11,261,381 B2 3/2022 Quanci et al.
11,359,145 B2 6/2022 Ball et al.
11,359,146 B2 6/2022 Quanci et al.
11,365,355 B2 6/2022 Quanci et al.
11,395,989 B2 7/2022 Quanci et al.
11,441,077 B2 9/2022 Quanci et al.
11,441,078 B2 9/2022 Quanci et al.
2002/0134659 A1 * 9/2002 Westbrook ..... F23J 11/12 202/254
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2004/0220840 A1 11/2004 Bonissone et al.
2005/0087767 A1 4/2005 Fitzgerald et al.
2005/0096759 A1 5/2005 Benjamin et al.
2006/0029532 A1 2/2006 Breen et al.
2006/0102420 A1 5/2006 Huber et al.
2006/0149407 A1 7/2006 Markham et al.
2007/0087946 A1 4/2007 Quest et al.
2007/0102278 A1 5/2007 Inamasu et al.
2007/0116619 A1 5/2007 Taylor et al.
2007/0251198 A1 11/2007 Witter
2008/0028935 A1 2/2008 Andersson
2008/0179165 A1 7/2008 Chen et al.
2008/0250863 A1 10/2008 Moore
2008/0257236 A1 10/2008 Green
2008/0271985 A1 11/2008 Yamasaki
2008/0289305 A1 11/2008 Girondi
2009/0007785 A1 1/2009 Kimura et al.
2009/0032385 A1 2/2009 Engle
2009/0105852 A1 4/2009 Wintrich et al.
2009/0152092 A1 6/2009 Kim et al.
2009/0162269 A1 6/2009 Barger et al.
2009/0217576 A1 9/2009 Kim et al.
2009/0257932 A1 10/2009 Canari et al.
2009/0283395 A1 11/2009 Hippe
2010/0015564 A1 1/2010 Chun et al.
2010/0025217 A1 * 2/2010 Schuecker ..... C10B 15/02 201/15
2010/0095521 A1 4/2010 Kartal et al.
2010/0106310 A1 4/2010 Grohman
2010/0113266 A1 5/2010 Abe et al.
2010/0115912 A1 5/2010 Worley
2010/0119425 A1 5/2010 Palmer
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0300867 A1 * 12/2010 Kim ..... C10B 21/10 201/37
2010/0314234 A1 12/2010 Knoch et al.
2011/0000284 A1 1/2011 Kumar et al.
2011/0014406 A1 1/2011 Coleman et al.

(56) References Cited

U.S. PATENT DOCUMENTS

2011/0048917 A1* 3/2011 Kim ..... C10B 41/00 201/27
2011/0083314 A1 4/2011 Baird
2011/0088600 A1 4/2011 McRae
2011/0120852 A1* 5/2011 Kim ..... C10B 15/02 202/99
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim
2011/0198206 A1* 8/2011 Kim ..... C10B 5/06 201/1
2011/0223088 A1 9/2011 Chang et al.
2011/0253521 A1* 10/2011 Kim ..... F22B 1/04 201/28
2011/0291827 A1 12/2011 Baldocchi et al.
2011/0313218 A1 12/2011 Dana
2011/0315538 A1* 12/2011 Kim ..... C10B 21/10 201/37
2012/0031076 A1 2/2012 Frank et al.
2012/0125709 A1 5/2012 Merchant et al.
2012/0152720 A1 6/2012 Reichelt et al.
2012/0177541 A1 7/2012 Mutsuda et al.
2012/0179421 A1 7/2012 Dasgupta
2012/0180133 A1 7/2012 Ai-Harbi et al.
2012/0195815 A1 8/2012 Moore et al.
2012/0228115 A1 9/2012 Westbrook
2012/0247939 A1 10/2012 Kim et al.
2012/0305380 A1 12/2012 Wang et al.
2012/0312019 A1 12/2012 Rechtman
2013/0020781 A1 1/2013 Kishikawa
2013/0045149 A1 2/2013 Miller
2013/0213114 A1 8/2013 Wetzig et al.
2013/0216717 A1 8/2013 Rago et al.
2013/0220373 A1 8/2013 Kim
2013/0306462 A1 11/2013 Kim et al.
2014/0039833 A1 2/2014 Sharpe, Jr. et al.
2014/0156584 A1 6/2014 Motukuri et al.
2014/0208997 A1 7/2014 Alferyev et al.
2014/0224123 A1 8/2014 Walters
2015/0041304 A1 2/2015 Klim et al.
2015/0122629 A1 5/2015 Freimuth et al.
2015/0143908 A1 5/2015 Cetinkaya
2015/0175433 A1 6/2015 Micka et al.
2015/0219530 A1 8/2015 Li et al.
2015/0226499 A1 8/2015 Mikkelsen
2016/0026193 A1 1/2016 Rhodes et al.
2016/0048139 A1 2/2016 Samples et al.
2016/0149944 A1 5/2016 Obermeirer et al.
2016/0154171 A1 6/2016 Kato et al.
2016/0370082 A1 12/2016 Olivo
2017/0173519 A1 6/2017 Naito
2017/0182447 A1 6/2017 Sappok et al.
2017/0226425 A1 8/2017 Kim et al.
2017/0261417 A1 9/2017 Zhang
2017/0313943 A1 11/2017 Valdevies
2017/0352243 A1 12/2017 Quanci et al.
2019/0317167 A1 10/2019 LaBorde et al.
2020/0071190 A1 3/2020 Wiederin et al.
2020/0139273 A1 5/2020 Badiei
2020/0173679 A1 6/2020 O'Reilly et al.
2020/0208059 A1 7/2020 Quanci et al.
2020/0208063 A1 7/2020 Quanci et al.
2020/0208833 A1 7/2020 Quanci et al.
2021/0130697 A1 5/2021 Quanci et al.
2021/0163821 A1* 6/2021 Quanci ..... C10B 21/10
2021/0198579 A1 7/2021 Quanci et al.
2021/0261877 A1 8/2021 Despen et al.
2021/0340454 A1 11/2021 Quanci et al.
2021/0363426 A1 11/2021 West et al.
2021/0363427 A1 11/2021 Quanci et al.
2021/0371752 A1 12/2021 Quanci et al.
2021/0388270 A1 12/2021 Choi et al.
2022/0056342 A1 2/2022 Quanci et al.
2022/0106527 A1 4/2022 Quanci et al.
2022/0195303 A1 6/2022 Quanci et al.
2022/0204858 A1 6/2022 West et al.
2022/0204859 A1 6/2022 Crum et al.
2022/0226766 A1 7/2022 Quanci et al.
2022/0251452 A1 8/2022 Quanci et al.
2022/0298423 A1 9/2022 Quanci et al.
2022/0325183 A1 10/2022 Quanci et al.
2022/0356410 A1 11/2022 Quanci et al.
2023/0012031 A1 1/2023 Quanci et al.

FOREIGN PATENT DOCUMENTS

CA 2822841 7/2012
CA 2822857 7/2012
CA 2905110 A1 9/2014
CN 87212113 U 6/1988
CN 87107195 A 7/1988
CN 2064363 U 10/1990
CN 2139121 Y 7/1993
CN 1092457 A 9/1994
CN 1255528 A 6/2000
CN 1270983 A 10/2000
CN 2528771 Y 2/2002
CN 1358822 A 7/2002
CN 2521473 Y 11/2002
CN 1468364 A 1/2004
CN 1527872 A 9/2004
CN 2668641 1/2005
CN 1957204 A 5/2007
CN 101037603 A 9/2007
CN 101058731 A 10/2007
CN 101157874 A 4/2008
CN 101211495 A 7/2008
CN 201121178 Y 9/2008
CN 101395248 A 3/2009
CN 100510004 C 7/2009
CN 101486017 A 7/2009
CN 201264981 Y 7/2009
CN 101497835 A 8/2009
CN 101509427 A 8/2009
CN 101886466 A 11/2010
CN 101910530 A 12/2010
CN 102072829 A 5/2011
CN 102155300 A 8/2011
CN 2509188 Y 11/2011
CN 202226816 5/2012
CN 202265541 U 6/2012
CN 102584294 A 7/2012
CN 202415446 U 9/2012
CN 202470353 U 10/2012
CN 103399536 A 11/2013
CN 103468289 A 12/2013
CN 103913193 A 7/2014
CN 203981700 U 12/2014
CN 104498059 A 4/2015
CN 105001914 A 10/2015
CN 105137947 A 12/2015
CN 105189704 A 12/2015
CN 105264448 A 1/2016
CN 105467949 A 4/2016
CN 106661456 A 5/2017
CN 106687564 A 5/2017
CN 107445633 A 12/2017
CN 100500619 C 6/2020
DE 201729 C 9/1908
DE 212176 7/1909
DE 1212037 B 3/1966
DE 2212544 A 1/1973
DE 2720688 A1 11/1978
DE 3231697 C1 1/1984
DE 3328702 A1 2/1984
DE 3315738 C2 3/1984
DE 3329367 C 11/1984
DE 3407487 C1 6/1985
DE 19545736 6/1997
DE 19803455 8/1999
DE 10122531 A1 11/2002
DE 10154785 5/2003

(56) References Cited

FOREIGN PATENT DOCUMENTS

| | | | |
|---|---|---|---|
| DE | 102005015301 | | 10/2006 |
| DE | 102006004669 | | 8/2007 |
| DE | 102006026521 | | 12/2007 |
| DE | 102009031436 | | 1/2011 |
| DE | 102011052785 | | 12/2012 |
| EA | 010510 | B1 | 10/2008 |
| EP | 0126399 | A1 | 11/1984 |
| EP | 0208490 | A1 | 1/1987 |
| EP | 0903393 | A2 | 3/1999 |
| EP | 1538503 | A1 | 6/2005 |
| EP | 1860034 | A1 | 11/2007 |
| EP | 2295129 | A1 | 3/2011 |
| EP | 2468837 | A1 | 6/2012 |
| FR | 2339664 | | 8/1977 |
| FR | 2517802 | | 6/1983 |
| FR | 2764978 | | 12/1998 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S5319301 | A | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | S57172978 | A | 10/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H05230466 | A | 9/1993 |
| JP | H0649450 | A | 2/1994 |
| JP | H0654753 | U | 7/1994 |
| JP | H06264062 | | 9/1994 |
| JP | H06299156 | A | 10/1994 |
| JP | 07188668 | | 7/1995 |
| JP | 07216357 | | 8/1995 |
| JP | H07204432 | | 8/1995 |
| JP | H0843314 | A | 2/1996 |
| JP | H08104875 | A | 4/1996 |
| JP | 08127778 | | 5/1996 |
| JP | H08218071 | A | 8/1996 |
| JP | H10273672 | A | 10/1998 |
| JP | H11131074 | | 5/1999 |
| JP | H11256166 | A | 9/1999 |
| JP | 2000204373 | A | 7/2000 |
| JP | 2000219883 | A | 8/2000 |
| JP | 2001055576 | A | 2/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003051082 | A | 2/2003 |
| JP | 2003071313 | A | 3/2003 |
| JP | 2003292968 | A | 10/2003 |
| JP | 2003342581 | A | 12/2003 |
| JP | 2004169016 | A | 6/2004 |
| JP | 2005503448 | A | 2/2005 |
| JP | 2005135422 | A | 5/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2007063420 | A | 3/2007 |
| JP | 3924064 | B2 | 6/2007 |
| JP | 2007231326 | A | 9/2007 |
| JP | 4101226 | B2 | 6/2008 |
| JP | 2008231278 | A | 10/2008 |
| JP | 2009019106 | A | 1/2009 |
| JP | 2009073864 | A | 4/2009 |
| JP | 2009073865 | A | 4/2009 |
| JP | 2009135276 | A | 6/2009 |
| JP | 2009144121 | | 7/2009 |
| JP | 2010229239 | A | 10/2010 |
| JP | 2010248389 | A | 11/2010 |
| JP | 2011504947 | A | 2/2011 |
| JP | 2011068733 | A | 4/2011 |
| JP | 2011102351 | A | 5/2011 |
| JP | 2012102302 | | 5/2012 |
| JP | 2012102325 | A | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| JP | 2015094091 | A | 5/2015 |
| JP | 2016169897 | A | 9/2016 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030012458 | A | 2/2003 |
| KR | 1020040020883 | A | 3/2004 |
| KR | 20040107204 | A | 12/2004 |
| KR | 20050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20150011084 | A | 1/2015 |
| KR | 20170038102 | A | 4/2017 |
| KR | 20170058808 | A | 5/2017 |
| KR | 20170103857 | A | 9/2017 |
| KR | 101862491 | B1 | 5/2018 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2005023649 | | 3/2005 |
| WO | WO2005031297 | | 4/2005 |
| WO | WO2005115583 | | 12/2005 |
| WO | WO2007103649 | | 9/2007 |
| WO | WO2008034424 | | 3/2008 |
| WO | WO2008105269 | | 9/2008 |
| WO | WO2009147983 | | 12/2009 |
| WO | WO2010103992 | | 9/2010 |
| WO | WO2011000447 | | 1/2011 |
| WO | WO2011126043 | | 10/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |

(56) References Cited

FOREIGN PATENT DOCUMENTS

| | | |
|---|---|---|
| WO | WO2014043667 | 3/2014 |
| WO | WO2014105064 | 7/2014 |
| WO | WO2014153050 | 9/2014 |
| WO | WO2016004106 | 1/2016 |
| WO | WO2016033511 | 3/2016 |
| WO | WO2016086322 | 6/2016 |

OTHER PUBLICATIONS

Office of the Federal Register, National Archives and Records Administration. (Apr. 14, 2005). 70 FR 19992—National Emission Standards for Coke Oven Batteries. [Government]. Office of the Federal Register, National Archives and Records Administration. https://www.govinfo.gov/app/details/FR-2005-04-15/05-6942.*

U.S. Appl. No. 07/587,742, filed Sep. 25, 1990, now U.S. Pat. No. 5,114,542, titled Nonrecovery Coke Oven Battery and Method of Operation.

U.S. Appl. No. 07/878,904, filed May 6, 1992, now U.S. Pat. No. 5,318,671, titled Method of Operation of Nonrecovery Coke Oven Battery.

U.S. Appl. No. 09/783,195, filed Feb. 14, 2001, now U.S. Pat. No. 6,596,128, titled Coke Oven Flue Gas Sharing.

U.S. Appl. No. 07/886,804, filed May 22, 1992, now U.S. Pat. No. 5,228,955, titled High Strength Coke Oven Wall Having Gas Flues Therein.

U.S. Appl. No. 08/059,673, filed May 12, 1993, now U.S. Pat. No. 5,447,606, titled Method of and Apparatus for Capturing Coke Oven Charging Emission.

U.S. Appl. No. 08/914,140, filed Aug. 19, 1997, now U.S. Pat. No. 5,928,476, titled Nonrecovery Coke Oven Door.

U.S. Appl. No. 09/680,187, filed Oct. 5, 2000, now U.S. Pat. No. 6,290,494, titled Method and Apparatus for Coal Coking.

U.S. Appl. No. 10/933,866, filed Sep. 3, 2004, now U.S. Pat. No. 7,331,298, titled Coke Oven Rotary Wedge Door Latch.

U.S. Appl. No. 11/424,566, filed Jun. 16, 2006, now U.S. Pat. No. 7,497,930, titled Method and Apparatus for Compacting Coal for a Coal Coking Process.

U.S. Appl. No. 12/405,269, filed Mar. 17, 2009, now U.S. Pat. No. 7,998,316, titled Flat Push Coke Wet Quenching Apparatus and Process.

U.S. Appl. No. 13/205,960, filed Aug. 9, 2011, now U.S. Pat. No. 9,321,965, titled Flat Push Coke Wet Quenching Apparatus and Process.

U.S. Appl. No. 11/367,236, filed Mar. 3, 2006, now U.S. Pat. No. 8,152,970, titled Method and Apparatus for Producing Coke.

U.S. Appl. No. 12/403,391, filed Mar. 13, 2009, now U.S. Pat. No. 8,172,930, titled Cleanable In Situ Spark Arrestor.

U.S. Appl. No. 12/849,192, filed Aug. 3, 2010, now U.S. Pat. No. 9,200,225, titled Method and Apparatus for Compacting Coal for a Coal Coking Process.

U.S. Appl. No. 13/631,215, filed Sep. 28, 2012, now U.S. Pat. No. 9,683,740, titled Methods for Handling Coal Processing Emissions and Associated Systems and Devices.

U.S. Appl. No. 13/730,692, filed Dec. 28, 2012, now U.S. Pat. No. 9,193,913, titled Reduced Output Rate Coke Oven Operation With Gas Sharing Providing Extended Process Cycle.

U.S. Appl. No. 14/655,204, now U.S. Pat. No. 10,016,714, filed Jun. 24, 2015, titled Systems and Methods for Removing Mercury From Emissions.

U.S. Appl. No. 16/000,516, now U.S. Pat. No. 11,117,087, filed Jun. 5, 2018, titled Systems and Methods for Removing Mercury From Emissions.

U.S. Appl. No. 17/459,380, filed Jun. 5, 2018, titled Systems and Methods for Removing Mercury From Emissions.

U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.

U.S. Appl. No. 16/026,363, filed Jul. 3, 2018, now U.S. Pat. No. 11,008,517, titled Non-Perpendicular Connections Between Coke Oven Uptakes and a Hot Common Tunnel, and Associated Systems and Methods.

U.S. Appl. No. 13/730,796, filed Dec. 28, 2012, now U.S. Pat. No. 10,883,051, titled Methods and Systems for Improved Coke Quenching.

U.S. Appl. No. 17/140,564, filed Jan. 4, 2021, titled Methods and Systems for Improved Coke Quenching.

U.S. Appl. No. 13/730,598, filed Dec. 28, 2012, now U.S. Pat. No. 9,238,778, titled Systems and Methods for Improving Quenched Coke Recovery.

U.S. Appl. No. 14/952,267, filed Nov. 25, 2015, now U.S. Pat. No. 9,862,888, titled Systems and Methods for Improving Quenched Coke Recovery.

U.S. Appl. No. 15/830,320, filed Dec. 4, 2017, now U.S. Pat. No. 10,323,192, titled Systems and Methods for Improving Quenched Coke Recovery.

U.S. Appl. No. 13/730,735, filed Dec. 28, 2012, now U.S. Pat. No. 9,273,249, titled Systems and Methods for Controlling Air Distribution in a Coke Oven.

U.S. Appl. No. 14/655,013, filed Jun. 23, 2015, now U.S. Pat. No. 11,142,699, titled Vent Stack Lids and Associated Systems and Methods.

U.S. Appl. No. 17/471,491, filed Sep. 10, 2021, now U.S. Pat. No. 11,142,699, titled vent Stack Lids and Associated Systems and Methods.

U.S. Appl. No. 13/843,166, filed Mar. 15, 2013, now U.S. Pat. No. 9,273,250, titled Methods and Systems for Improved Quench Tower Design.

U.S. Appl. No. 15/014,547, filed Feb. 3, 2016, now, U.S. Pat. No. 10,927,303, titled Methods for Improved Quench Tower Design.

U.S. Appl. No. 17/155,818, filed Jan. 22, 2021, titled Methods and Systems for Improved Quench Tower Design.

U.S. Appl. No. 14/655,003, filed Jun. 23, 2015, now U.S. Pat. No. 10,760,002, titled Systems and Methods for Maintaining a Hot Car in a Coke Plant.

U.S. Appl. No. 16/897,957, filed Jun. 10, 2020, now U.S. Pat. No. 11,359,145, titled Systems and Methods for Maintaining a Hot Car in a Coke Plant.

U.S. Appl. No. 13/829,588, filed Mar. 14, 2013, now U.S. Pat. No. 9,193,915, titled Horizontal Heat Recovery Coke Ovens Having Monolith Crowns.

U.S. Appl. No. 15/322,176, filed Dec. 27, 2016, now U.S. Pat. No. 10,526,541, titled Horizontal Heat Recovery Coke Ovens Having Monolith Crowns.

U.S. Appl. No. 15/511,036, filed Mar. 14, 2017, now U.S. Pat. No. 10,968,383, titled Coke Ovens Having Monolith Component Construction.

U.S. Appl. No. 17/190,720, filed Mar. 3, 2021, titled Coke Ovens Having Monolith Component Construction.

U.S. Appl. No. 13/589,009, filed Aug. 17, 2012, now U.S. Pat. No. 9,359,554, titled Automatic Draft Control System for Coke Plants.

U.S. Appl. No. 15/139,568, filed Apr. 27, 2016, now U.S. Pat. No. 10,947,455, titled Automatic Draft Control System for Coke Plants.

U.S. Appl. No. 17/176,391, filed Feb. 16, 2021, titled Automatic Draft Control System for Coke Plants.

U.S. Appl. No. 13/588,996, filed Aug. 17, 2012, now U.S. Pat. No. 9,243,186, titled Coke Plant Including Exhaust Gas Sharing.

U.S. Appl. No. 14/959,450, filed Dec. 4, 2015, now U.S. Pat. No. 10,041,002, titled Coke Plant Including Exhaust Gas Sharing.

U.S. Appl. No. 16/047,198, filed Jul. 27, 2018, now U.S. Pat. No. 10,611,965, titled Coke Plant Including Exhaust Gas Sharing.

U.S. Appl. No. 16/828,448, filed Mar. 24, 2020, now U.S. Pat. No. 11,441,077, titled Coke Plant Including Exhaust Gas Sharing.

U.S. Appl. No. 13/589,004, filed Aug. 17, 2012, now U.S. Pat. No. 9,249,357, titled Method and Apparatus for Volatile Matter Sharing in Stamp-Charged Coke Ovens.

U.S. Appl. No. 13/730,673, filed Dec. 28, 2012, now U.S. Pat. No. 9,476,547, titled Exhaust Flow Modifier, Duct Intersection Incorporating the Same, and Methods Therefor.

(56) References Cited

OTHER PUBLICATIONS

U.S. Appl. No. 15/281,891, filed Sep. 30, 2016, now U.S. Pat. No. 10,975,309, titled Exhaust Flow Modifier, Duck Intersection Incorporating the Same, and Methods Therefor.
U.S. Appl. No. 17/191,119, filed Mar. 3, 3021, titled Exhaust Flow Modifier, Duck Intersection Incorporating the Same, and Methods Therefor.
U.S. Appl. No. 13/598,394, filed Aug. 29, 2012, now U.S. Pat. No. 9,169,439, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, now U.S. Pat. No. 9,580,656, titled Coke Oven Charging System.
U.S. Appl. No. 15/443,246, filed Feb. 27, 2017, now U.S. Pat. No. 9,976,089, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, now U.S. Pat. No. 11,359,146, titled Methods for Decarbonizing Coking Ovens, and Associated Systems and Devices.
U.S. Appl. No. 14/984,489, filed Dec. 30, 2015, now U.S. Pat. No. 10,975,310, titled Multi-Modal Beds of Coking Material.
U.S. Appl. No. 14/983,837, filed Dec. 30, 2015, now U.S. Pat. No. 10,968,395, titled Multi-Modal Beds of Coking Material.
U.S. Appl. No. 14/986,281, filed Dec. 31, 2015, now U.S. Pat. No. 10,975,311, titled Multi-Modal Beds of Coking Material.
U.S. Appl. No. 17/222,886, filed Apr. 12, 2021, titled Multi-Modal Beds of Coking Material.
U.S. Appl. No. 14/987,625, filed Jan. 4, 2016, now U.S. Pat. No. 11,060,032, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, now U.S. Pat. No. 11,053,444, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, now U.S. Pat. No. 10,920,148, titled Improved Burn Profiles for Coke Operations.
U.S. Appl. No. 17/155,719, filed Jan. 22, 2021, now U.S. Pat. No. 11,441,078, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, now U.S. Pat. No. 11,214,739, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, now U.S. Pat. No. 11,186,778, titled System and Method for Repairing a Coke Oven.
U.S. Appl. No. 17/521,061, filed Nov. 8, 2021, titled System and Method for Repairing a Coke Oven.
U.S. Appl. No. 17/135,483, filed Dec. 28, 2020, titled Oven Health Optimization Systems and Methods.
U.S. Appl. No. 16/729,053, filed Dec. 27, 2019, titled Oven Uptakes.
U.S. Appl. No. 16/729,036, filed Dec. 27, 2019, now U.S. Pat. No. 11,365,355, titled Systems and Methods for Treating a Surface of a Coke Plant.
U.S. Appl. No. 17/747,708, filed May 18, 2022, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, now U.S. Pat. No. 11,395,989, titled Methods and Systems for Providing Corrosion Resistant Surfaces in Contaminant Treatment Systems.
U.S. Appl. No. 17/843,164, filed Jun. 17, 2022, titled Methods and Systems for Providing Corrosion Resistant Surfaces in Contaminant Treatment Systems.
U.S. Appl. No. 16/729,068, filed Dec. 27, 2019, titled Systems and Methods for Utilizing Flue Gas.
U.S. Appl. No. 17/947,520, filed Sep. 19, 2022, titled Systems and Methods for Utilizing Flue Gas.
U.S. Appl. No. 16/729,129, filed Dec. 27, 2019, now U.S. Pat. No. 11,008,518, titled Coke Plant Tunnel Repair and Flexible Joints.
U.S. Appl. No. 17/320,343, filed May 14, 2021, titled Coke Plant Tunnel Repair and Flexible Joints.
U.S. Appl. No. 16/729,170, now U.S. Pat. No. 11,193,069, filed Dec. 27, 2019, titled Coke Plant Tunnel Repair and Anchor Distribution.
U.S. Appl. No. 17/532,058, filed Nov. 22, 2021, titled Coke Plant Tunnel Repair and Anchor Distribution.
U.S. Appl. No. 16/729,157, filed Dec. 27, 2019, now U.S. Pat. No. 11,071,935, titled Particulate Detection for Industrial Facilities, and Associated Systems and Methods.
U.S. Appl. No. 16/729,057, filed Dec. 27, 2019, now U.S. Pat. No. 11,021,655, titled Decarbonization of Coke Ovens and Associated Systems and Methods.
U.S. Appl. No. 17/321,857, filed May 17, 2021, titled Decarbonization of Coke Ovens and Associated Systems and Methods.
U.S. Appl. No. 16/729,212, filed Dec. 27, 2019, now U.S. Pat. No. 11,261,381, titled Heat Recovery Oven Foundation.
U.S. Appl. No. 17/584,672, filed Jan. 26, 2022, titled Heat Recovery Oven Foundation.
U.S. Appl. No. 16/729,219, now U.S. Pat. No. 11,098,252, filed Dec. 27, 2019, titled Spring-Loaded Heat Recovery Oven System and Method.
U.S. Appl. No. 17/388,874, filed Jul. 29, 2021, titled Spring-Loaded Heat Recovery Oven System and Method.
U.S. Appl. No. 17/736,960, filed May 20, 2022, titled Foundry Coke Products, and Associated Systems and Methods.
U.S. Appl. No. 17/306,895, filed May 3, 2021, titled High-Quality Coke Products.
U.S. Appl. No. 17/532,058, filed Nov. 22, 2021, Quanci et al.
U.S. Appl. No. 17/736,960, filed May 5, 2022, Quanci et al.
U.S. Appl. No. 17/747,708, filed May 18, 2022, Quanci et al.
U.S. Appl. No. 17/843,164, filed Jun. 17, 2022, Quanci et al.
U.S. Appl. No. 17/947,520, filed Sep. 19, 2022, Quanci et al.
ASTM D5341-99(2010)e1, Standard Test Method for Measuring Coke Reactivity Index (CRI) and Coke Strength After Reaction (CSR), ASTM International, West Conshohocken, PA, 2010.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf; 404 pages.
Basset et al., "Calculation of steady flow pressure loss coefficients for pipe junctions," Proc Instn Mech Engrs., vol. 215, Part C, p. 861-881 IMechIE 2001.
Beckman et al., "Possibilities and limits of cutting back coking plant output," Stahl und Eisen, Verlag Stahleisen, Dusseldorf, DE, vol. 130, No. 8, Aug. 16, 2010, pp. 57-67.
Bloom, et al., "Modular cast block—The future of coke oven repairs," Iron & Steel Technol, AIST, Warrendale, PA, vol. 4, No. 3, Mar. 1, 2007, pp. 61-64.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.

(56) References Cited

OTHER PUBLICATIONS

"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
"High Alumina Cement-Manufacture, Characteristics and Uses," TheConstructor.org, https://theconstructor.org/concrete/high-alumina-cement/23686/; 12 pages.
Industrial Furnace Design Handbook, Editor-in-Chief: First Design Institute of First Ministry of Machinery Industry, Beijing: Mechanical Industry Press, pp. 180-183, Oct. 1981.
Joseph, B., "A tutorial on inferential control and its applications," Proceedings of the 1999 American Control Conference (Cat. No. 99CH36251), San Diego, CA, 1999, pp. 3106-3118 vol. 5.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173, 184.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
"Refractory Castables," Victas.com, Dec. 28, 2011 (date obtained from WayBack Machine), https://www/vitcas.com/refactory-castables; 5 pages.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue de Metallurgie—Cahiers d'Informations Techniques, Revue de Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
Brazilian Examination Report for Brazilian Application No. BR112017014428-0; dated Jun. 8, 2021; 7 pages.
Canadian Office Action in Canadian Application No. 2,973,243; dated May 25, 2021; 5 pages.
Chinese Office Action in Chinese Application No. 201680007598.4; dated Dec. 4, 2019; 22 pages.
Extended European Search Report for European Application No. 16732907.7; dated May 18, 2018; 10 pages.
Examination Report for European Application No. 16732907.7; dated Apr. 8, 2019; 5 pages.
Examination Report for European Application No. 16732907.7; dated Apr. 16, 2021; 4 pages.
India First Examination Report in Application No. 201737026074; dated Mar. 12, 2020; 6 pages.
International Search Report and Written Opinion issued in PCT/US2016/012085, dated Apr. 22, 2016, 13 pages.
U.S. Appl. No. 17/967,615, filed Oct. 17, 2022, Quanci et al.
U.S. Appl. No. 18/047,916, filed Oct. 19, 2022, Quanci et al.
U.S. Appl. No. 18/052,739, filed Nov. 4, 2022, Quanci et al.
U.S. Appl. No. 18/052,760, filed Nov. 4, 2022, Quanci et al.
U.S. Appl. No. 18/168,142, filed Feb. 13, 2023, Quanci et al.
De Cordova, et al. "Coke oven life prolongation—A multidisciplinary approach." 10.5151/2594-357X-2610 (2015) 12 pages.
Lin, Rongying et al., "Study on the synergistic effect of calcium and aluminum on improving ash fusion temperature of semi-coke," International Journal of Coal Preparation and Utilization, May 31, 2019 (published online), vol. 42, No. 3, pp. 556-564.
Lipunov, et al. "Diagnostics of the Heating Systgem and Lining of Coke Ovens," Coke and Chemistry, 2014, Vopl. 57, No. 12, pp. 489-492.
Tiwari, et al., "A novel technique for assessing the coking potential of coals/cole blends for non-recovery coke making process," Fuel, vol. 107, May 2013, pp. 615-622.

* cited by examiner

SUN COKE HEAT RECOVERY OVEN - ILLUSTRATION OF GAS FLOWS

| MV\CS | Tcrown PS | Tcrown Center | Tcrown CS | (Tcrown Center PS – Tcrown CS) | TSolePS | TSoleCS | Tsole CS – Tsole CS) | Over Draft |
|---|---|---|---|---|---|---|---|---|
| Crown (cop air or door hole) Damper 1 PS | X | | | X | X | | | X |
| Crown (cop air or door hole) Damper 2 PS | X | X | | X | X | | | X |
| Crown (cop air or door hole) Damper 3 PS | X | X | X | X | | | | X |
| Crown (cop air or door hole) Damper 1 CS | | | X | X | | | | X |
| Crown (cop air or door hole) Damper 2 CS | | X | X | X | | | | X |
| Crown (cop air or door hole) Damper 3 CS | X | X | X | X | | | | X |
| Sole Damper PS | | | | | X | | X | X |
| Sole Damper CS | | | | | | X | X | X |
| Uptake Damper 1 | | | | | | | | X |
| Uptake Damper 2 | | | | | | | | X |
| | | | | | | | | |
| **Feed Forward** | | | | | | | | |
| Uptake Damper 1FF | X | X | X | X | X | X | X | |
| Uptake Damper 2FF | X | X | X | X | X | X | X | |
| Coal VM | X | X | X | X | X | X | X | X |
| Coal Moisture | X | X | X | X | X | X | X | X |
| | | | | | | | | |
| Nomenclature | | | | | | | | |
| PS | Push Side | | | | | | | |
| CS | Coke Side | | | | | | | |
| MV | Manipulated Variable | | | | | | | |
| CV | Controlled Variable | | | | | | | |
| Tcrown | Crown Temperature | | | | | | | |
| Tsole | Sole Flue Temperature | | | | | | | |

*Fig. 20*

Exemplary screen shot 1: Modified Oven Screen

Exemplary screen shot 2: Damper Controller Pop-up

Exemplary screen shot 3: Damper Controller

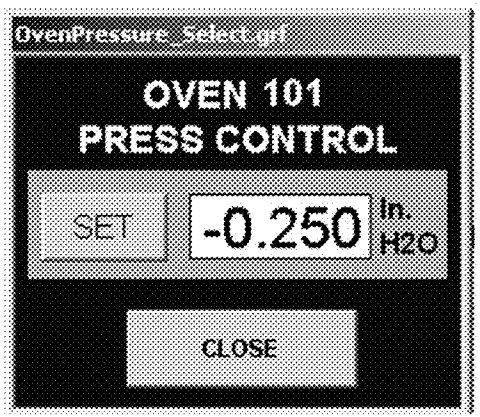
Exemplary screen shot 5: Oven Pressure Controller
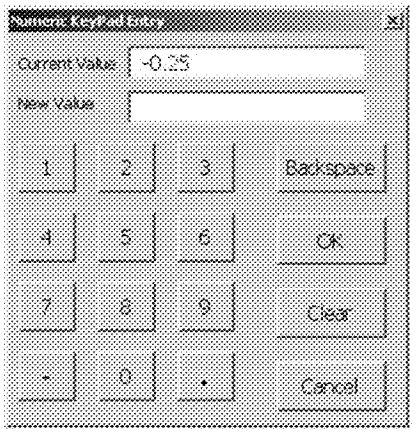
Exemplary screen shot 6: Oven Pressure Set Point Keypad
*Fig. 24E*

Exemplary screen shot 7: Oven Overview Screen

Exemplary Graph of Crown Temp Control

Exemplary Auto Control Performance Graph

Exemplary Auto Control Performance

Exemplary burner or operator Intervention Protocol

Burner Intervention

- Burners should take the ovens out of auto control in the following conditions:
  - Mechanical issues with Uptakes
  - Faulty thermocouples
    - Control system will not be able to make appropriate moves
  - Production delays or significant change in plant operation can lead to manual uptake adjustment
- In general, it is up to burner's discretion to take the oven in manual if he/she thinks it is good for coking operation SunCoke Energy – CONFIDENTIAL & Attorney Client Privilege SunCoke Energy

*Fig. 24K*

Exemplary Turning Auto Control On/Off

Exemplary Auto Control Tuning from the Controller Perspective

INTEGRATED COKE PLANT AUTOMATION AND OPTIMIZATION USING ADVANCED CONTROL AND OPTIMIZATION TECHNIQUES

CROSS-REFERENCE TO RELATED APPLICATIONS

This application is a divisional application of U.S. patent application Ser. No. 14/987,625, filed Jan. 4, 2016, which claims the benefit of priority to U.S. Provisional Patent Application No. 62/099,383, filed Jan. 2, 2015, the disclosures of which are incorporated herein by reference in their entireties.

TECHNICAL FIELD

The present technology is generally directed to integrated control of coke ovens in a coke plant in order to optimize coking rate, product recovery, byproducts and/or unit lime consumption.

BACKGROUND

Iron and steel are vital parts of the global economy. The World Steel Association reported that 1.1 billion tons of raw iron was produced globally by blast furnaces in 2013. This process uses coke and iron ore as its main raw materials. Coke is a solid carbon fuel and carbon source used to melt and reduce iron ore in the production of steel. Coke is produced by exposing properly selected and prepared blend of bituminous coals to the high temperatures of a coke oven for an adequate period of time in the absence of air. During the entire conversion, volatile gases, vapors and tars are being expelled from the charge. As the temperatures of the charge increases in the reducing coke oven atmosphere, the coking coals pass through a plastic or softening stage, gasses and tars are evolved, coal particles swell and shrink and then bond or adhere together re-solidifying into a semi coke and finally a coke at about 1830 degrees Fahrenheit. Coking coals are unique with respect to this unusual behavior when heated. The coals are solid when charged, become fluid to varying degrees, then with further increase in temperature, become the solid, hard porous substance, known as coke. Coke is porous black to silver gray substance. It is high in carbon content, low in non-carbon impurities such as sulfur and ash. Physically, the coke produced is strong, resistant to abrasion, and sized to span a narrow size range.

The melting and fusion process undergone by the coal particles during the heating process is an important part of coking. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens, and the coal is heated in the ovens in order to remove volatile matter ("VM") from the resulting coke. The coking process is highly dependent on the oven design, the type of coal, and the conversion temperature used. Typically, ovens are adjusted during the coking process so that each charge of coal is coked out in approximately the same amount of time. Once the coal is "coked out" or fully coked, the coke is removed from the oven and quenched with water to cool it below its ignition temperature. Alternatively, the coke is dry quenched with an inert gas. The quenching operation must also be carefully controlled so that the coke does not absorb too much moisture. Once it is quenched, the coke is screened and loaded into rail cars, trucks, or onto belt conveyors, for shipment.

As the source of coal suitable for forming metallurgical coal ("coking coal") has decreased, attempts have been made to blend weak or lower quality coals ("non-coking coal") with coking coals to provide a suitable coal charge for the ovens. One way to combine non-coking and coking coals is to use compacted or stamp-charged coal. The coal may be compacted before or after it is in the oven. In some embodiments, a mixture of non-coking and coking coals is compacted to greater than 50 pounds per cubic foot in order to use non-coking coal in the coke making process. As the percentage of non-coking coal in the coal mixture is increased, higher levels of coal compaction are required (e.g., up to about 65 to 75 pounds per cubic foot). Commercially, coal is typically compacted to about 1.15 to 1.2 specific gravity (sg) or about 70-75 pounds per cubic foot.

The manner in which coals are selected, prepared and combined greatly effects the properties of the coke produced. Coals must be reduced in size by grinding to optimal levels and then thoroughly mixed to ensure good distribution of coal particles that will promote the maximum coke quality achievable form the available coals. In North America, coke makers generally pulverize their coals or blends to 75% to 95% minus ⅛" size. The size the coal is crushed is expressed as % minus ⅛" is commonly referred to as the pulverization level. In addition to size control, bulk density must be controlled. High bulk density can cause hard-pushing and damage coke oven walls in a byproduct coke oven. Low bulk density can reduce the strength of the coke produced.

Two coke oven technologies dominate the industry: by-product coke ovens and heat recovery coke ovens. The majority of the coke produced in the United States comes from by-product oven batteries. This technology charges coal into a number of slot type ovens wherein each oven shares a common heating flue with the adjacent oven. Natural gas and other fuels are used to provide heat to the ovens. Coal is carbonized in the reducing atmosphere, under positive (higher than atmospheric) pressure and the gasses and tars that evolve (off-gases) are collected and sent to a by-product plant where various by-products are recovered. Coal to coke transformation in a by-product oven takes place when the heat is transferred from the heated brick walls into the coal charge. The coal decomposes to form plastic layers near each wall and these layers progress toward the center of the oven. Once the plastic layers have met in the center of the oven, the entire mass is carbonized.

Alternatively, using heat-recovery, non-recovery, or beehive oven technology, coal is charged to large oven chambers operated under negative (lower than atmospheric) pressure. The carbonization process takes place from the top by radiant heat transfer and from the bottom by conduction of heat through the sole floor. Primary combustion air is introduced into the oven chamber through several ports located above the charge level. The evolving gasses and tar are combusted in the top chamber and soles of the oven and provide the heat for the coking process. In heat recovery ovens, excess thermal energy from the combusted gases is recovered in the waste heat recovery boiler and converted to steam or power. Coal to coke transformation in a heat-recovery, non-recovery and beehive oven takes place when the heat is transferred from the heated brick floor or radiant heat from the top of the coal bed into the coal charge. The coal decomposes to form plastic layers near the wall and the top of the bed and these layers progress toward the center of the oven. Once the plastic layers have met in the center of the oven, the entire mass is carbonized.

The rate of movement of the plastic layer to the center of the coal bed in both by-product and heat-recovery ovens is limited by the conductive heat transfer rate of the coal bed. Coal chemistry and bed density have a major impact on the heat transfer rate which ultimately sets the oven cycle time and battery production capacity. By-product ovens generally have cycle times between 17 to 24 hours per charge. Heat-recovery ovens generally have cycle times between 24 and 48 hours per charge.

The common method to increase bulk density of the coal charge to the oven is to compact the coal bed prior to or after it is charged by mechanical means known as stamp charging. While a stamp charge method can successfully increase the overall bulk density of the coal charge, it requires expensive equipment to perform the compaction. In heat recovery ovens, it results in a longer coking cycle because the closely packed particles release volatile matter slower than a loosely packed bed. At the same time, stamp charging's higher density leads to improved coke quality. This allows attaining a higher coke quality and the option to substitute lower cost, lower quality coals. In the United States, there is an abundance of high quality low cost coal. The abundance of low cost, high quality coal and the high cost of installing a stamp charger has led to stamp chargers not being employed in the United States. Any low cost method to improve coal density without stamp charging would have application in the United States to improve coke quality and possibly use some lower cost coals or coal substitutes.

BRIEF DESCRIPTION OF THE DRAWINGS

FIG. 20: Example of the relationship matrix that could be used by Model Predictive Control (MPC) in its controller calculation. X denotes dynamic model between manipulated variable (MV) or feedforward (FF) variable with the corresponding controlled variable (CV) in accordance with aspects of the disclosure.

FIGS. 24A-M illustrate exemplary screen shots of a user interface in accordance with aspects of the disclosure.

DETAILED DESCRIPTION

The present technology is generally directed to integrated control of coke ovens in a coke plant, including horizontal heat recovery (HHR) coke plants, beehive coke plants, and by-product coke plants, in order to optimize coking rate, product recovery, byproducts and unit lime consumption. Coking rate is defined as tons of coal coked out/hr, energy efficiency defined as net energy production (total heat produced—heat consumed for coke making—heat losses). Product recovery is defined as amount of coke produced (tons) per amount of coal consumed (tons) on a wet or dry basis. Byproducts are defined by power or steam. Unit lime consumption is defined as tons of lime consumed per ton of coal charged to the ovens.

Figure 1:
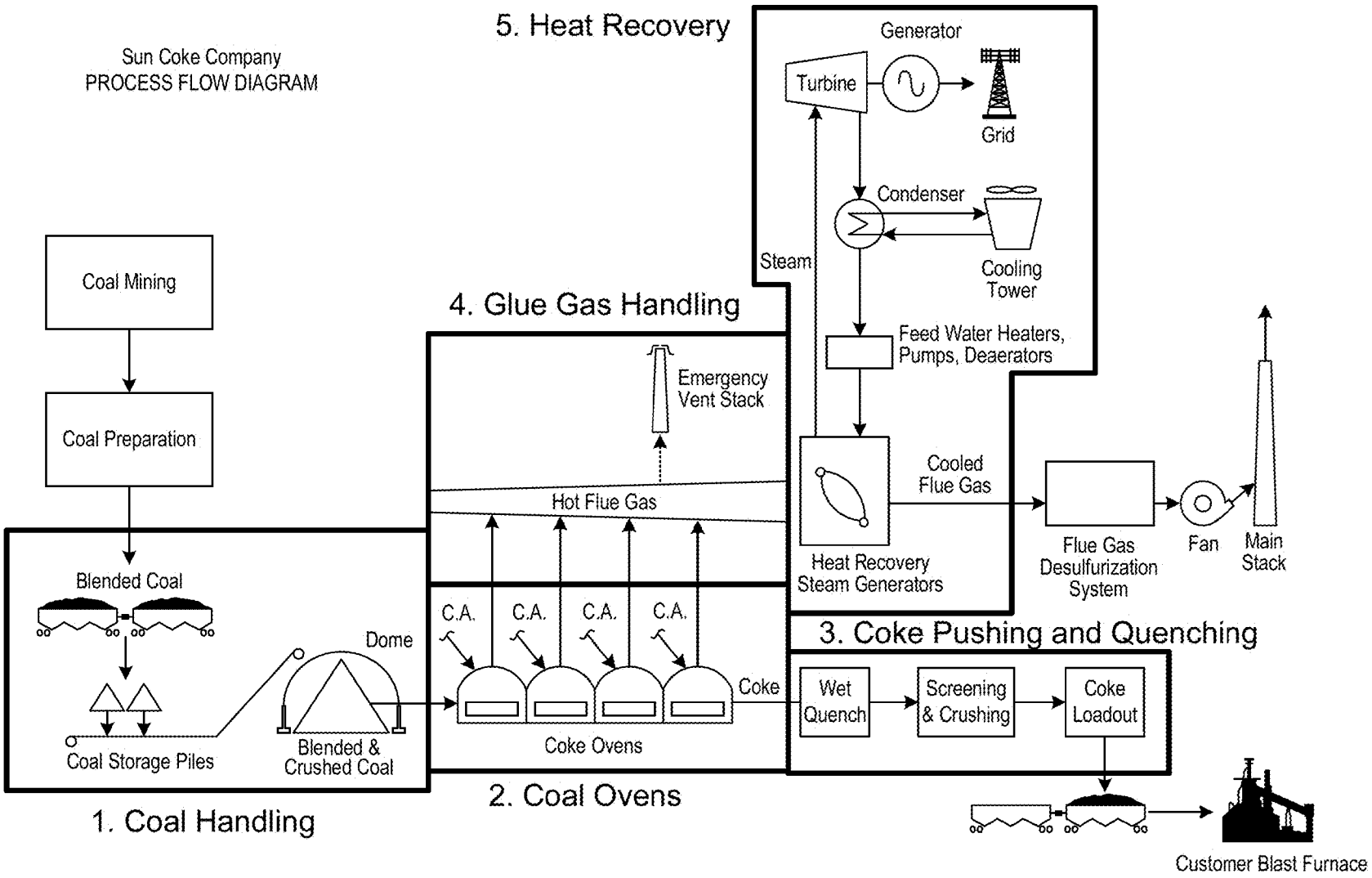
FIG. 1: Schematic process flow diagram of horizontal heat recovery coke plant in accordance with aspects of the disclosure.

According to one exemplary embodiment of the disclosure, horizontal heat recovery coke plants consist of several systems including a series of coke ovens connected to each other with a single or multiple hot flue gas ducts, multiple heat recovery steam generator (HRSG) units to generate steam from waste heat of flue gas from ovens. In alternative embodiments, the coke plant may include a steam turbine generator generates power from steam. In still further embodiments, the coke plan may include flue gas desulphurization units to remove sulfur from flue gas and/or a bag house to remove particulate matter. A schematic diagram is shown in FIG. 1. In accordance with one embodiment, the entire coke plant is operated under negative pressure created by using an induced draft (ID) fan at the stack. Optimization of the coke plant consists of optimization of the all the individual systems connected to each other and subject to interactions within and between the different units. Various control schemes are described herein for integrated control of coke plants.

Coke Ovens

Figure 2:
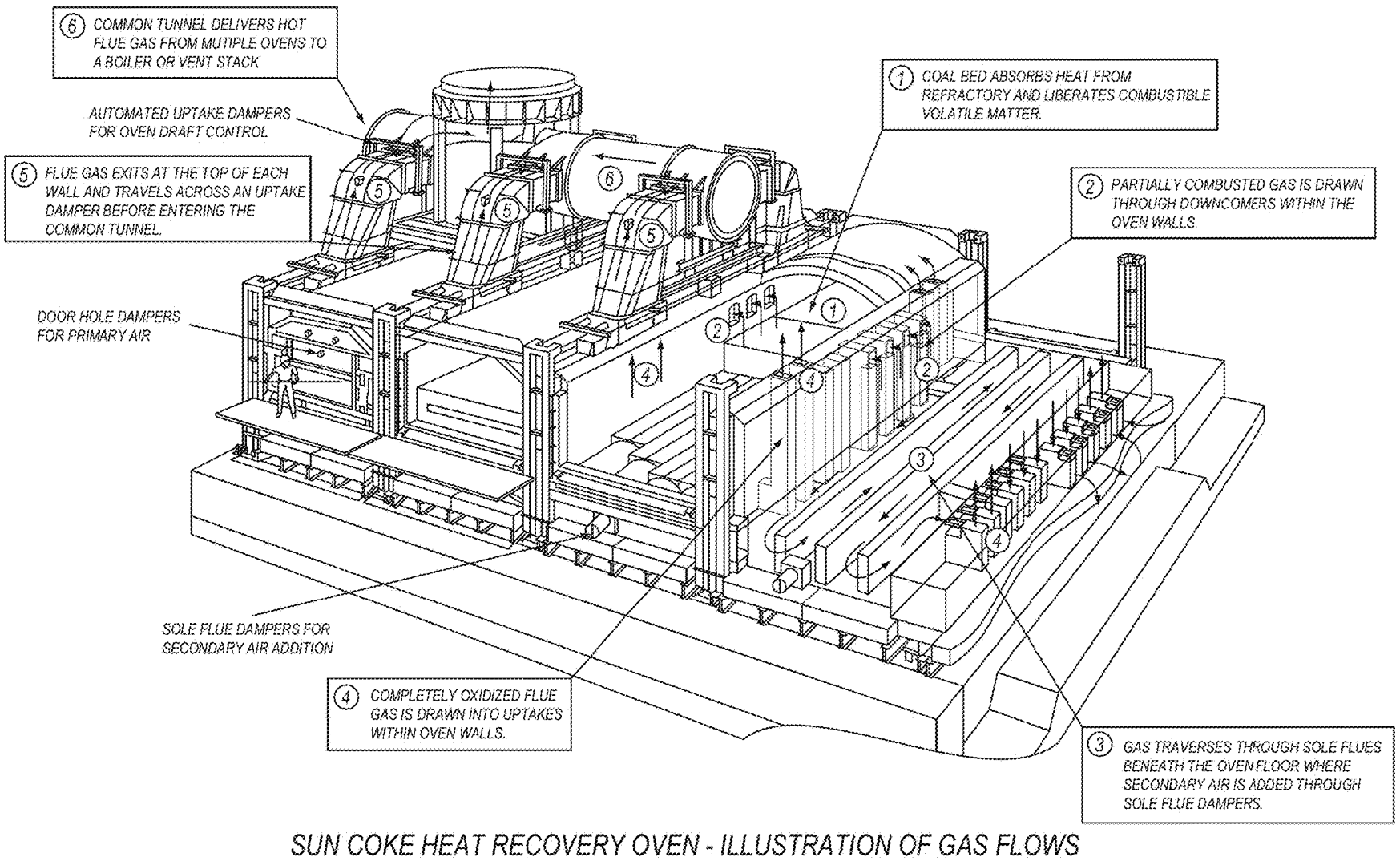
FIG. 2: Illustrates an exemplary lay out of horizontal heat recovery coke oven with door holes for primary air in accordance with aspects of the disclosure.
Figure 3:
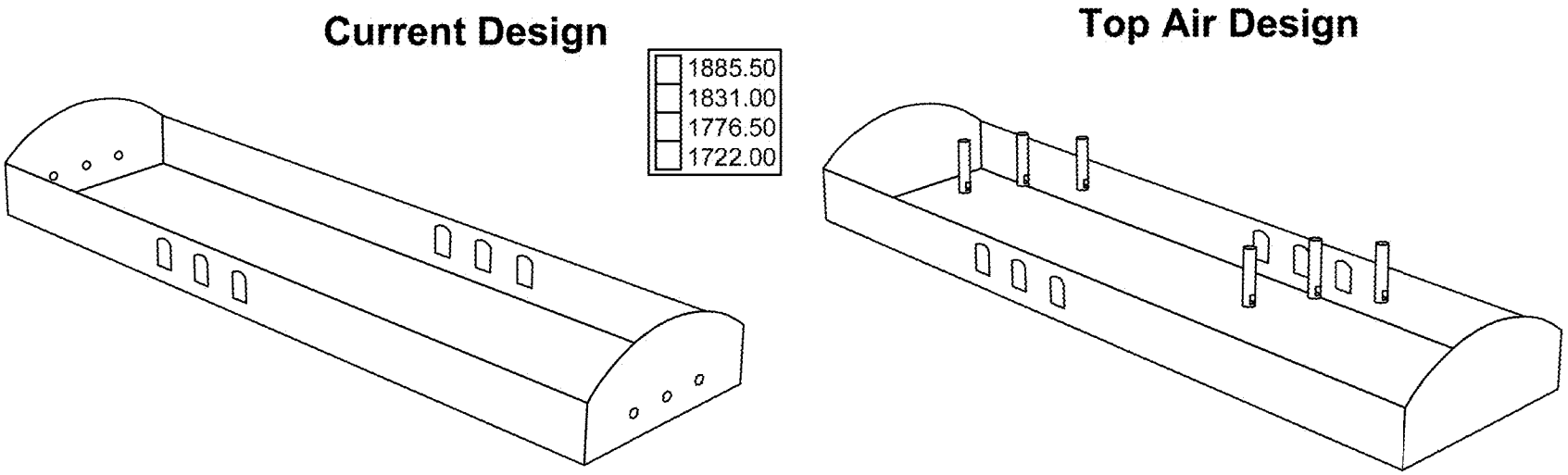
FIG. 3: Door hole vs top air configuration for providing primary air to crown section of oven in accordance with aspects of the disclosure.

According to aspects of one embodiment, more than a hundred coke oven may be included in a single coke plant. Coke ovens are typically divided in to several batteries. Several of these coke ovens in each battery share heat recovery steam generators. For example, in accordance with one embodiment, a hundred oven coke plant there could be three batteries and there could be one heat recovery steam generator for every 20 ovens. According to additional embodiments, there could be fewer or more ovens affiliated with each heat recovery steam generator. Each of the coke ovens are built the same and behave similarly, although each coke oven has some differences caused by carbon formation, oven leaks, charge, etc. In operation, coke ovens may be charged on a 48 hour cycle. Odd ovens are charged one day and even ovens the next day. Blended coal with a particular set of properties such as moisture content, volatile matter (VM), fluidity, etc. is charged in the oven and coked for 48 hours. Heat for coking in horizontal heat recovery coke ovens is provided by the volatile matter that is released from coal. Volatile matter consists of tar, hydrocarbon, hydrogen, carbon-monoxide and other gases that are burnt in the oven. In horizontal heat recovery ovens, the gases are burnt in the crown section at the top of the coal as well as under the floor in sole flue. Thus coking of the coal happens from both top of the coke cake and the bottom of the coke cake. The air needed for burning the volatile matter is provided in the crown by using air holes in the door, at the ceiling of the crown (top air) or from a different non-movable surface in the oven crown. The air needed for burning the volatile matter in the sole flue is provided from the holes in the end walls. One horizontal heat recovery oven configuration with door holes is shown in FIG. 2. FIG. 3 shows the difference between door hole and top air configuration for providing the primary air to the crown section of the oven.

Coke Oven Optimization

One aspect of the disclosure is the formulation of the different control schemes for integrated oven control to optimize coking rate, product, byproduct recovery and unit lime consumption. This is described in further detail below.

Optimization Objectives

One optimization objective of the coke oven is to maximize throughput (defined as amount of coal that can be charged and coked out in one batch), yield (defined as tons of coke made per ton of coal charged) and coke quality (stability, coke strength after reaction (CSR) and mean size). Coke chemistry, coke size, and coke strength (stability) have been considered the most important factors for evaluating coke for use in a blast furnace. However, coke reactivity index (CRI) and CSR are increasing in importance as their impact on blast furnace performance is better understood. For example, a decrease in coke consumption during hot metal production can be linked to increases in CSR values. The magnitude of coke rate reduction varies with changes in blast furnaces size and operating parameters. However, it is estimated that 2 to 5 lbs. of coke are saved per net ton of hot metal produced for every point that CSR increases.

Throughput is maximized by maximizing the coking rate (defined as tons of coal converted to coke per hour). Coking rate can be optimized by optimizing the temperature profiles in crown and sole flue. Yield can be maximized by minimizing the burn loss in the oven (defined as amount of coke burnt out in a batch). Again, yield can be optimized by optimizing the temperature profiles in crown and sole flue. The temperature profiles in crown and sole flue affect the size of the coke (bottom vs top coke), stability and CSR. Optimization objectives are achieved through controlling certain variables (called control variables) by manipulating available handles (called manipulated variables) subject to constraints and system disturbances that affect the controlled variables. These different variables are explained in further detail below.

Controlled Variables (CVs): CVs are defined as variables that are controlled to desired user set-points to meet the optimization objectives. From above, optimization of coke oven involves defining the optimal set-point temperature profile trajectories and controlling the temperature profiles to the optimal set point profiles in both the crown and sole flues. Temperatures are affected by the amount of oxygen in the oven i.e combustion control. If the oxygen intake in the oven is matched to the fuel (in volatile matter) release rate then temperature can be maximized (in other words controlling the fuel/air ratio). However, neither the gas evolution rate (and also composition) nor the air flow in to the oven is measured. Hence a direct control of fuel/air (or oxygen) is not possible. However, one can try a feedback control by measuring the temperatures and adjusting the oxygen to maximize the temperature (or controlling to a desired set-point). Alternatively one can also use an inferential control by indirectly inferring the amount of gas (air (at a particular density)+volatile matter) by using the draft (or pressure) in the oven and controlling the temperature by controlling the draft in the oven by moving the door hole dampers, sole flue (SF) dampers or uptake dampers (which controls the amount of air).

Thus the controlled variables include temperatures in the crown (center, push side (PS) and coke side (CS)), temperatures in the sole (PS and CS) and/or draft within the oven system that would include the crown, sole flue, downcomers, upcomers and uptakes to the damper blocks. Controlled variables can be controlled to a set point profile (like temperatures) or maintained in a deadband (i.e. draft). According to further embodiments, an additional controlled variable may be the delta T between the coke side and push side temperatures.

Manipulated Variables (MVs): MVs are defined as variables that can be moved independently by the controller in order to control the controlled variables. The main variables that can be manipulated to control the ovens are the oven uptakes, the sole flue dampers and the door hole or top air hole dampers on the push side and coke side.

Disturbance Variables (DVs) and Feed Forward (FF) Variables: DVs are variables that cause the controlled variables to change, but may not be available for the controller to move them.

Feedforward (FF) Variables are a special class of DVs which can be measured. This measurement can be used to predict future controlled variable changes which can be accounted for with compensating manipulated variable changes. Some examples of disturbances are given below.

Emergency Vent Stack (EVS) Draft: As shown in FIG. 1, flue gas from each set of ovens in a battery (typically 20 ovens) are connected through a common tunnel which send the gas to a corresponding heat recovery steam generator. Variations in pressure (or draft) at the emergency vent stack can affect the operation of all the ovens in that battery. For example, if the draft at emergency vent stack increases by 0.1 this will result in increased draft for the ovens connected to it and will thus vary the air inflow to the ovens for the same uptake, door hole and sole flue damper position. Hence, this disturbance will affect the temperatures of all the ovens and operator or control system need to take action in order to counteract the disturbance and keep the ovens in control. Thus, if the emergency vent stack draft can be set at a particular value and controlled tightly it greatly enhances the controllability of the ovens.

Door holes: Door holes are used as a main source for providing primary air or secondary source in addition to top air holes. If the door holes are controlled manually then they can be treated as disturbances to the automatic control scheme. In other words if an operator opens the door holes and let in more air the controller will treat it as a disturbances affecting the controlled variables (such as temperatures or draft) and take an action with the other manipulated variables available (such as uptakes or top air hole dampers) to keep the controlled variables within their limits.

Sole Flue (SF) Dampers: Similar to door holes if the sole flue dampers are not automated.

Ambient conditions: If the ambient conditions change it will affect the properties of the air intake. For example, the density, temperature or humidity changes of the air could affect the controlled variables.

Coal property changes: Properties of the coal charged in to the oven can change from day to day. For example, the moisture content, volatile matter, fluidity, bulk density, etc. could vary from one day to the other. These act as disturbances affecting the controlled variables.

Coal Charging: Coal is charged by using a pusher charger machine (PCM) by an operator. The machine settings and charging speed could affect shape and level of the coal bed in the oven. For example, uneven speed of charging could result in more coal in the push side compared to coke side or vice versa. Similarly there could be side to side variations. Uneven coal bed loading leads to uneven volatile matter evolution in the oven and hence would act as disturbances to the control system affecting the controlled variables.

Constraints: Constraints are limits for the variables that need to be honored by the control system and cannot be violated. Constraints arising from safety, environmental, equipment limitations or efficiency need to be incorporated in to the control system. These could be temperature limits (for example, high limit to prevent melting of oven bricks), draft limits (for example, to prevent the oven pressure from going positive leading to outgassing), or oxygen limits (for example, high limit to prevent the oven from cooling off due to excess air). Control systems are designed to handle these constraints in a prioritized fashion.

Control Schemes

As discussed above, coke ovens have several controlled and manipulated variables and are subject to various disturbances and constraints. Depending on the level of complexity and desired response several control schemes can be configured.

As shown in FIG. 1, coke ovens are in the front end of the process. However, any down stream disturbance could affect all the ovens upstream. Thus, for good control of the ovens it is important to have good control of downstream operations and if possible decouple the downstream operations from the coke ovens for good controllability. This can be done if emergency vent stack draft is maintained at a desired set point value. Control schemes to do this will first be described.

For control of coke ovens, several control schemes starting from simple single loop control to advanced multi-loop cascade control is then discussed. The use of state of the art multivariable matrix based Model Predictive Control (MPC) is then described.

Figure 4:
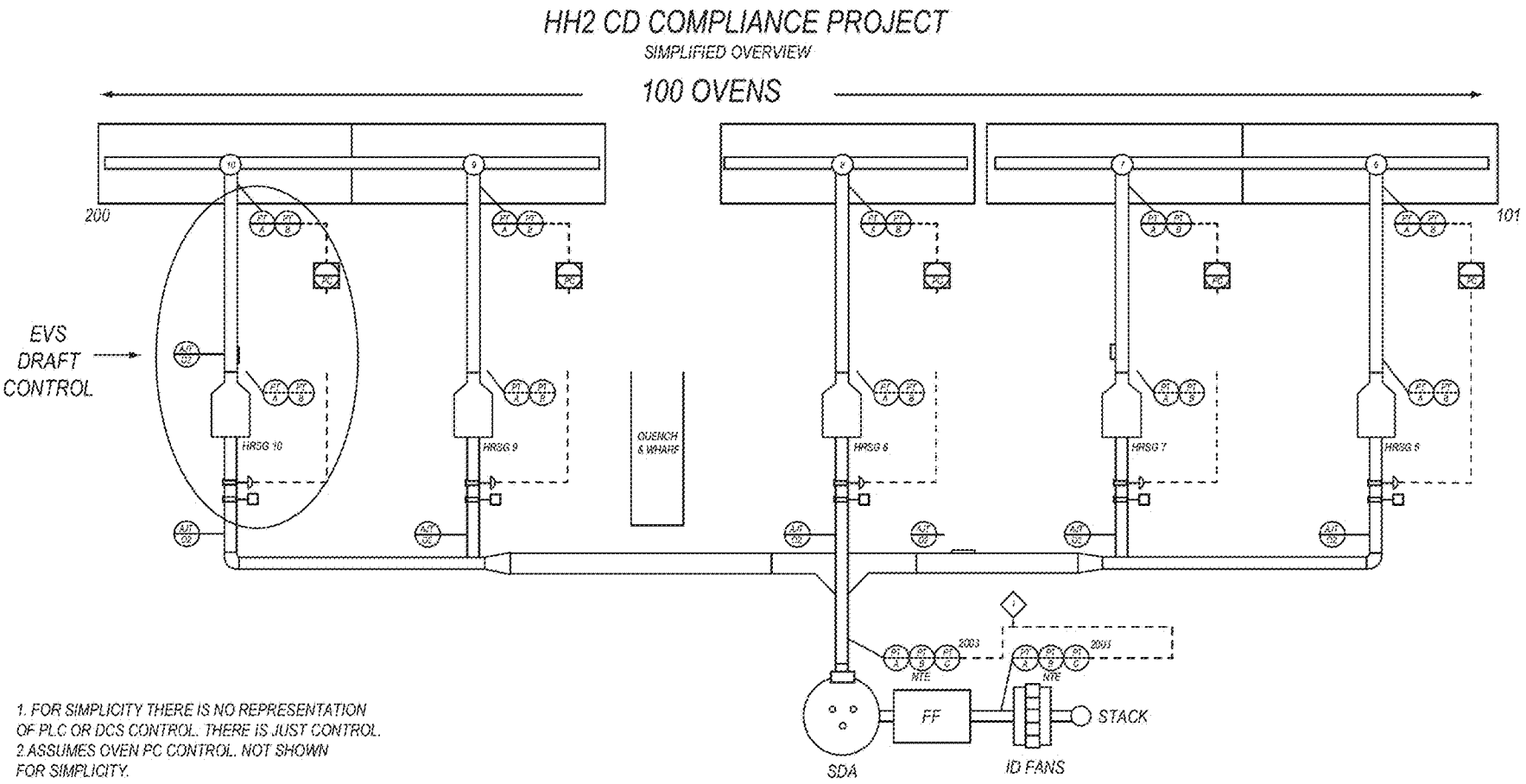
FIG. 4: Schematic of 100 oven plant with downstream operations. emergency vent stack (EVS) control draft scheme is shown in accordance with aspects of the disclosure.

EVS Draft Control Schemes—Decoupling Oven Control From Downstream Operations: Plant without Gas Sharing Tunnel FIG. 4 shows an oven plant with 1 heat recovery steam generator for each of the 20 ovens. Each of the heat recovery steam generator (HRSG) has an associated pressure control valve (PCV) downstream of the heat recovery steam generator. As shown in FIG. 4, a PIC (pressure indicating controller) is used to control the pressure control valve to maintain the emergency vent stack draft at a particular set point specified by the operator. This maintains the pressure downstream of the ovens and ensures that ovens don't get affected due to disturbances in downstream operations or due to production cycles associated with the different ovens (gas evolution from ovens varies through the coking cycle thus affecting the emergency vent stack draft).

Coke Plant with Gas Sharing (GS) Tunnel

Figure 5:
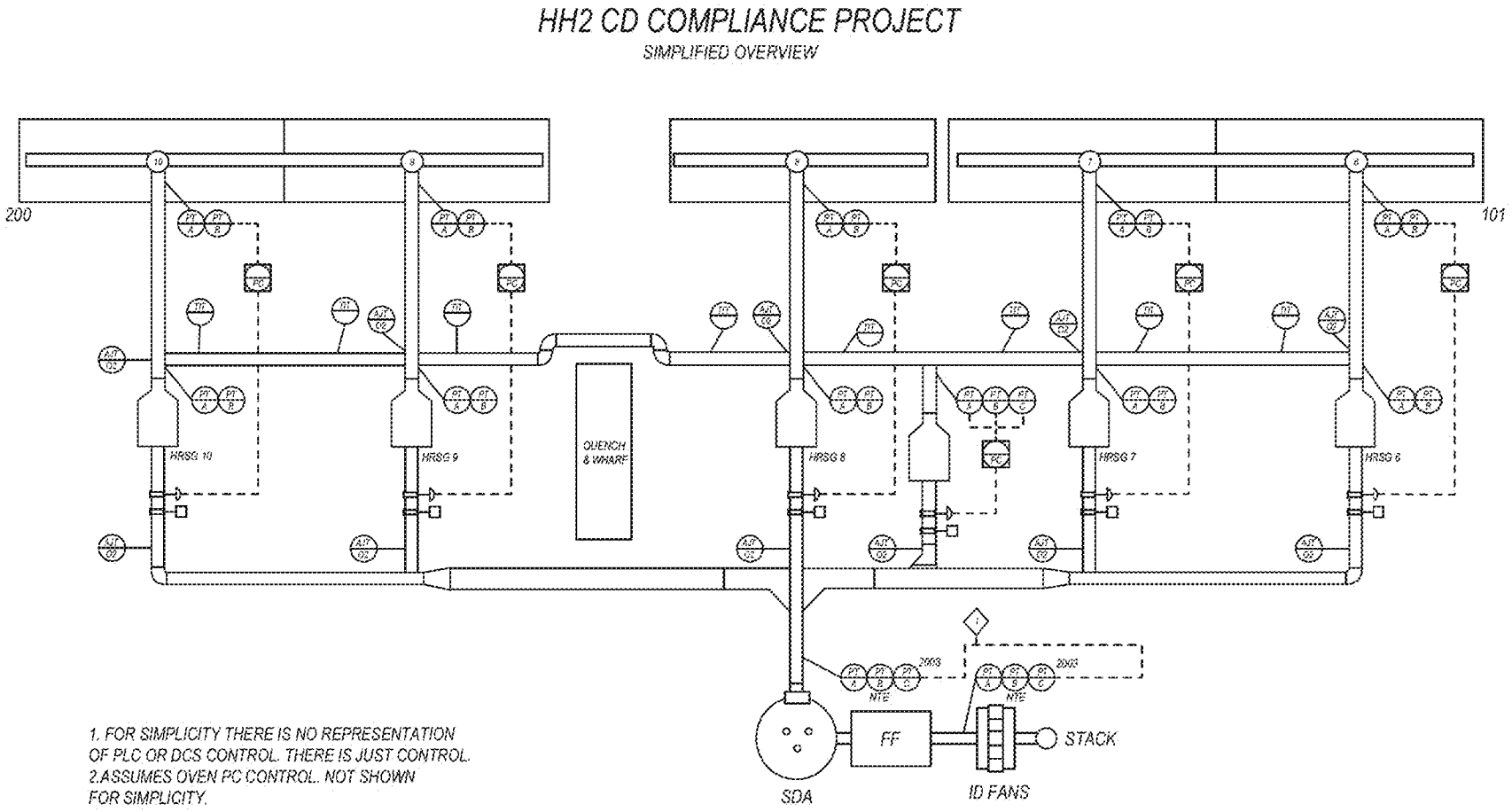
FIG. 5: Schematic of 100 oven plant with gas sharing tunnel and downstream operations. Emergency vent stack control draft scheme is shown in accordance with aspects of the disclosure.

FIG. 5 shows the schematic of a plant with additional gas sharing tunnel and an additional redundant heat recovery steam generator. This scheme is used in plants where venting needs to be prevented from the emergency vent stack when a heat recovery steam generator goes down. The gas sharing tunnel enables the gas from the heat recovery steam generator that is down to be sent to the new redundant heat recovery steam generator instead of being vented to the atmosphere from the vent stack. This scheme connects all the heat recovery steam generator together and hence the interaction between the heat recovery steam generator greatly increases during normal operation. This makes control of the emergency vent stack draft even more challenging. The normal scheme (as shown in FIG. 4) resulted in the PICs of different heat recovery steam generators fighting against each other inducing severe cycling. This is because the flue gas, after the emergency vent stack, can either go the gas sharing tunnel or the corresponding heat recovery steam generator. The path it takes depends on what is happening in the other heat recovery steam generators as well as the tuning of the pressure indicating controllers (PICs) (path of least resistance). An additional complexity is that any variation of gas movement in and out of new redundant heat recovery steam generator (HRSG #11 in FIG. 5 located at the center of all the heat recovery steam generators) affects all other emergency vent stack draft and hence causes a disturbance to all PICs and hence ovens. Control schemes are discussed below to effectively control the emergency vent stack draft during normal operation with redundant heat recovery steam generator and during gas sharing operation with any one of the heat recovery steam generators down.

EVS Draft Control During Normal Operation with All HRSGs Running

Control Scheme H1: EVS Draft PIC with #11 Under Inlet PIC

In this scheme, the individual emergency vent stack pressure, before the tie-in point to the new tunnel, are controlled using the corresponding pressure control valve downstream of that heat recovery steam generator as shown in FIG. 5. HRSG 11 inlet pressure can be controlled with its pressure control valve. There are two challenges with this scheme. First, when HRSG 11 is under PIC its flow changes when production occurs for any of the battery (ovens getting charged). This is because there is more gas and the PIC starts reacting to maintain pressure. Since HRSG #11 is at the center any movement in #11 causes pressure disturbance in other heat recovery steam generators causing all PTCs to swing and start fighting against each other to maintain their set point. In other words, the system becomes highly interactive. The second challenge is, the pressure that is controlled is at the stack but the valve that is used for PIC is downstream of the heat recovery steam generator and in between the stack and heat recovery steam generator is the tie-in to the gas sharing tunnel. So the gas can go to the tunnel or the heat recovery steam generator. Thus the PIC is not a one to one control i.e. it is difficult to get a direct correlation between the valve movement and the pressure to be used in PIC. Other schemes are described below to overcome these challenges.

Control Scheme H2: EVS Draft PIC with HRSG 11 Under FIC

In order to overcome the first challenge mentioned in scheme H1, one can control the mass flow (or steam flow) form the heat recovery steam generator. A mass flow meter can be used to measure the flue gas flow through the heat recovery steam generator. Having the heat recovery steam generator under flow control ensures a fixed flow through the heat recovery steam generator at all times (production and non-production times). This is like isolating the heat recovery steam generator and removing the interactions caused by heat recovery steam generator flow changes to the other heat recovery steam generators.

Control Scheme H3: HRSG Inlet PIC with HRSG 11 Under Inlet PIC

In order to overcome the second challenge mentioned in control scheme H1, the heat recovery steam generator inlet pressure, after the tie-in point, can be controlled. This serves as a direct PIC scheme and a model between pressure control valve and heat recovery steam generator inlet pressure can be readily obtained by step test data collection methods. A better model for controller enables one to tune the PIC much tighter ensuring a superior control (model uncertainties typically result in bad controller tuning and hence poor pressure control). It is extremely important to have good and tight control of the individual heat recovery steam generator pressure in order to prevent and minimize the interaction between different heat recovery steam generators caused by the common gas sharing tunnel. For example, if the PICs are tuned slowly, when there is excess gas causing increase in pressure, the pressure control valve will react slowly to let the excess gas go through the heat recovery steam generator. Now, the excess gas will start going to the other heat recovery steam generators through the new gas sharing tunnel. This will hence affect the other heat recovery steam generator PICs. Similarly, if one PIC swings other PIC will start swinging. Hence, to have good operation with gas sharing tunnel it is important to have the PICs working in concert.

Control Scheme H4: HRSG Inlet PIC with HRSG 11 Under FIC

To overcome both challenges described in control scheme H1, we can use HRSG inlet PICs and FIC on #11.

EVS Draft Control During GS Operation with One HRSG Down

When one of the heat recovery steam generator goes down, depending on which heat recovery steam generator, the draft set points (SP) for the heat recovery steam generators and flow set point for #11 (if control schemes H2 or H4 is used) have to be changed so that the flue gas from the heat recovery steam generator that is down can be sent to other heat recovery steam generators. The draft and flow set point have to be chosen carefully in order to have a smooth transition, minimize the interactions, stabilize the system quickly and prevent any emergency vent stack from opening during the transition. The draft and flow set point for control scheme H4 for different scenarios is shown in Table 1.

TABLE 1

| HRSG | None | 6 | 7 | 8 | 9 | 10 | 11 |
|---|---|---|---|---|---|---|---|
| | | HRSG Down (draft SP in WC) | | | | | |
| 6 | −0.95 | | −1.15 | −0.95 | −0.95 | −0.95 | −0.95 |
| 7 | −0.95 | −1.25 | | −0.95 | −0.95 | −0.95 | −0.95 |
| 8 | −1 | −0.9 | −0.9 | | −0.9 | −1.05 | −1 |
| 9 | −1.05 | −1.05 | −1.05 | −1.05 | | −1.35 | −1.05 |
| 10 | −1.15 | −1.15 | −1.15 | −1.15 | −1.35 | | −1.15 |
| | HRSG Down (Flow SP KPPH) | | | | | | |
| 11 | 40 | 90 | 80 | 80 | 80 | 100 | |

Figure 6:
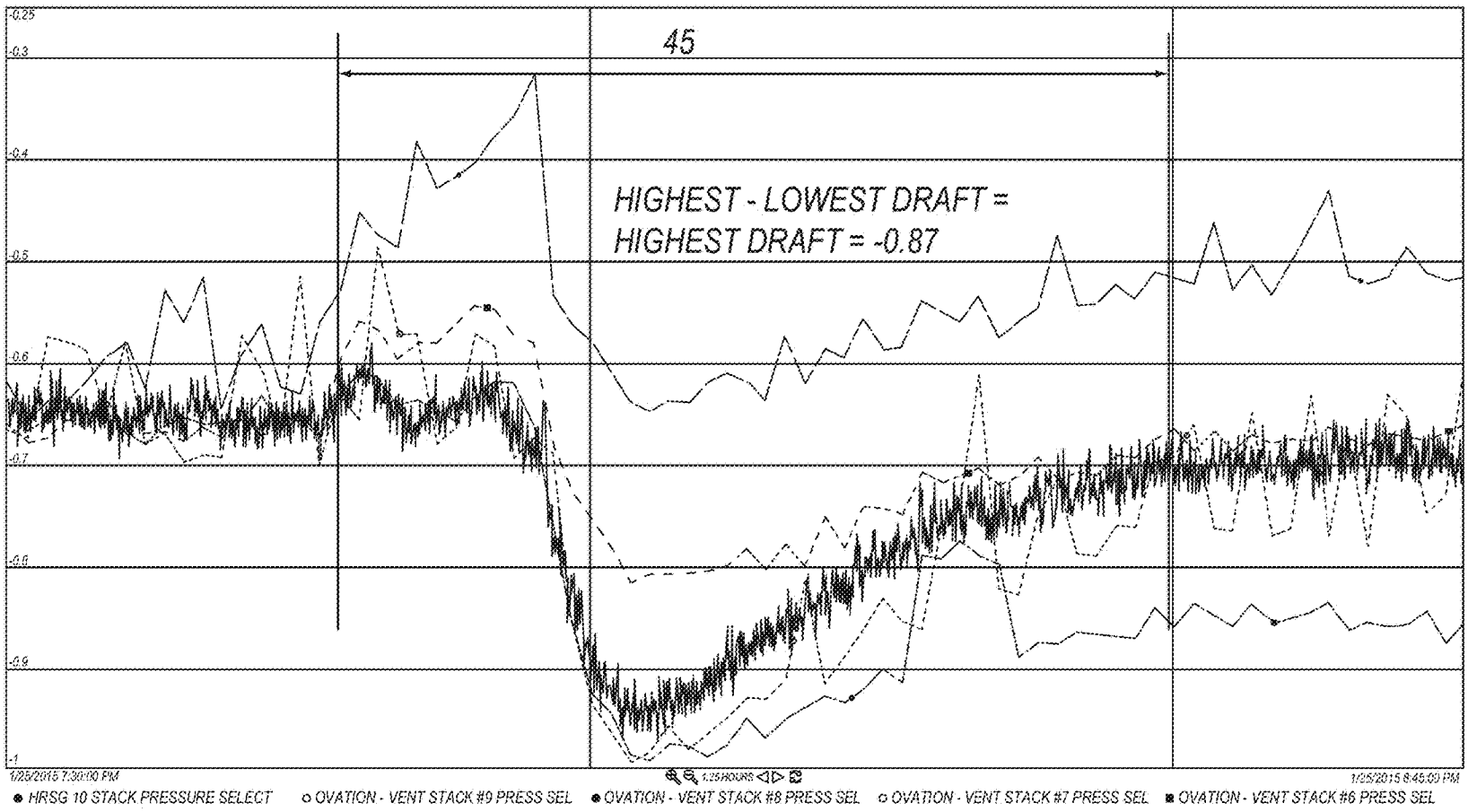
FIG. 6: Stack pressure response during heat recovery steam generator (HRSG) trips using control scheme H4 in accordance with aspects of the disclosure.
Figure 7A:
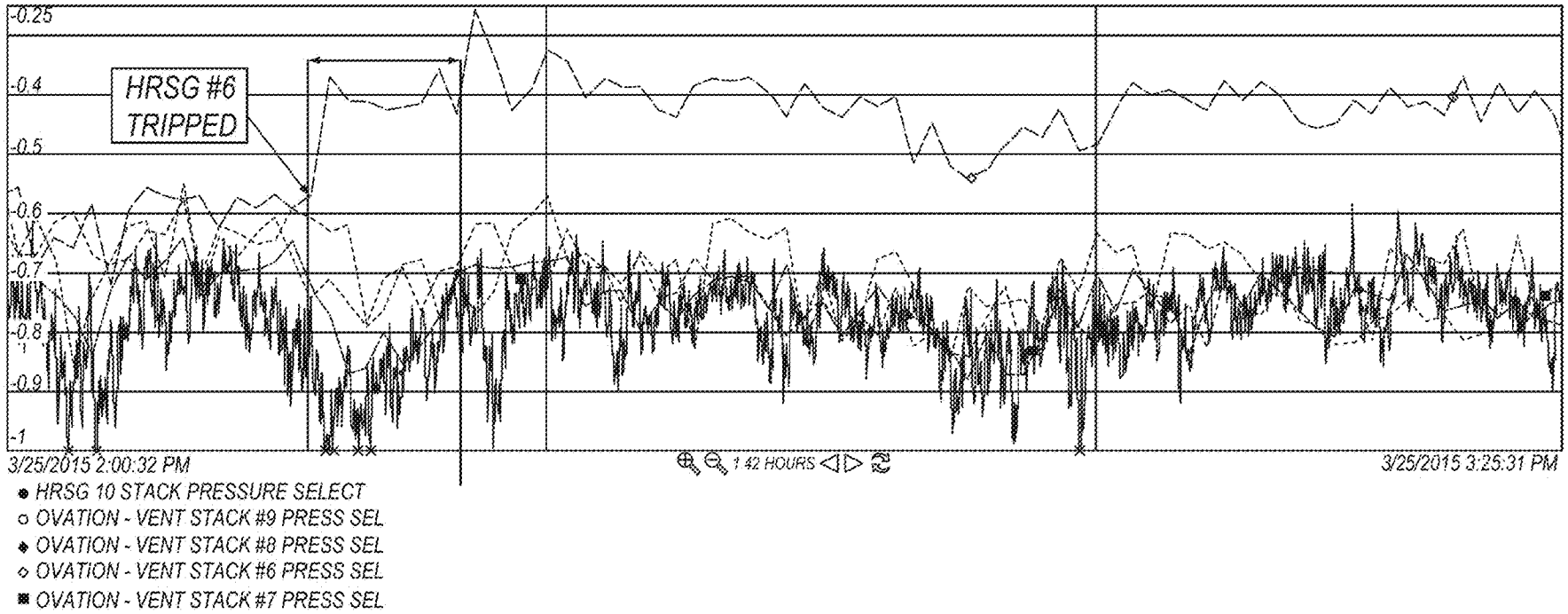
FIGS. 7A and 7B: Illustrate a stack pressure response during heat recovery steam generator trip using control scheme H3 and H4 in a transition response when #7 HRSG shut down in accordance with aspects of the disclosure.
Figure 7B:
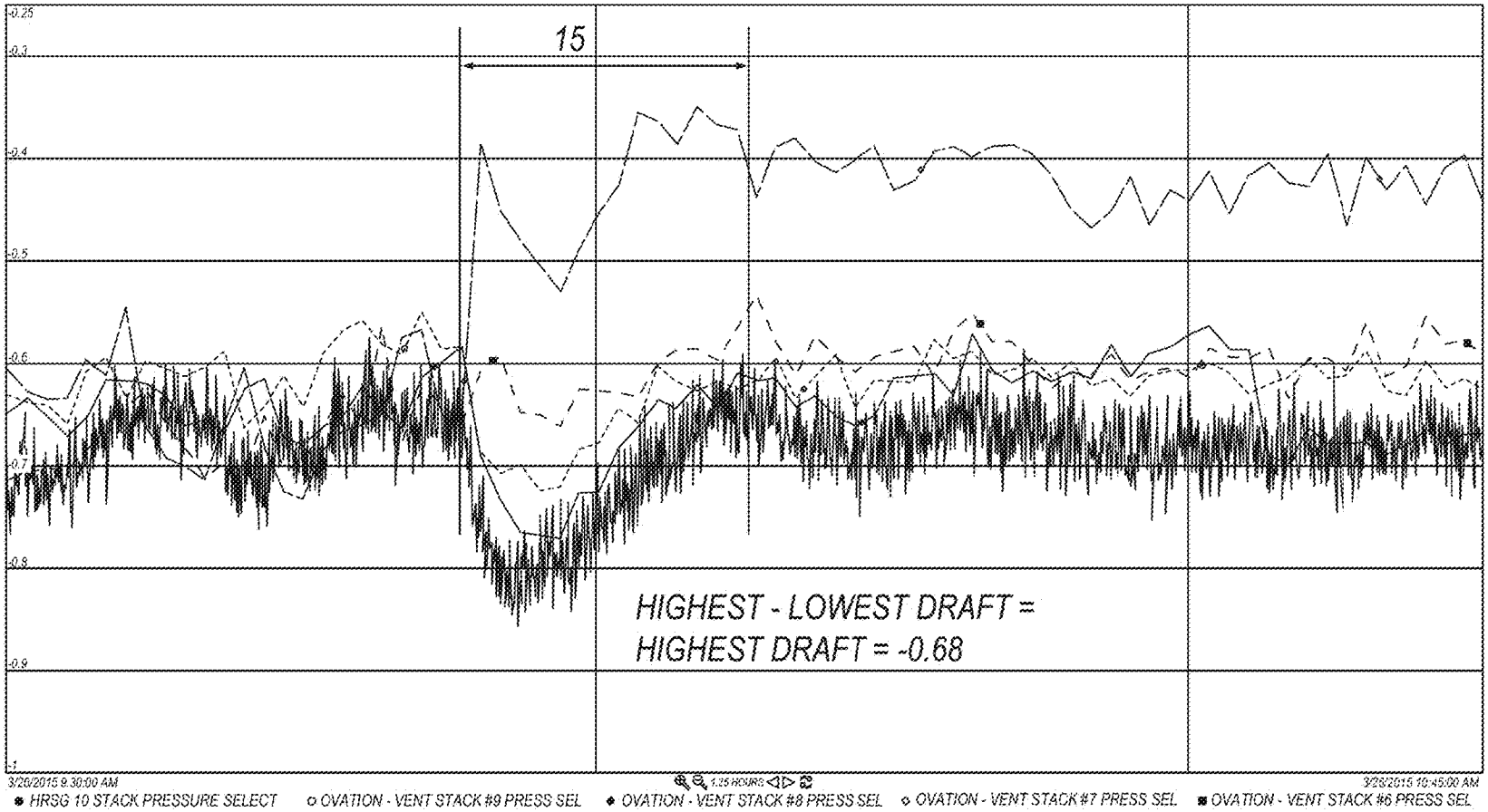
Figure 8:
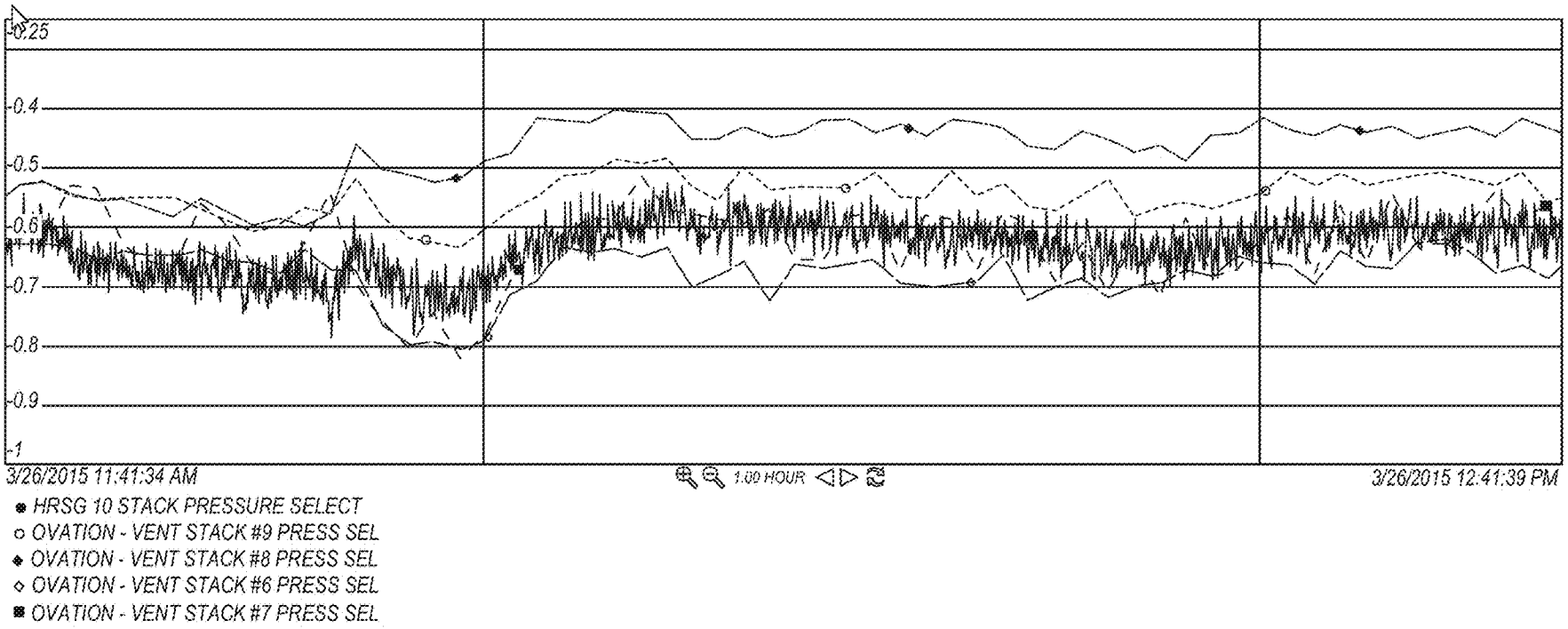
FIG. 8: Illustrates a stack pressure response during heat recovery steam generator (HRSG) trips using control scheme H4 in a transition response when #8 HRSG shut down in accordance with aspects of the disclosure.
Figure 9:
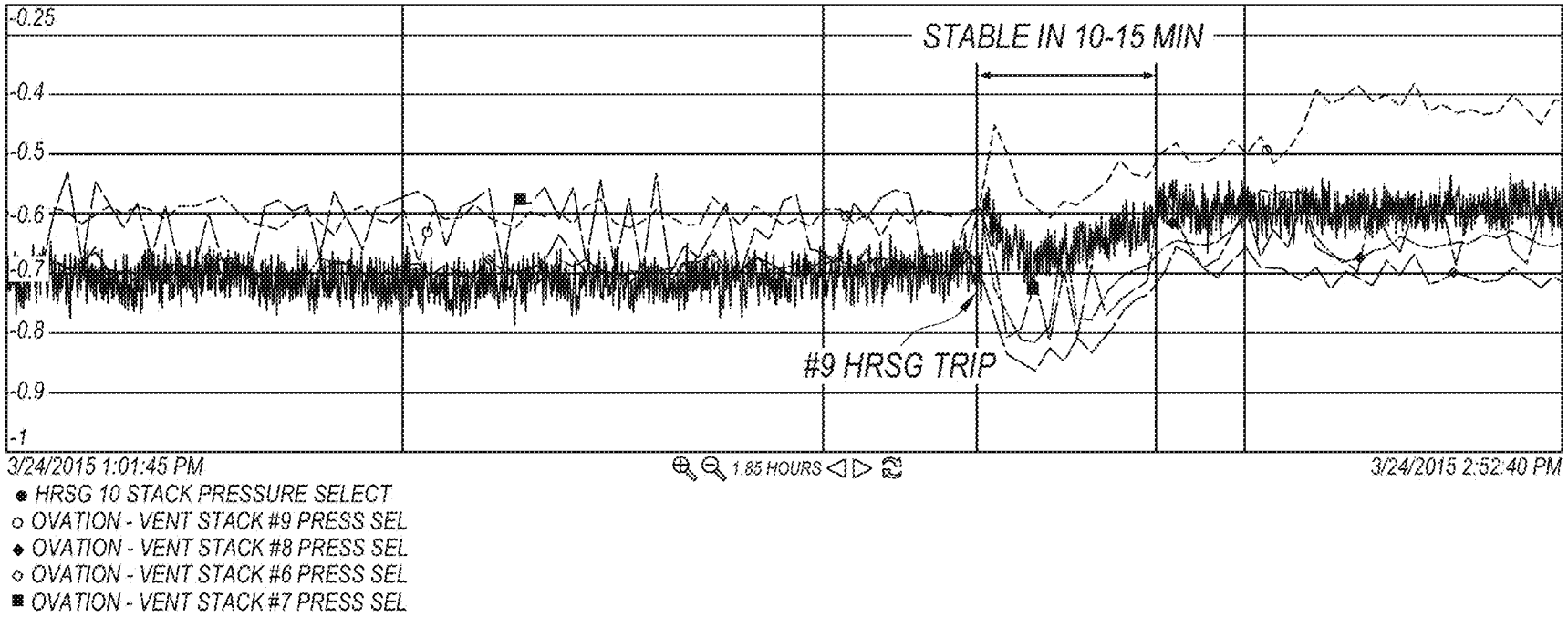
FIG. 9: Illustrates a stack pressure response during heat recovery steam generator trips using control scheme H4 in a transition response when #9 HRSG shut down in accordance with aspects of the disclosure.
Figure 10:
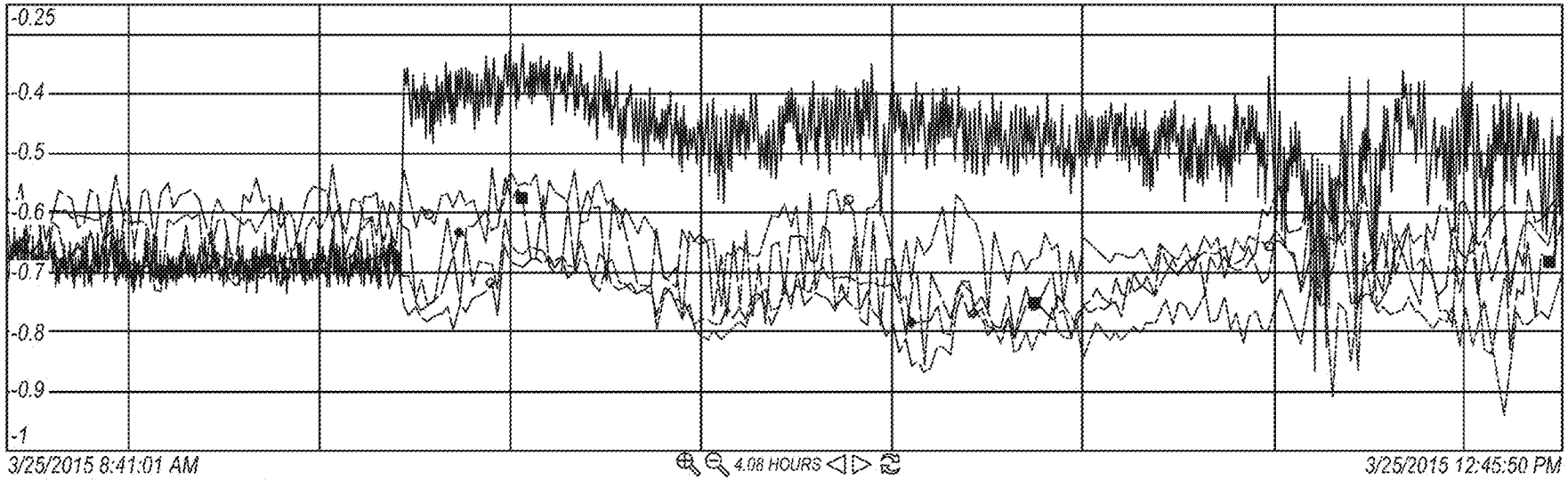
FIG. 10: Illustrates a stack pressure response during heat recovery steam generator trips using a control scheme in a transition response when #10 HRSG shut down in accordance with aspects of the disclosure.

FIG. 6 show the responses of the emergency vent stack pressures when different HRSG #6 went down using control scheme H3 and FIG. 7 show the responses of the emergency vent stack pressures when HRSG #7 went down using control scheme H3 and H4 with set points in Table 1. As can be seen from the figures the control system H4 was able to respond and stabilize the emergency vent stack pressures much quickly (15 min compared to 45 min) and without venting causing the least amount of disturbance to the ovens upstream. Moreover, the draft requirements for the stacks were also lower and the highest draft was at least 0.1 in WC lower with control system H4 compared to H3. Having a lower draft at emergency vent stack causes less air leaks and hence keeps the oven hotter without cooling down due to excess air. Hotter ovens imply higher coking rate and prevents any coking delays.

Transition responses using control scheme H4 during other heat recovery steam generator trips are show below.

Oven Pressure and Temperature Control System

The Haverhill plant Phase II Ovens have been modified in order to automatically control the pressure within each oven while maintaining similar pusher and coke side sole flue temperatures. This is done using a pressure sensor in the crown of each oven, the existing sole flue temperature probes and radar systems. The radar systems replace the proximity switches and perform the same function of monitoring damper position.

The oven pressure sensor reading is used by a programmable logic controller (PLC) which sends a signal to the oven uptake dampers in order to keep the oven pressure at a pre-determined set point. The oven pressure is controlled by moving the coke side and pusher side dampers in the same direction.

The sole flue temperatures are used by a separate PLC controller which sends a signal to the oven uptake dampers in order to keep the oven sole flue temperatures within 100 degrees of each other. This action, called temperature biasing, is accomplished by moving the coke side and pusher side dampers in the opposite directions. This movement forces more hot gas from the side whose damper is closing to the side whose damper is opening.

Although the outlet dampers are automatically controlled, the sole flue dampers and the door dampers may continue to be manually controlled by the burner or operator. Rules for adjustment of the sole flue dampers and the door dampers will not change due to this modification.

HMI Screen for Damper Controller

Each oven screen (Exemplary Screen Shot 1) has been modified. The proximity indicators have been replaced with radar position indicators. The radar position indicators show the actual coke side and pusher side damper openings and the set points that the system wants. Above each set of readings there is a button which opens the damper controller (Exemplary screen shot 2).

A. The top button of the controller places the controller in automatic or manual. The sole flue temperature control system (temperature bias) will be active in the automatic setting and inactive in the manual setting. FIG. 3 indicates that the controller is in manual control.

B. The next button locks and unlocks the damper. The condition is indicated to the right of the lock.

C. The damper position can be manually set using the SELECT dropdown menu, SET button and Begin Move button. When clicked the dropdown arrow will show a window with values ranging from 2 to 14 inches. After selecting a value, the SET button is clicked. When CURR SETPT displays the new set point, the BEGIN MOVE button can be clicked. Movement of the damper will be indicated to the right of the CLOSE button (TRVL).

D. The TEACH button is used for maintenance purposes and will only be clicked by appropriate maintenance personnel.

E. The STOP button can be clicked to end damper movement.

F. Wandering of the damper opening during operation may occur. The system can automatically correct for this drift. Clicking the DRIFT ENBL button will enable or disable automatic correction for drift. Drift correction will work in manual mode as well as in automatic mode. When there is an occurrence of drift to either the closed or open position, it is recorded in the drift count box. The counts can be reset to zero by clicking the DRIFT COUNTER RESET button.

G. There are three alarms.

1. Sensor Fault/Bad Value indicates that the pressure sensor is giving an out of range value. This fault will cause the damper controller to switch to manual. The damper setting stays at the last position before the fault.
2. DMPR POS FLT (Damper Position Fault) indicates that the radar position indicating system has failed. This fault will cause the damper controller to switch to manual. The damper setting stays at the last position before the fault.
3. DMPR Drift (Damper Drift) alarms when the drift count has been exceeded. It is alarm only and has no effect on the control system.
4. Alarms can be reset by clicking the ALARM RESET button.

H. The CLOSE button will remove the dialog box from the screen.

HMI Screen for Pressure Control Set Point

Each oven screen has also been modified to include an oven pressure set point button. When the button is clicked, the oven pressure controller dialog box will appear (Exemplary screen shot 4).

The dialog box shows the current oven pressure set point. To input a new set point, the SET button is clicked. This will open the set point keypad (Exemplary screen shot 6).

The set point must be a negative number and be within the range of −0.1 to −1.5. The new set point is entered in the New Value window and the OK button is clicked. The new set point will appear in the oven pressure controller dialog box. Clicking CLOSE will remove the dialog box from the screen.

Other HMI Screen Modifications

Information concerning oven pressure, damper operating mode (automatic or manual), damper drift (enabled or disabled) and temperature bias (active or inactive) is available on the individual oven screen (Exemplary screen shot 1) and the oven overview screen (Exemplary screen shot 7). The percentage of ovens that are in automatic pressure control is indicated at the top of the oven overview screen. A yellow triangle over the overview screen's damper position indicates that there is a sensor or damper position fault.

Oven Control Schemes

Once the downstream heat recovery steam generator control can stabilize the emergency vent stack pressures the ovens are practically decoupled from downstream operations and hence can be independently controlled using different control schemes discussed below. Disturbances do occur when one of the heat recovery steam generator goes down since the emergency vent stack stacks have to operate at a different draft. This will be handled in the oven control scheme by using a feedforward variable control action that will be discussed below (at the end of the oven control schemes).

Single Loop Control

These are independent one-to-one controllers where each controlled variable is controlled by a corresponding manipulated variable.

Figure 11:
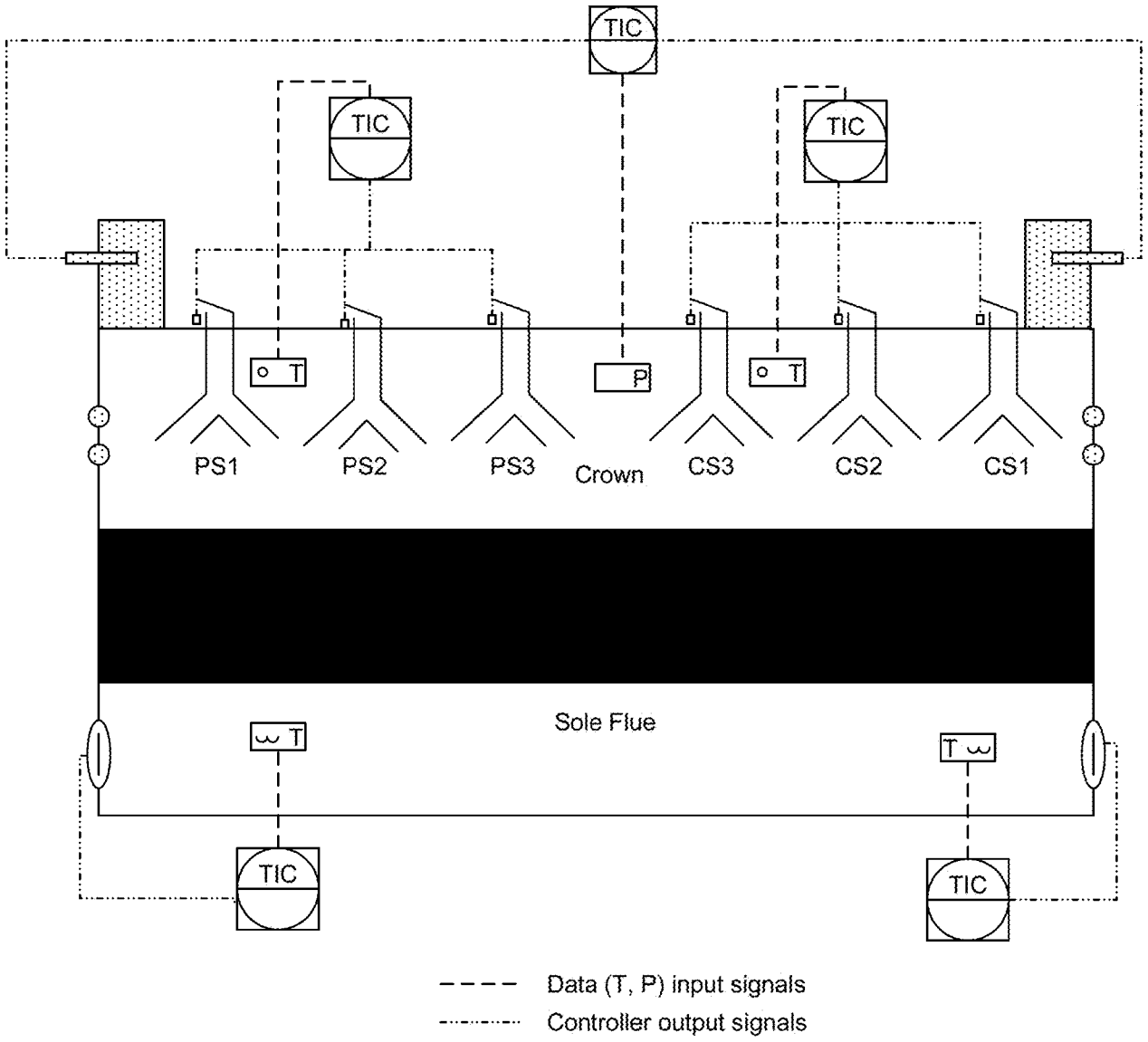
FIG. 11: Schematic diagram of single loop control scheme 1 with top air configuration in accordance with aspects of the disclosure.

Control Scheme 1: In this scheme, the coke side crown temperature is controlled using coke side door or top air holes or holes that are in any non-movable surface on the coke side of crown, the push side crown temperature is controlled using push side door or top air holes or holes that are in any normally non-movable surface on the push side of crown, sole flue (SF) coke side temp is controlled by the coke side sole flue damper, sole flue (SF) push side temp is controlled by the push side sole flue damper and the draft in the oven measured by the crown pressure cell is controlled by the uptakes. A schematic diagram of the control scheme is shown in FIG. 11.

Figure 12:
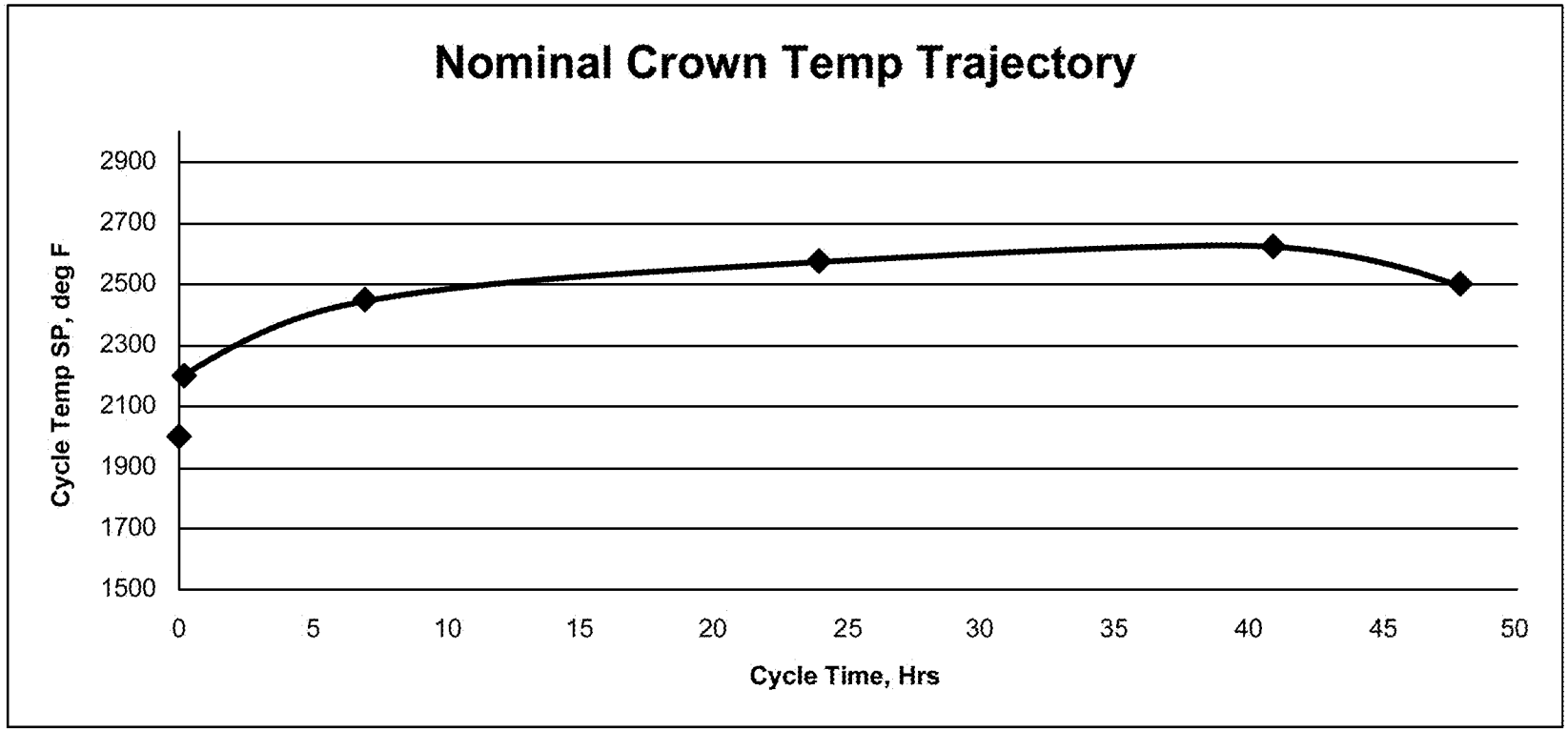
FIG. 12: Example of crown set point trajectory in accordance with aspects of the disclosure.
Figure 13:
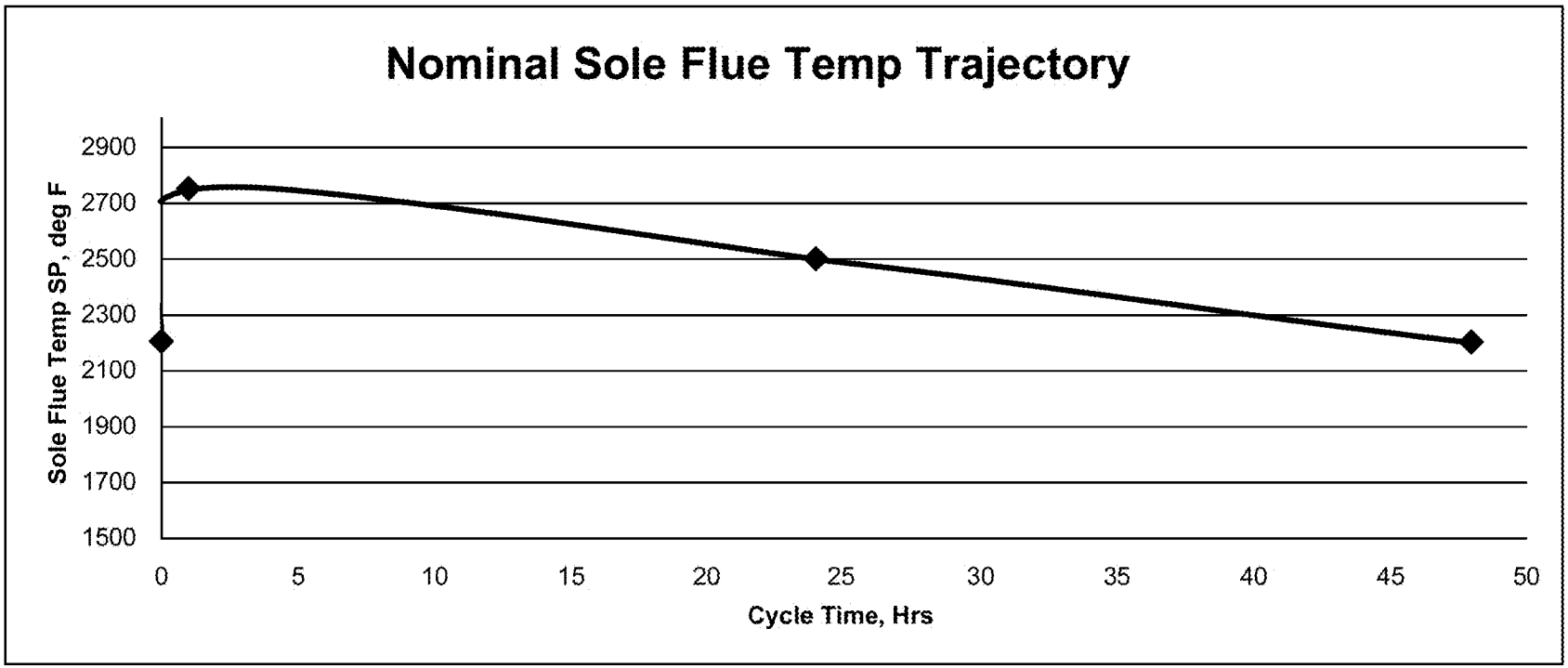
FIG. 13: Example of sole flue set point trajectory in accordance with aspects of the disclosure.
Figure 14:
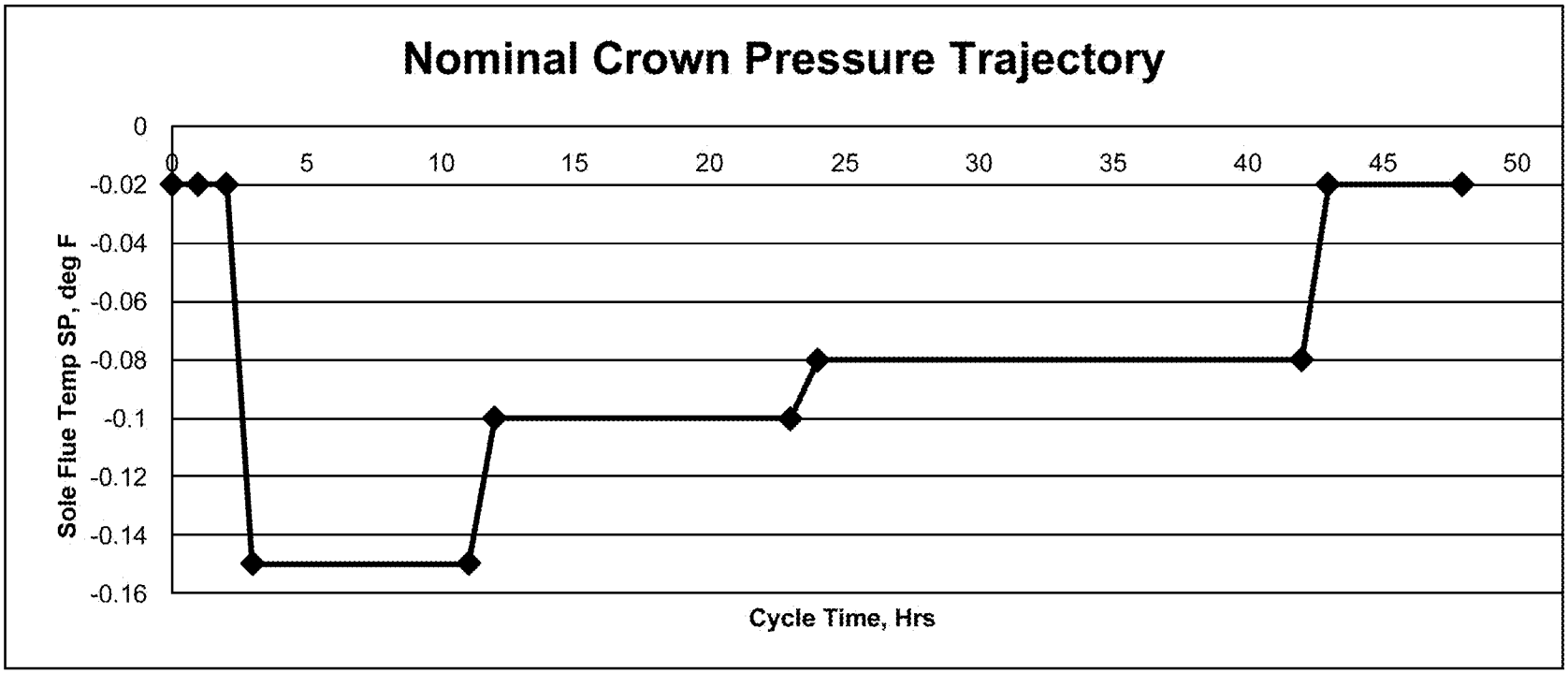
FIG. 14: Example of crown draft set point trajectory in accordance with aspects of the disclosure.

The set point (SP) for the temperature and draft controllers as a function of time is supplied by the user. FIGS. 12, 13, and 14 show some typical set point trajectories for crown, sole flue temperatures and crown draft as function of the forty eight hour coking cycle that is provided by the user to the control system. The temperature and the draft controllers are tuned to keep the variables close to these set point trajectories by manipulating the manipulated variables.

In this scheme, the temperature controllers try to maintain the temperatures in crown and sole flue, respectively. The draft controller is a knob that can be used effectively to distribute the heat to the crown or sole flue as desired. For example, a higher crown draft would mean that more gas would be burnt in the crown relative to sole flue and a lower draft would mean the opposite. Thus care should be taken while defining the optimum set point trajectories for the crown, sole flue and draft so that the controllers wouldn't fight each other.

Figure 15:
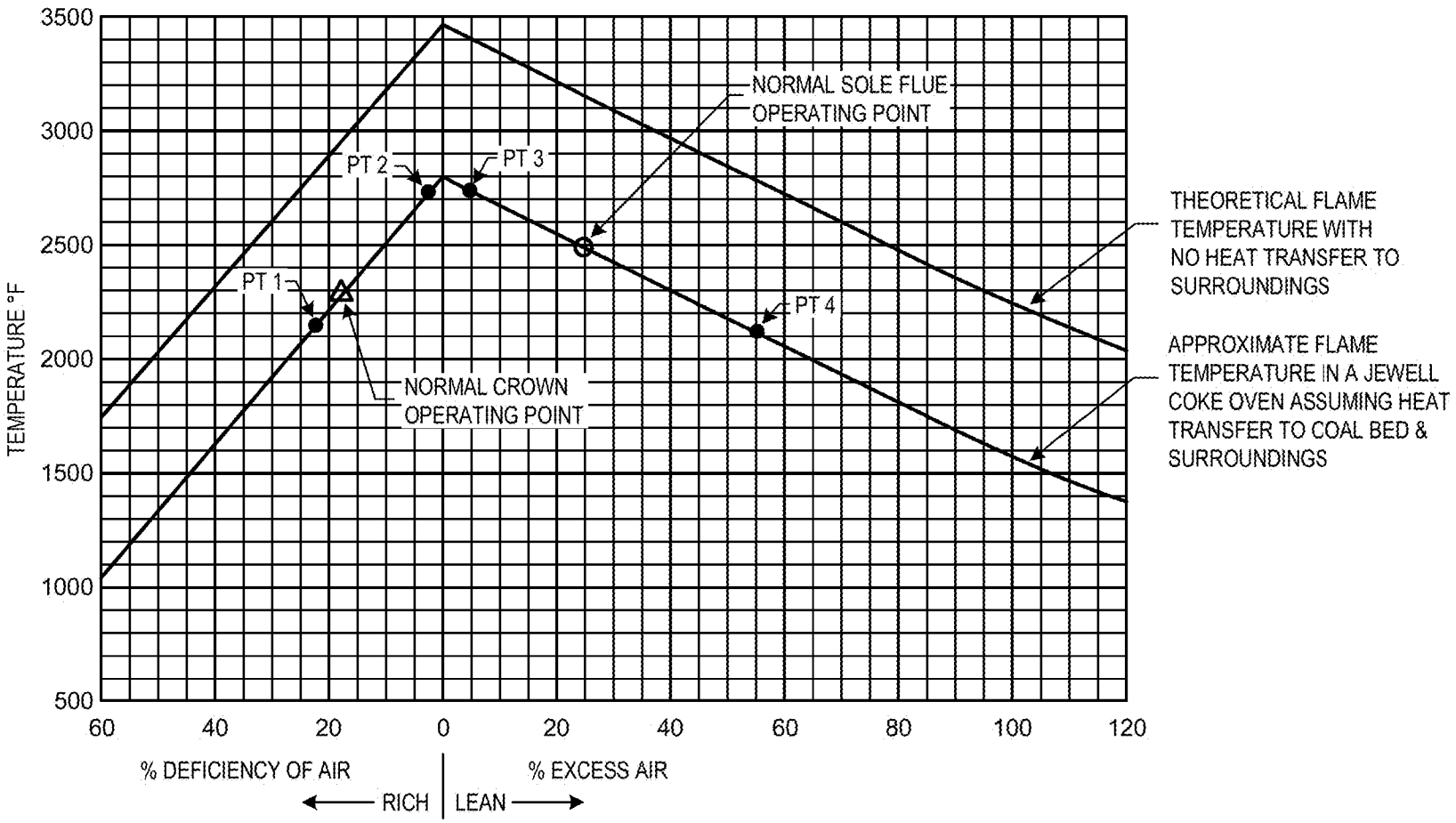
FIG. 15: Oxygen (or Air) vs Temperature relationship in accordance with aspects of the disclosure.

One variable to control for in this control scheme is the changing relationship over time between the damper and the temperature changes. This makes single loop controller (especially PID type controller) tuning very challenging. This can be better explained by the excess oxygen (surrogate for damper opening) vs temperature relationship. FIG. 15 shows the excess oxygen vs temperature graph. As seen from the graph when excess oxygen is less than 0% (oxygen deficient), increase in oxygen results in increase in temperature. This is because, like in the initial part of the coking cycle where volatile matter evolution is highest, there is more fuel available (fuel-rich) than oxygen supplied for combustion. Thus increase in oxygen would mean more fuel can be combusted and hence the temperature increases. On the other hand, when there is excess oxygen as shown in the right side of the graph, increase in oxygen results in decrease in temperature. This is because when the fuel flow becomes lower and there is excess oxygen (or air), increase in oxygen (or air) results in the heat being absorbed by the excess air resulting in the drop in temperature. Thus, depending on whether the atmosphere is fuel-rich or fuel-lean, the manipulated variable (dampers) could have an entirely different effect on the controlled variables (temperatures). Thus the same controller tuning or philosophy cannot be used for fuel-rich and fuel-lean regimes. The question is how to detect the transition from fuel-rich to fuel-lean regime? One approach is to base it on experience from the past batch runs. Typically this transition occurs in the first six to eight hours of the batch. Thus one can program the controller to switch after eight hours from a fuel-rich to fuel-lean scheme. Another approach, as described in control scheme 2, is to use an oxygen analyzer to detect the excess oxygen to make the switch in the controller from fuel-rich to fuel-lean scheme. A third approach, for example, would be to perturb the uptakes up or down by a small amount and see the response in temperature. Based on that one can detect whether it is a fuel rich or fuel lean regime and use the appropriate controller tuning.

The most popular controller type for single loop controller is a proportional integral derivative (PID) controller. Other types of single controller that could be used include fuzzy logic controller, other variants of PID control or user defined algorithm relating the controlled variables to manipulated variables.

Figure 16:
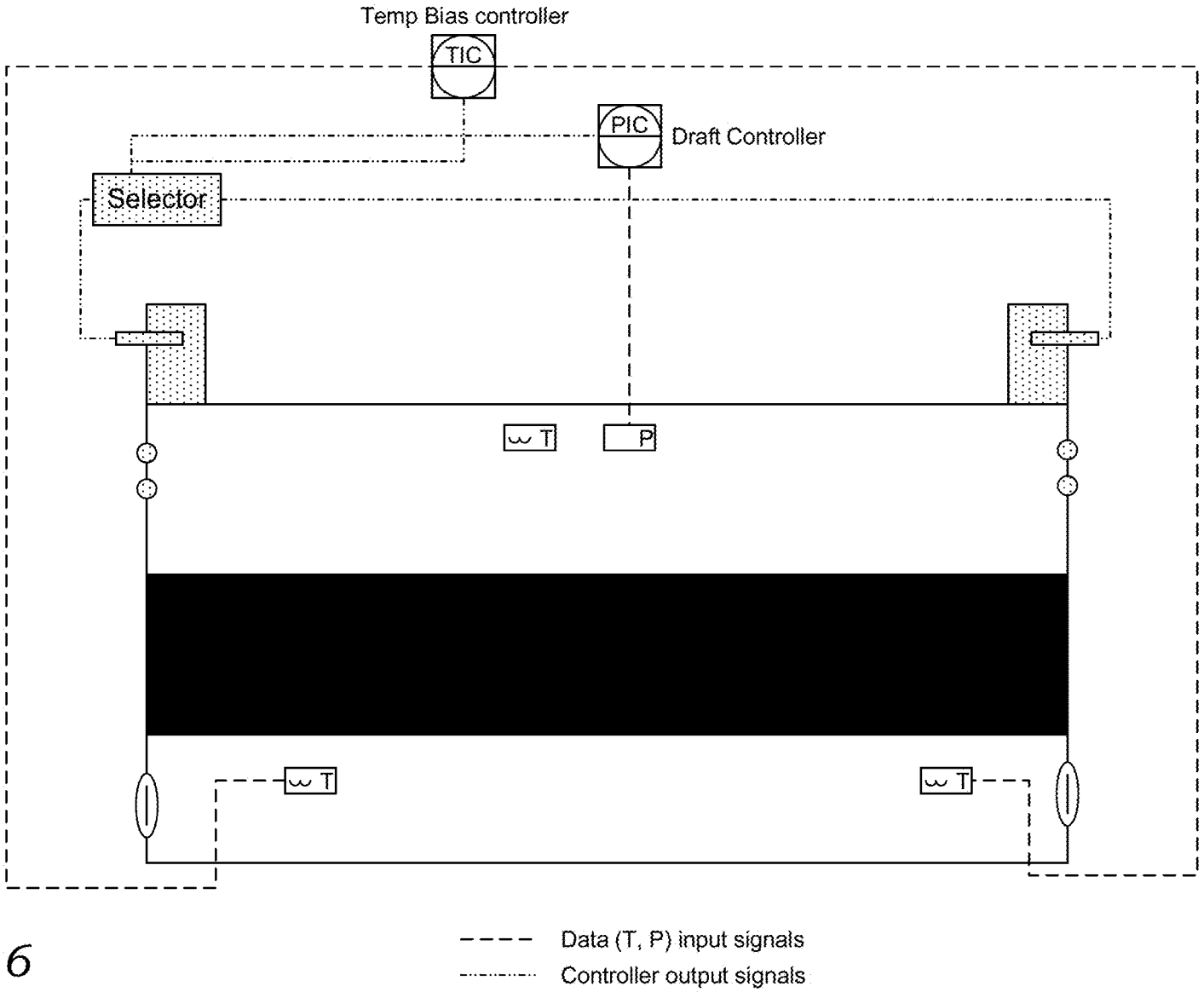
FIG. 16: Illustrates Control scheme 1A when door holes and sole flue dampers are not automated and only uptakes are used for control in accordance with aspects of the disclosure.

Control Scheme 1A: if the door holes and sole flue dampers are not automated then the oven can be controlled by using just the pressure controller to control the crown pressure. The pressure set point trajectory profile can be developed offline by using previous historical data from the ovens to correspond to a desired oven temperature profile. One can also configure some over-ride controller such as temperature bias controller to control the temperature difference between sole flue coke side and push side temperatures to ensure uniform sole flue temperature. This scheme is shown in FIG. 16. One can also develop an advanced temperature to pressure cascade control scheme as described in Control Scheme 1B.

Figure 17A:
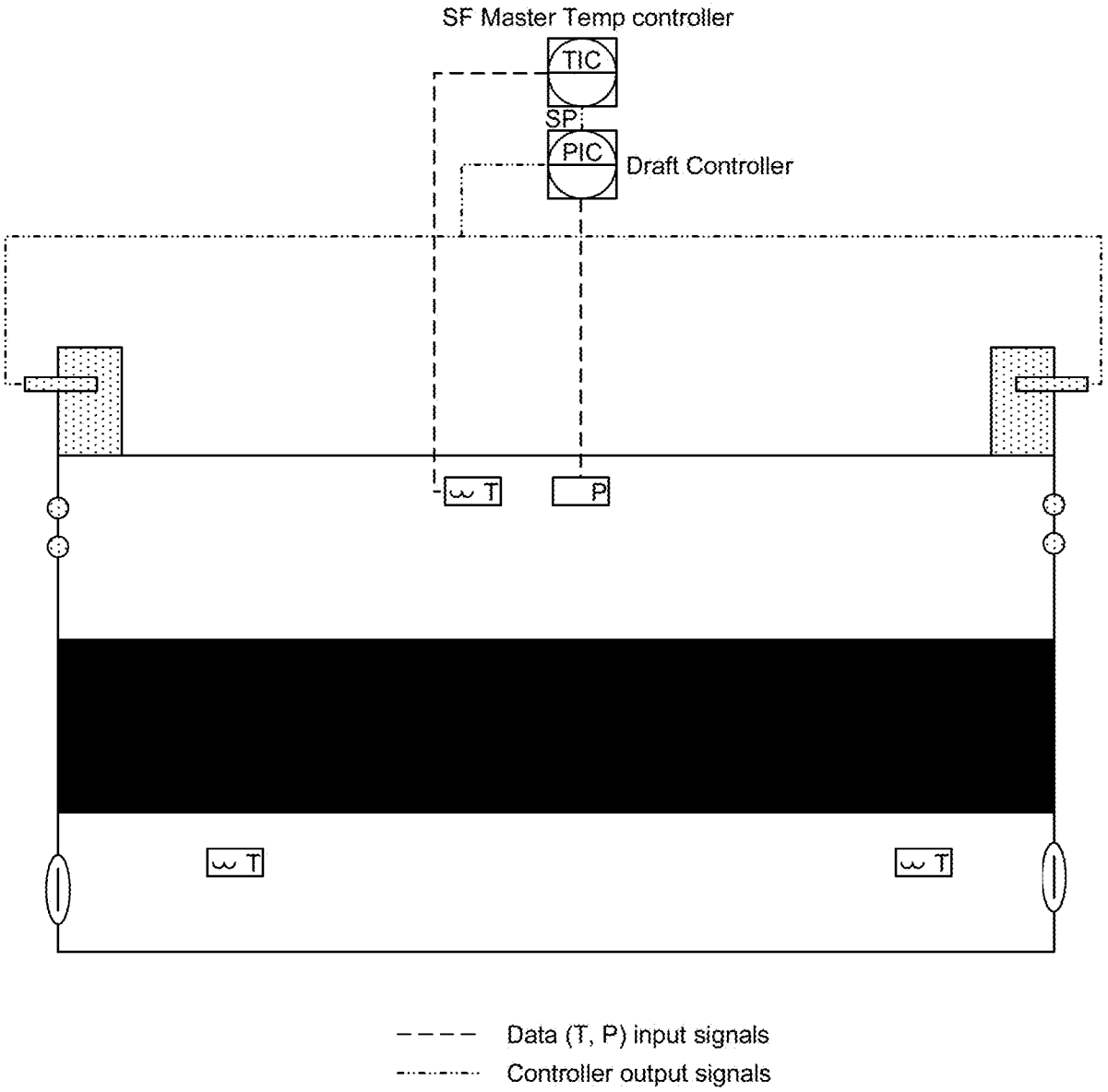
FIG. 17A: Illustrates Control scheme 1B—Crown temperature to draft pressure cascade control scheme in accordance with aspects of the disclosure.
Figure 17B:
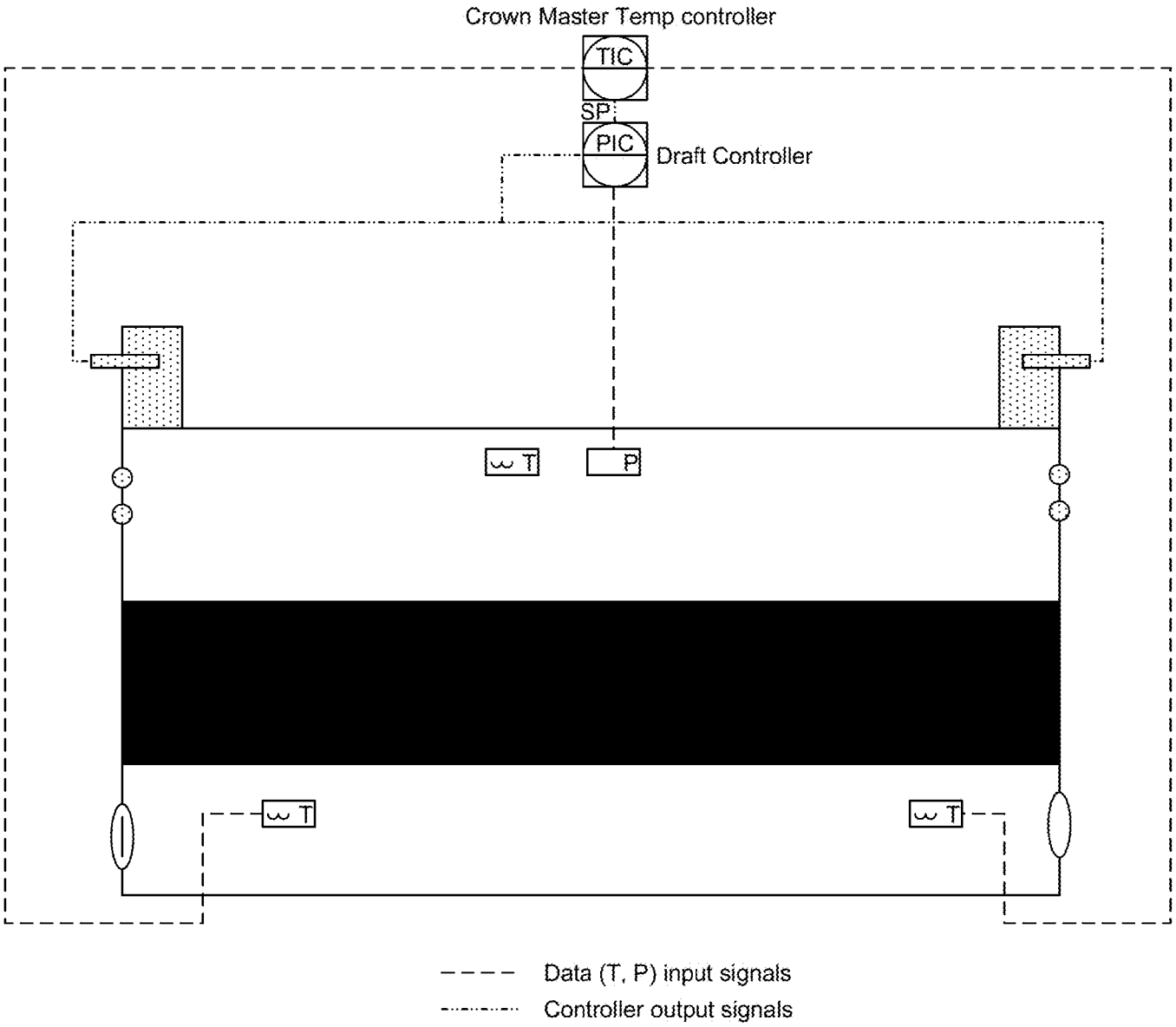
FIG. 17B: Illustrates Control Scheme 1B—Sole Flue Temperature to draft pressure cascade control scheme in accordance with aspects of the disclosure.
Figure 17C:
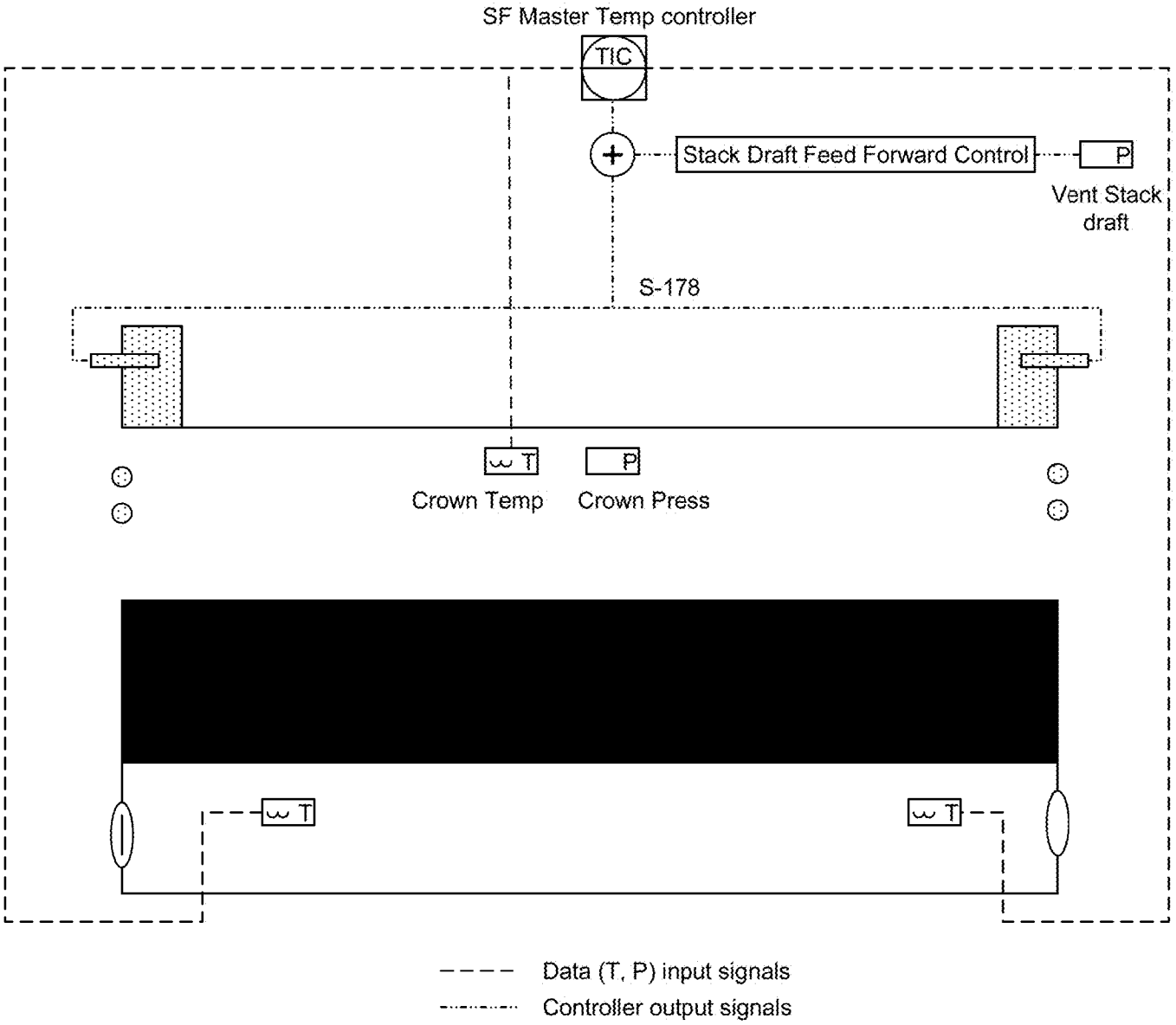
FIG. 17C: Illustrates Control Scheme 1C—Crown and Sole Flue Temperature control scheme with vent stack draft feed forward controller in accordance with aspects of the disclosure.

Control Scheme 1B: If the door holes and sole flue dampers are not automated, control scheme 1 can be modified such that the temperature controller can be cascaded to crown pressure controller. The temperature controller can be configured as a crown temperature controller with a set point trajectory defined for the crown temperature or it can be an average sole flue temperature (average of push and sole flue temperatures) controller. The temperature controller will be the master controller writing its output to the set point of the underlying crown pressure controller. The pressure controller will try to maintain the setpoint required by the temperature controller by using the uptakes. These schemes are shown in FIGS. 17A and 17B.

It should be noted all the above oven control schemes can be implemented without the crown draft PICs. Also the temperature controller can use any combination of the PID elements namely proportional, integral or derivative actions along with a combination of sole flue bias controller. One such scheme is shown in Control Scheme 1C.

Control Scheme 1C: This scheme represents an advanced control scheme consisting of a combination of crown temperature control, sole flue temperature control and a feedforward scheme to offset the effect of stack draft variations during gas sharing scenario. It is basically a combination of control schemes 1A and 1B without the cascaded pressure controller and the addition of feed forward component. Details of the control scheme are shown herein.

Figure 18:
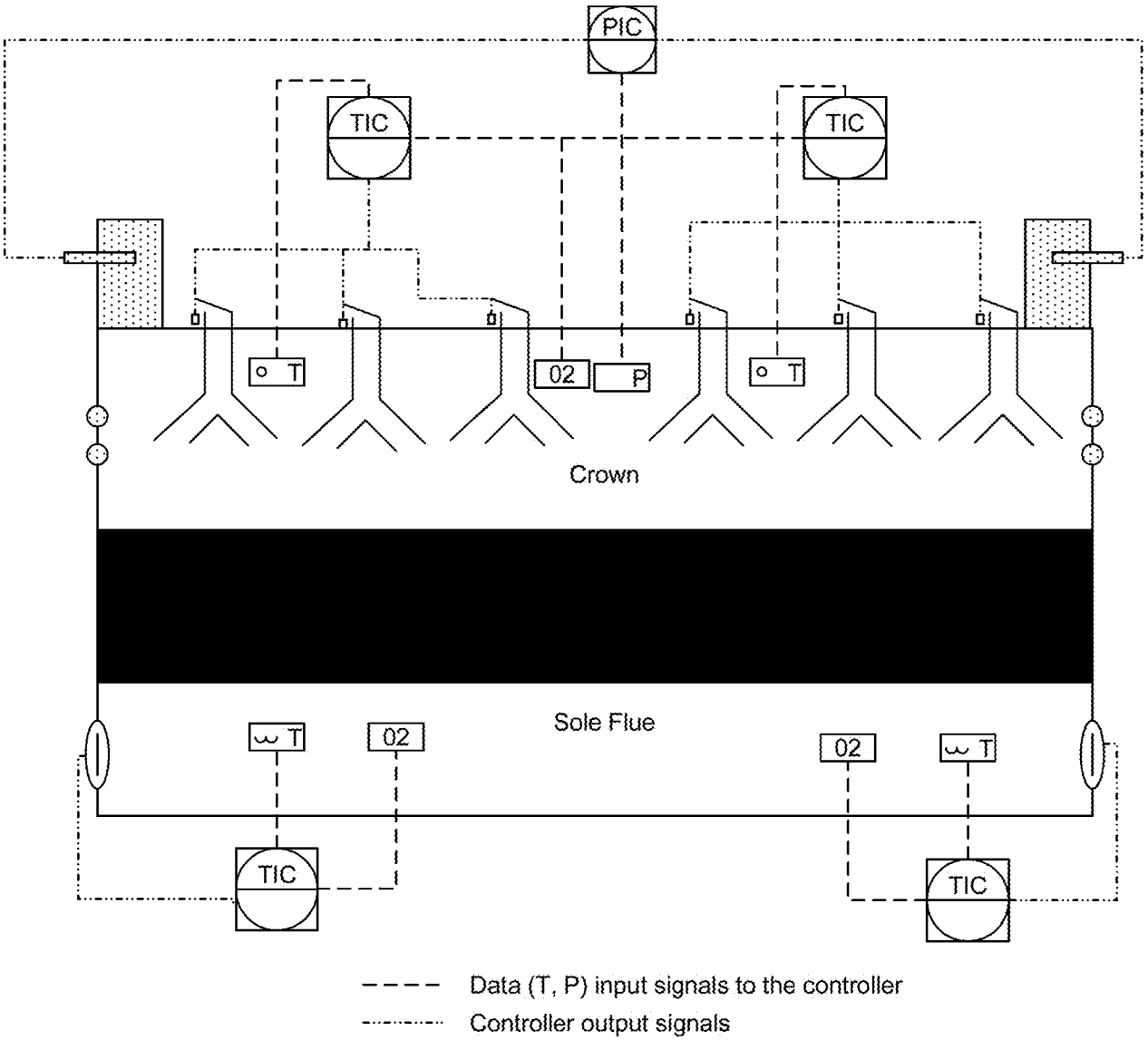
FIG. 18: Single loop controllers with excess oxygen measurement used for detecting the transition from fuel-rich to fuel-lean regime in accordance with aspects of the disclosure.

Control Scheme 2: This is similar to control scheme 1 except that the oxygen analyzer is used to detect the transition from fuel-rich to fuel-lean regime and the controller parameters are changed to handle the switch. This scheme is shown in FIG. 18.

Control Scheme 3: Multivariable Control

Figure 19:
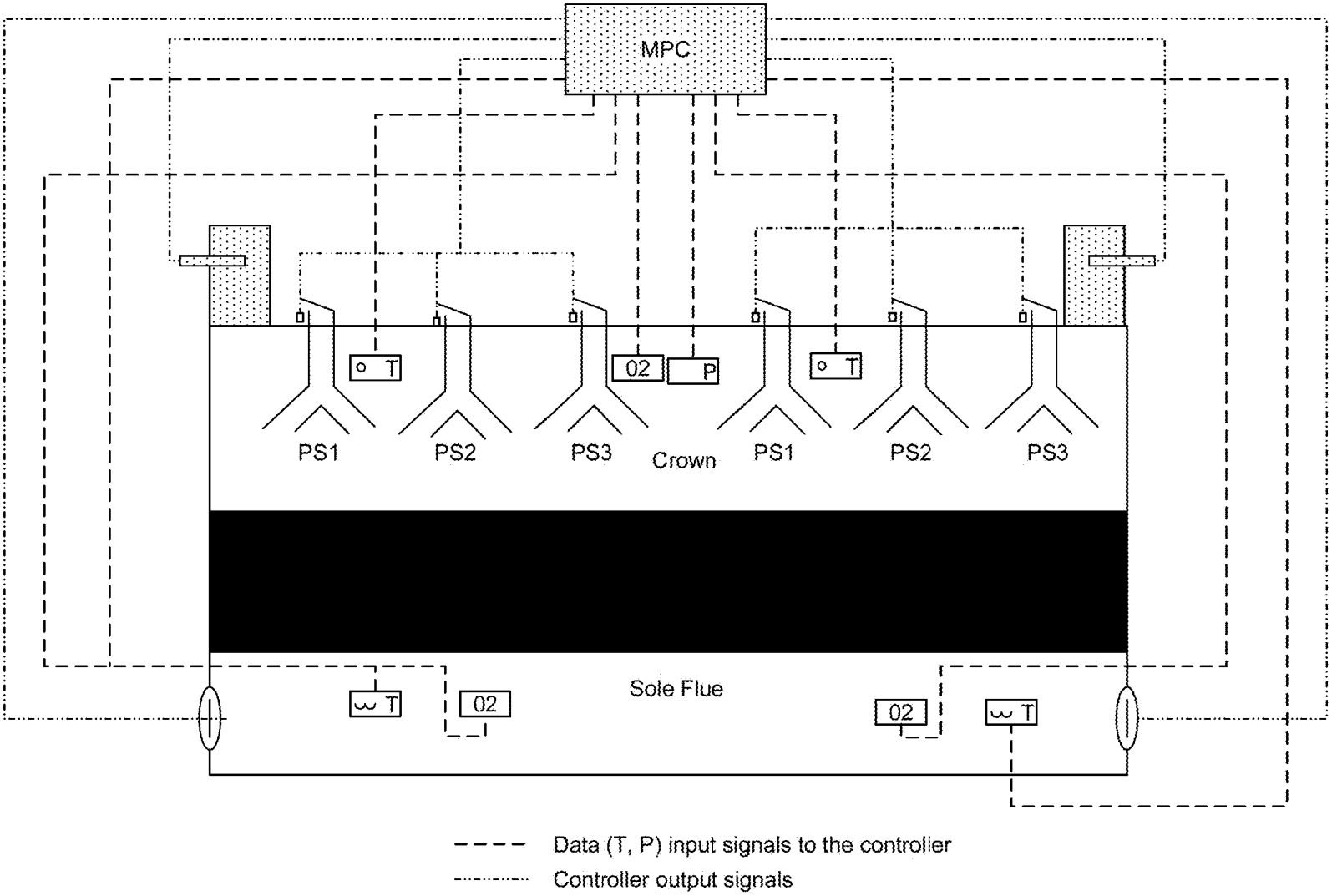
FIG. 19: Schematic representation of multivariable controller in accordance with aspects of the disclosure.
Figure 21:
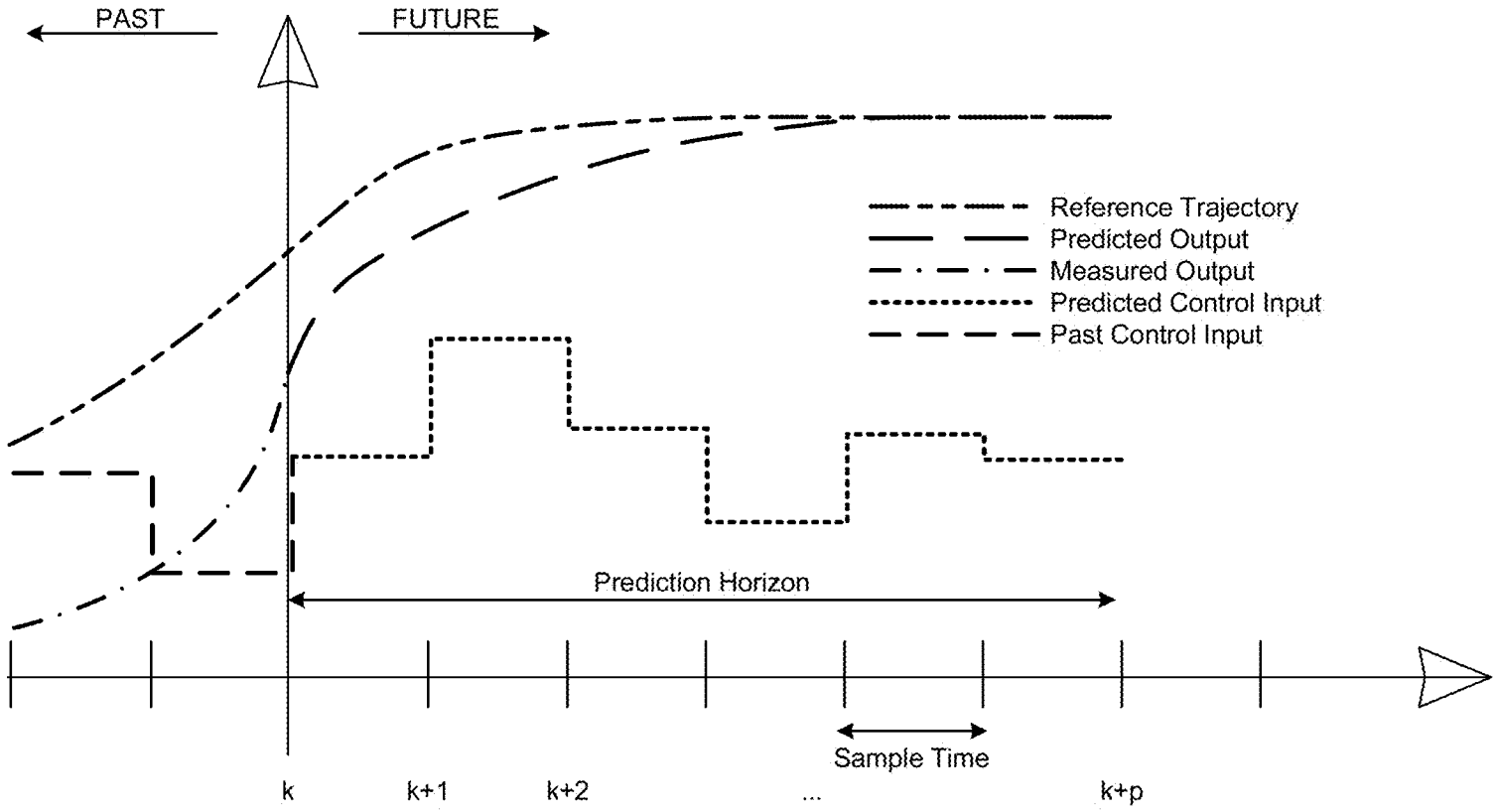
FIG. 21: Depiction of how Model Predictive Control works in accordance with aspects of the disclosure.

Instead of using several single loop controllers that interact with each other one could use a pure multivariable controller such as Model Predictive Control (MPC). This methodology consists of developing empirical dynamic models between the manipulated variables and disturbance feed forward (FF) variables, and controlled variables using data from the ovens. Data can be obtained either from past historical data or from controlled set of experiments by perturbing the manipulated variables and feed forward disturbance variables around a nominal operating trajectory and collecting the response of the controlled variables. Alternatively, if one has a fundamental theoretical nonlinear model of the process then it can be used to get the linear dynamic models around the nominal trajectory by either linearizing the nonlinear model around the nominal trajectory or by perturbing the nonlinear model in a simulation and getting the responses. A matrix is developed representing the relationship between manipulated variables, feedforward variables and controlled variables. Model Predictive Control uses the relationship matrix and the past data within a time horizon, at every instant of time "k", to predict the controlled variable profiles for a future prediction time horizon. The predicted deviation from the set point profile is then minimized by using an optimization program by calculating a set of manipulated variable moves for a future time horizon (could be the end of the batch or a reduced horizon). The first set of manipulated variable moves is implemented. FIGS. 19, 20 and 21 show the schematic representation of multivariable control, example of matrix of relationships, and a depiction of how Model Predictive Control works.

In Model Predictive Control framework, the process model change between air (door holes, sole flue damper, uptakes) and temperature can be handled by switching the model in the matrix or by using a variable gain equation within the controller. Again, the switching time can be decided by using any of the methods described previously in the single loop control schemes.

EXEMPLARY OPERATION OF AUTOMATIC CONTROL

During the first three hours of the coking cycle the uptake dampers are held fully open at 14 inches. After the first three hours the uptake dampers are automatically controlled by the oven pressure. The pressure set point is dependent on the time that has elapsed since the oven was charged. A sample schedule of set points:

| Hours Since Charge | Pressure Set Point |
|---|---|
| 3 hours to 12 hours | =−0.15 inches of water |
| 12 hours to 24 hours | =−0.10 inches of water |
| 24 hours to 42 hours | =−0.08 inches of water |
| 42 hours to end of cycle | Uptake Dampers Closed |

If the difference between the set point and the actual pressure value indicates that the uptake dampers must be adjusted, the PLC calculates the distance that the dampers must be moved and repositions the uptake dampers. The PLC will wait 10 minutes to allow the oven to stabilize before another move is made (if necessary). The minimum move is ½ inch. The maximum move is 3 inches.

The uptake damper opening is limited during automatic pressure control and this limit is dependent on the time that has elapsed since the oven charge. The PLC will not open the uptake damper beyond this point even if the calculated distance would do so. A sample of uptake limits are:

| Hours Since Charge | Damper Opening Limit |
|---|---|
| 3 hours to 12 hours | =14 inches |
| 12 hours to 24 hours | =10 inches |
| 24 hours to 42 hours | =8 inches (if crown temp is ≥2700 and a sole flue temperature is ≥2300)<br>=6 inches (if crown temp is <2700 or both sole flue temps are <2300) |
| 42 hours to end of cycle | =2 inches |

Temperature biasing uses the difference between the coke side and push side sole flue temperatures. If the difference in temperatures exceeds 100 degrees, the PLC calculates the distance that the uptake dampers must be moved and repositions the uptake dampers. The uptake dampers are moved in opposite directions. This movement forces more hot gas from the hotter side (whose damper is closing) to the cooler side (whose damper is opening). The PLC will wait 60 minutes to allow the oven to stabilize before another move is made (if necessary). The minimum move is ½ inch. The maximum move is 3 inches. The PLC will not open the uptake damper beyond the damper opening limit.

Manual Adjustments By The Burner Or Operator During Pressure Control

The sole flue dampers and the door dampers will continue to be manually controlled by the burner or the operator. After the coal charge the crown temperature should be 1900-2,100° F. and the sole flue temperature should be 2000-2,700° F. The guideline for door dampers during the first 20 hours of the coking cycle is:

| Sole Flue Temperature | Door Dampers |
|---|---|
| Less than 2500° F. | 0 open |
| 2500° F.-2600° F. | 1 open |
| 2600° F.-2700° F. | 2 open |
| 2700° F. or more | 3 open |

At 20 hours the crown temperature should be 2500° F. or more and all door dampers closed. Crown temperatures should be periodically checked and controlled to normal operating range since any incomplete combustion in the crown will result in higher sole flue temperatures. At push the crown temperature should be 2400-2,600° F. and the sole flue temperatures 2100-2,300° F.

The maximum crown temperature and the maximum sole flue temperature are 2,800° F. if the crown temperature reaches 2750° F. and continues to climb, decrease the draft to slow down the temperature rise. The draft can be decreased by increasing the oven pressure set point. The burner or operator can override the pre-determined pressure set point by following the instructions stated in HMI SCREEN FOR PRESSURE CONTROL SET POINT.

Example of Overriding Pressure Set Point

Current set point is −0.1 inches of water in oven 102 but at 20 hours, the oven is slow in the cycle and the burner or operator determines that it is likely to run longer than normal cycle time. The burner or operator, while still in pressure control, adjusts the crown pressure to increase the draft within the individual oven by setting the pressure set point to −0.15 inches of water (a −0.05 inch increase in draft). At 24 hours the system will automatically reset the set point to −0.08 inches of water (see set point schedule shown above).

The burner or operator will need to determine if he must adjust the set point again at this time.

The burner or operator can open one oven damper more than the other oven damper. This may be necessary to control sole flue temperatures. This can be done by following the instructions stated in item C of HMI SCREEN FOR DAMPER CONTROLLER.

Example of Biasing Oven Dampers

The burner or operator goes out and makes a hit and has to close up the Push side. From experience the burner or operator knows that the dampers need to be adjusted to avoid a large difference in sole flue temperatures. When the burner or operator gets back to the control room, the burner or operator places the damper controller in manual mode. The burner chooses the appropriate damper opening from the dropdown menu and moves the damper to that opening. The damper controller is placed back into automatic mode and the automatic controls start from the new set point before adjusting again.

The maximum temperature difference between the coke side sole flue temperature and the push side sole flue temperature is 200° F. The sole flue temperatures must be rebalanced to avoid this condition. If rebalancing is required, the following steps should be taken:

First Action: Adjust oven pressure set point to the actual oven pressure reading. This can be done by following the instructions stated in HMI SCREEN FOR PRESSURE CONTROL SET POINT. Check and adjust door and sole flue dampers as necessary to aid in balancing the temperature.

Second Action: Wait 20 minutes. If temperature begins rebalancing, DO NOTHING. When sole flue temperatures are within 100° F., begin stepping oven pressure set point back to where it was before the NTE condition occurred. Report action taken and results to the Turn Manager.

Third Action: If the temperature does not begin balancing within 20 minutes or if the sole flue temperature difference reaches 350 degrees before 20 minutes have elapsed, place both damper controls in manual mode. The burner or operator must manually adjust uptake dampers using the instructions stated in item C of HMI SCREEN FOR DAMPER CONTROLLER. The burner or operator must also adjust door and sole flue dampers as required. When the temperature difference reduces to 100° F., both damper controls can be placed back in automatic and the oven pressure set point returned to where it was before the NTE condition occurred. It may be necessary to bias the uptake dampers in order to maintain balanced sole flue temperatures. This can be done by following the above Example of Biasing Oven Dampers. The burner or operator should monitor the oven and adjust door and sole flue dampers as necessary. The burner or operator should report all actions taken and the results to the Turn Manager.

Burner or Operator Response to Alarms

The alarms listed in item G of HMI SCREEN FOR DAMPER CONTROLLER require the following responses from the burner or operator.

Sensor Fault/Bad Value will cause the damper controller to switch to manual with the damper staying at its last position. The burner or operator must manually control the damper using the instructions stated in item C of HMI SCREEN FOR DAMPER CONTROLLER. The burner or operator must enter an emergency work order to repair the pressure sensor.

DMPR POS FLT (Damper Position Fault) will cause the damper controller to switch to manual with the damper staying at its last position. The burner or operator must manually control the damper using the instructions stated in item C of HMI SCREEN FOR DAMPER CONTROLLER. The burner or operator must enter an emergency work order to repair the radar positioning system.

DMPR Drift (Damper Drift) has no effect on the control system. The burner or operator should enter a work order to inspect and repair the damper linkage.

First Action: Adjust oven pressure set point to the actual oven pressure reading. This can be done by following the instructions stated in HMI SCREEN FOR PRESSURE CONTROL SET POINT. Check and adjust door and sole flue dampers as necessary to aid in balancing the temperature.

Second Action: Wait 20 minutes. If temperature begins rebalancing, DO NOTHING. When sole flue temperatures are within 100° F., begin stepping oven pressure set point back to where it was before the NTE condition occurred. Report action taken and results to the Turn Manager.

Third Action: if the temperature does not begin balancing within 20 minutes or if the sole flue temperature difference reaches 350 degrees before 20 minutes have elapsed, place both damper controls in manual mode. The burner or operator must manually adjust uptake dampers using the instructions stated in item C of HMI SCREEN FOR DAMPER CONTROLLER. The burner or operator must also adjust door and sole flue dampers as required. When the temperature difference reduces to 100° F., both damper controls can be placed back in automatic and the oven pressure set point returned to where it was before the NTE condition occurred. It may be necessary to bias the uptake dampers in order to maintain balanced sole flue temperatures. This can be done by following the above Example of Biasing Oven Dampers. The burner or operator should monitor the oven and adjust door and sole flue dampers as necessary. The burner or operator should report all actions taken and the results to the Turn Manager.

Burner or Operator Response to Alarms

The alarms listed in item G of HMI SCREEN FOR DAMPER CONTROLLER require the following responses from the burner or operator.

Sensor Fault/Bad Value will cause the damper controller to switch to manual with the damper staying at its last position. The burner or operator may manually control the damper using the instructions stated in item C of HMI SCREEN FOR DAMPER CONTROLLER. The burner or operator must enter an emergency work order to repair the pressure sensor.

DMPR POS FLT (Damper Position Fault) will cause the damper controller to switch to manual with the damper staying at its last position. The burner or operator or operator may manually control the damper using the instructions stated in item C of HMI SCREEN FOR DAMPER CONTROLLER. The burner or operator must enter an emergency work order to repair the radar positioning system.

DMPR Drift (Damper Drift) has no effect on the control system. The burner or operator should enter a work order to inspect and repair the damper linkage.

Feed Forward Control to Reject EVS Draft Change Disturbance

Figure 22:
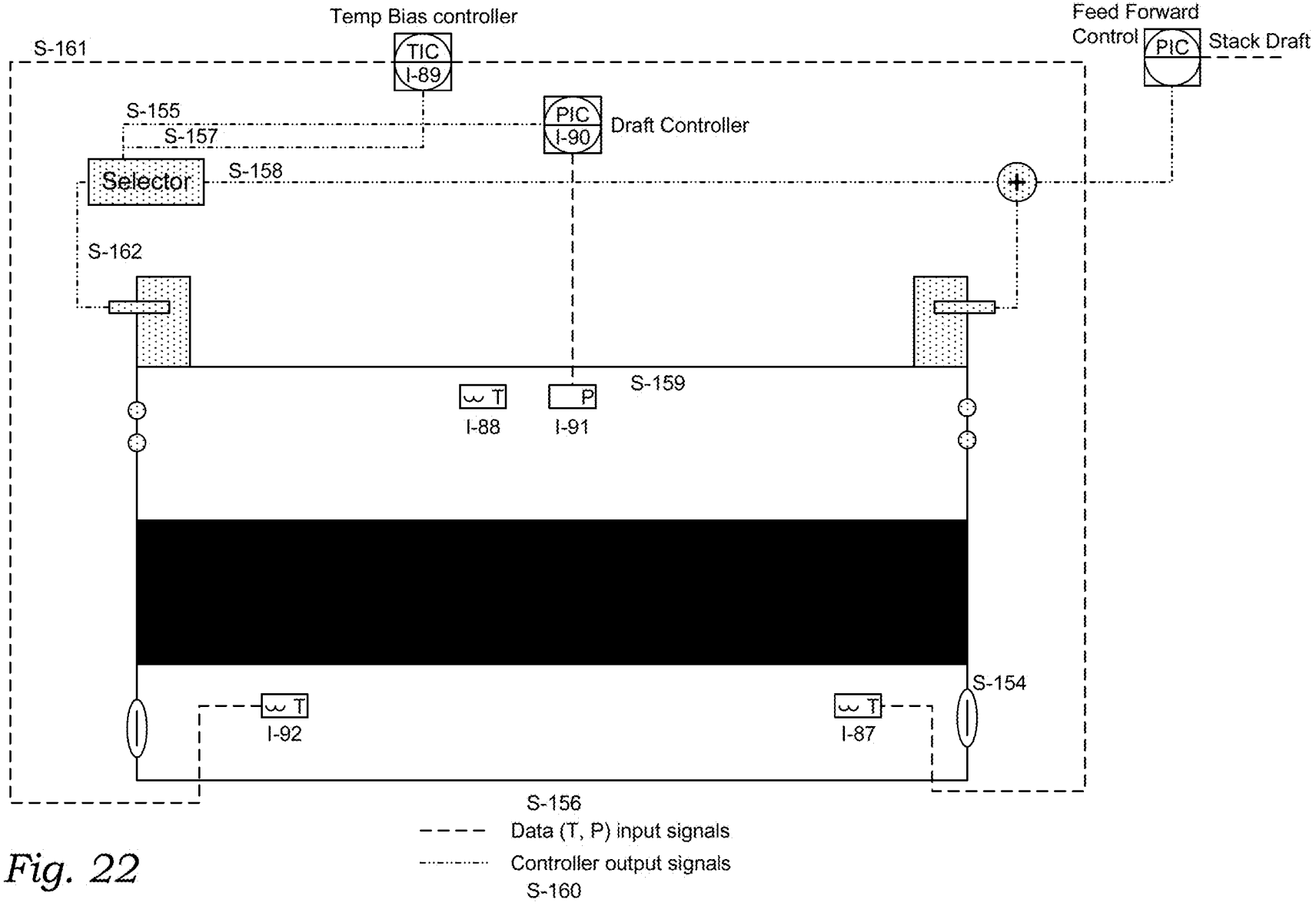
FIG. 22: Addition of stack draft feed forward control action to control scheme 1A to counteract higher stack draft during gas sharing operation when a heat recovery steam generator goes down in accordance with aspects of the disclosure.

As mentioned before, even though the heat recovery steam generator control decouples the oven controller from downstream operations, when one of the heat recovery steam generator goes down the emergency vent stack stack draft set point has to be changed for the new mode of operation. This could induce a disturbance to the ovens which would make the crown and sole flue temperatures change. Feedback control as shown in oven control schemes may be too slow to react since the oven temperatures may take long time to respond due to thermal inertia. When the temperatures do respond it may be too late for the feedback control to move the uptakes to compensate (for example, ovens may have already cooled down and one may have lost all the flue gas required to keep it warm). In order to effectively counteract this disturbance, we could add a feed-forward control action where the operator can start closing the uptakes when the draft set point is increased in anticipation of oven cooling down. This is shown in FIG. 22 for control scheme 1A. This adjustment can be applied to all control schemes discussed above.

In operation, the optimal oven operation is to implement a fully automated oven using all the crown, sole flue and uptake dampers to control the temperature profiles of crown and sole flues to the desired profiles. Use of single loop or multivariable control scheme would depend on the amount of interaction, ability to reject different disturbances and the performance of the controller to maintain the controlled variable to its trajectory.

If all the manipulated variables are not available to control then an alternative scheme with reduced set of manipulated variables may be used. For example, any of the control schemes 1, 1A, 1B, 2 or 3 could be used with reduced set of manipulated variables. If certain variables are not used as manipulated variables they can be treated as disturbances when they are moved manually.

HRSG Control

Figure 23:
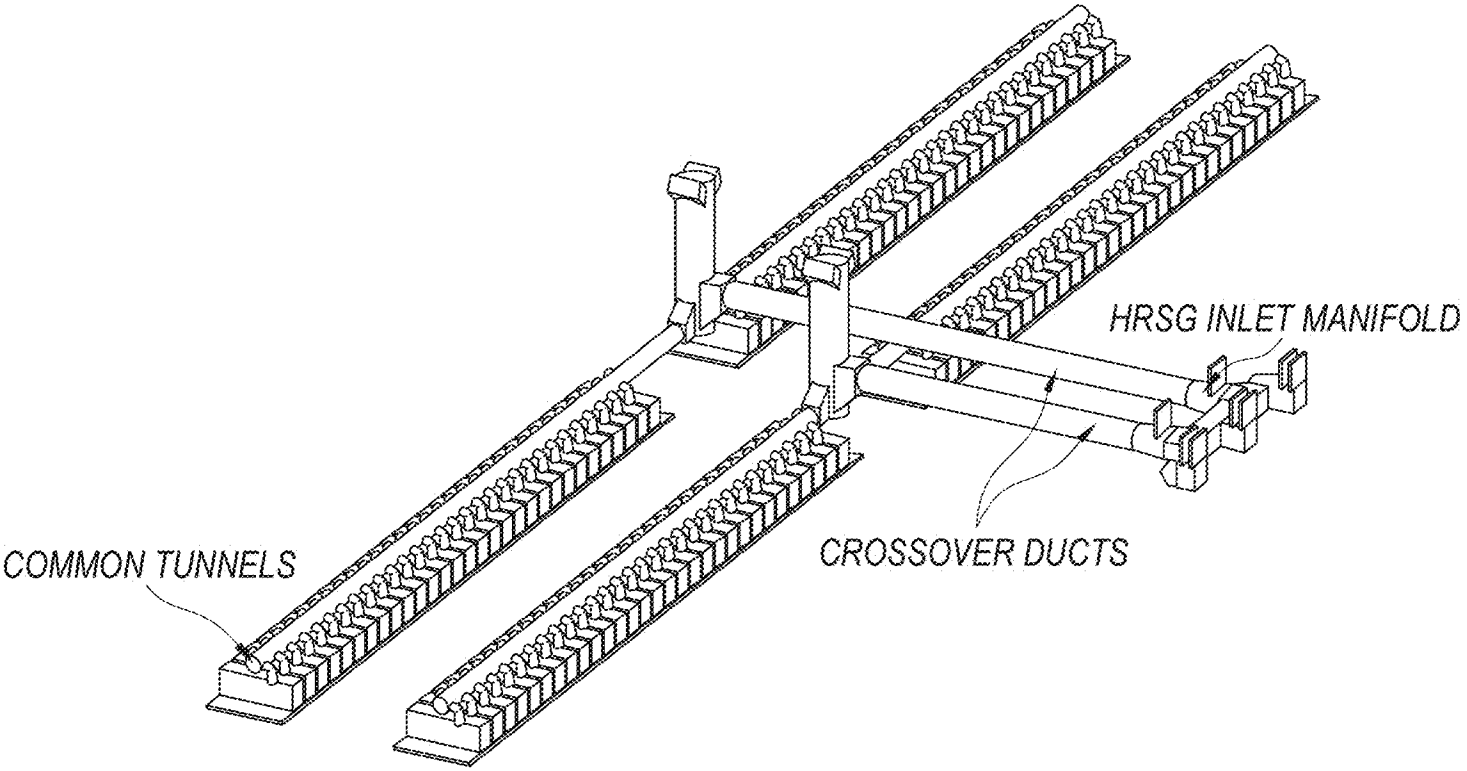
FIG. 23 illustrates heat recovery steam generator control in accordance with aspects of the disclosure.
Figure 24A:
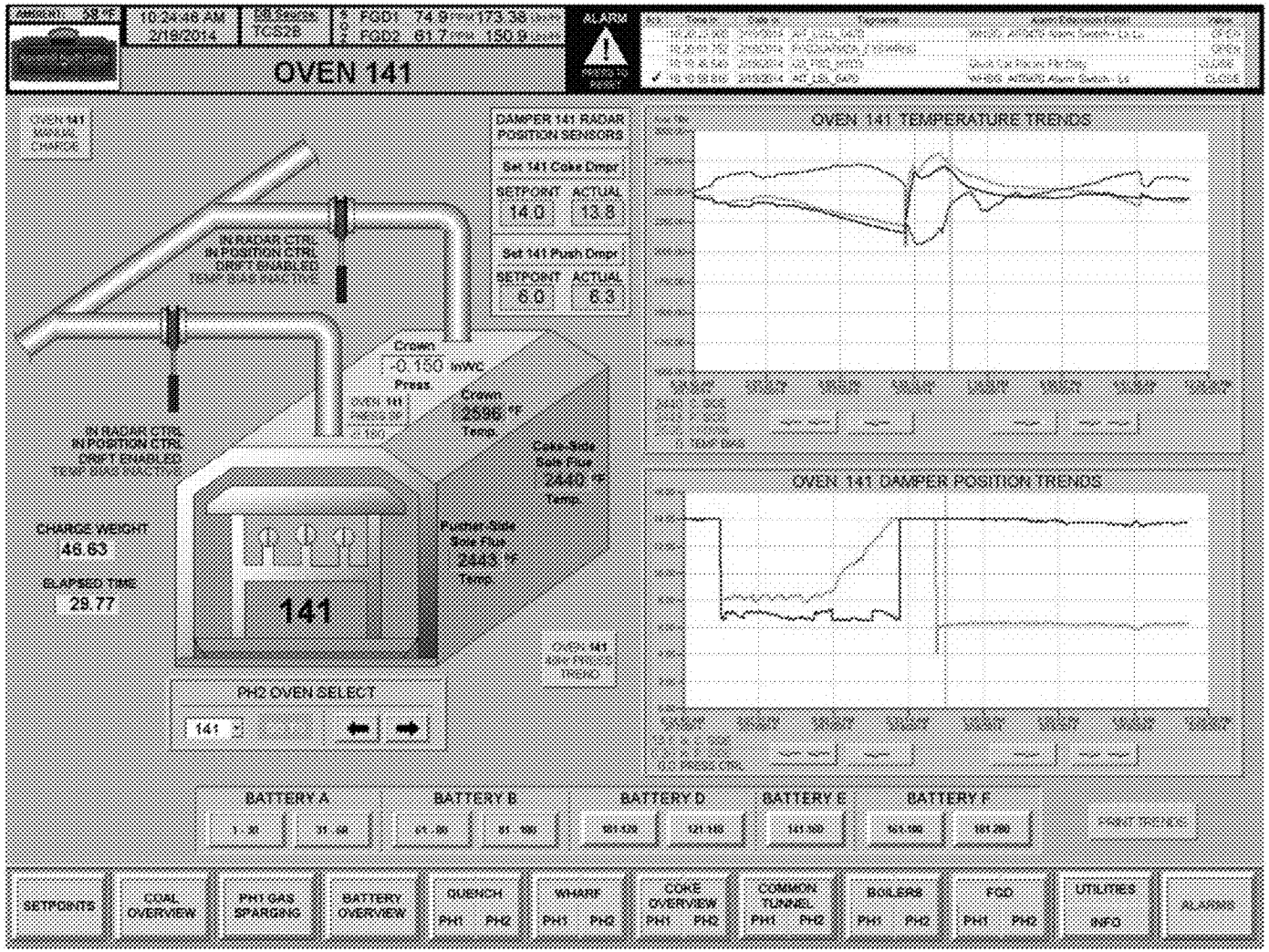
Figure 24B:
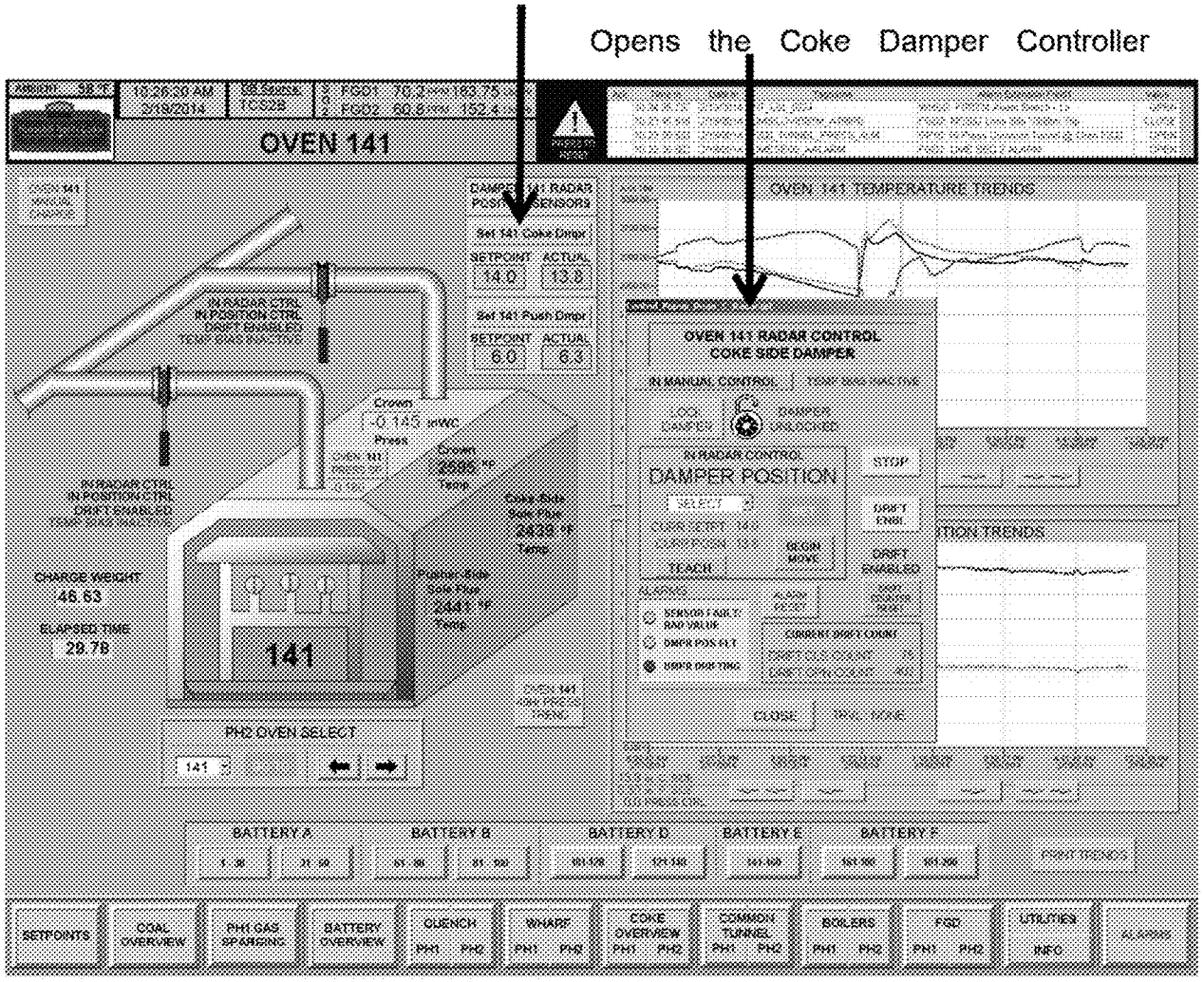
Figure 24C:
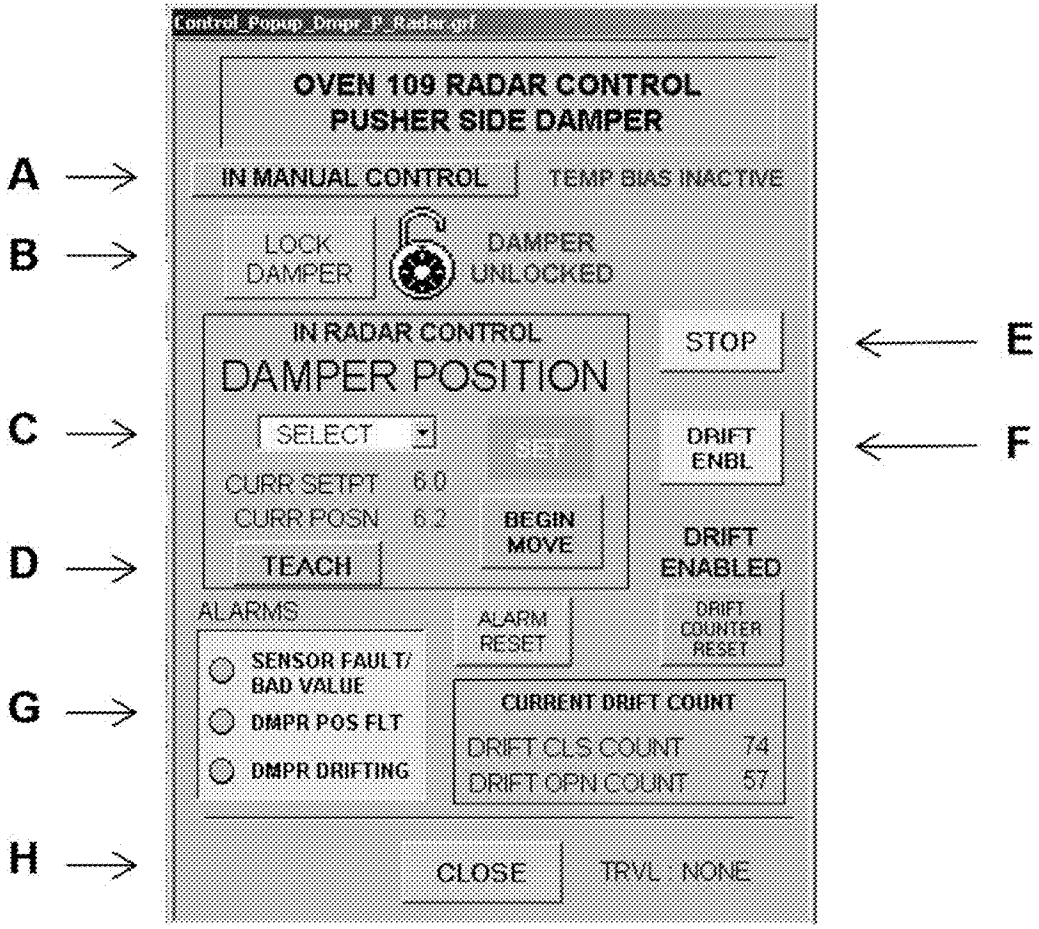
Figure 24D:
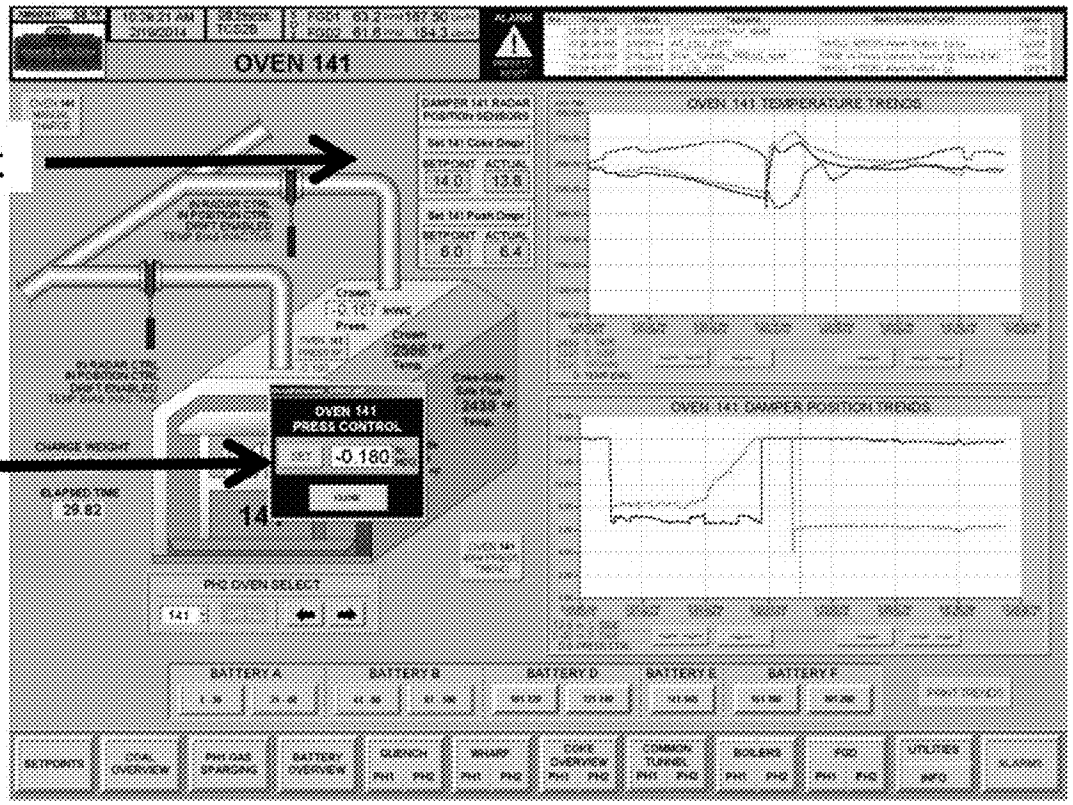
Figure 24F:
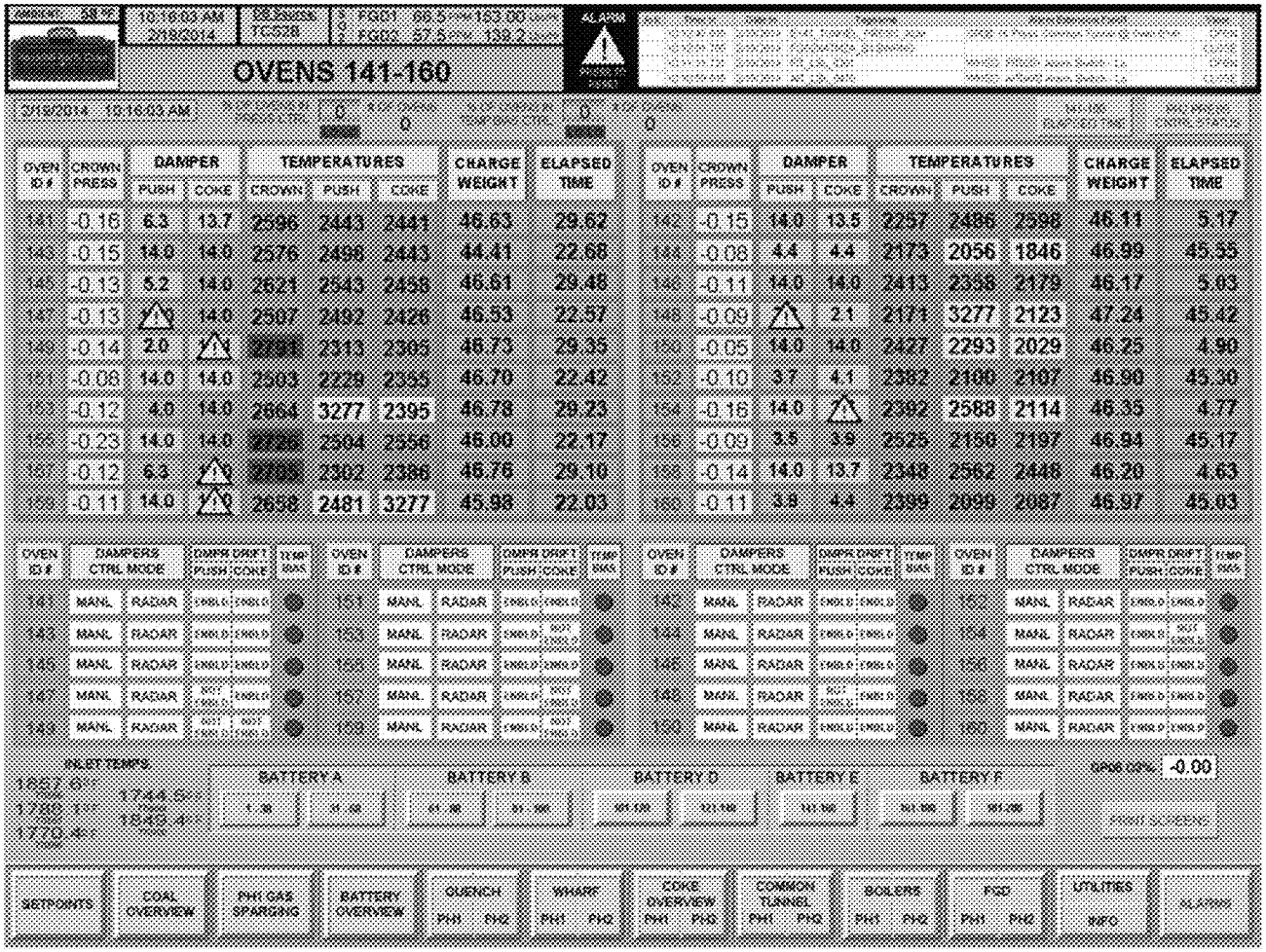
Figure 24G:
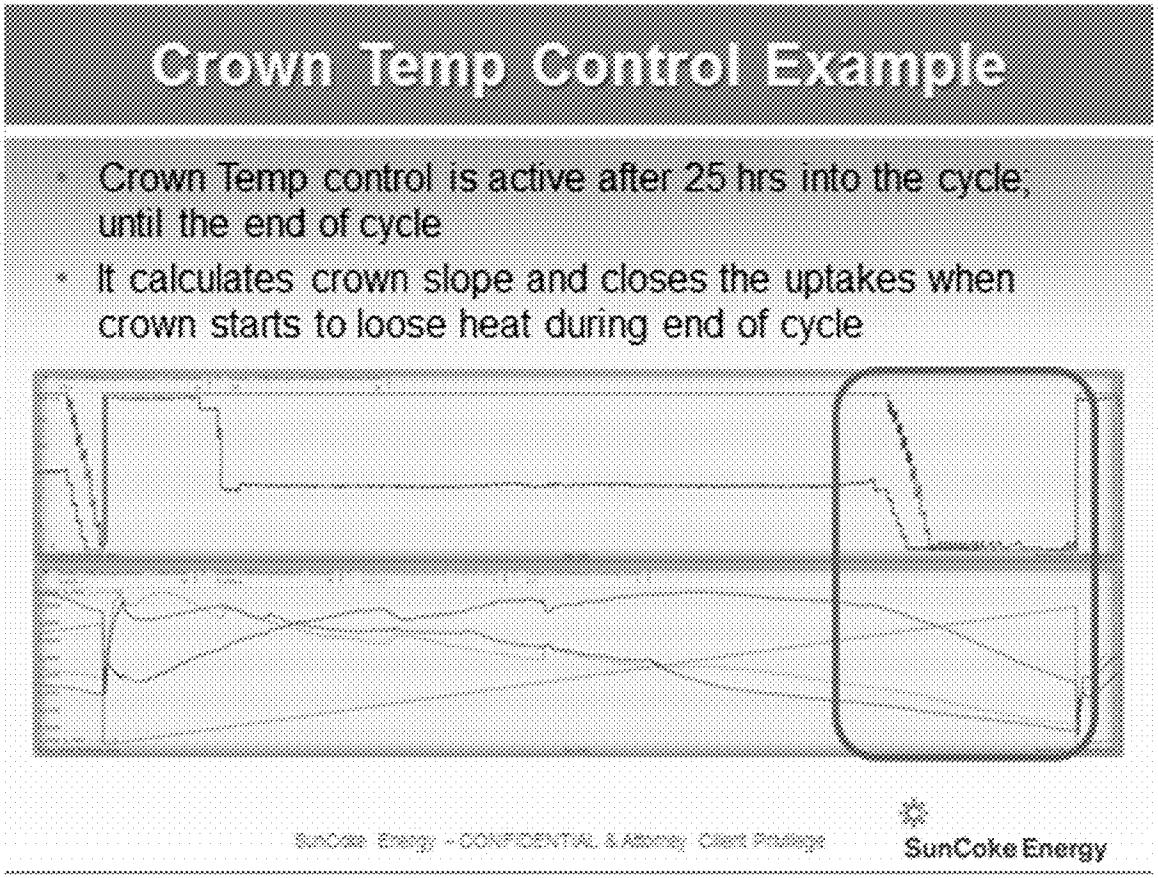
Figure 24H:
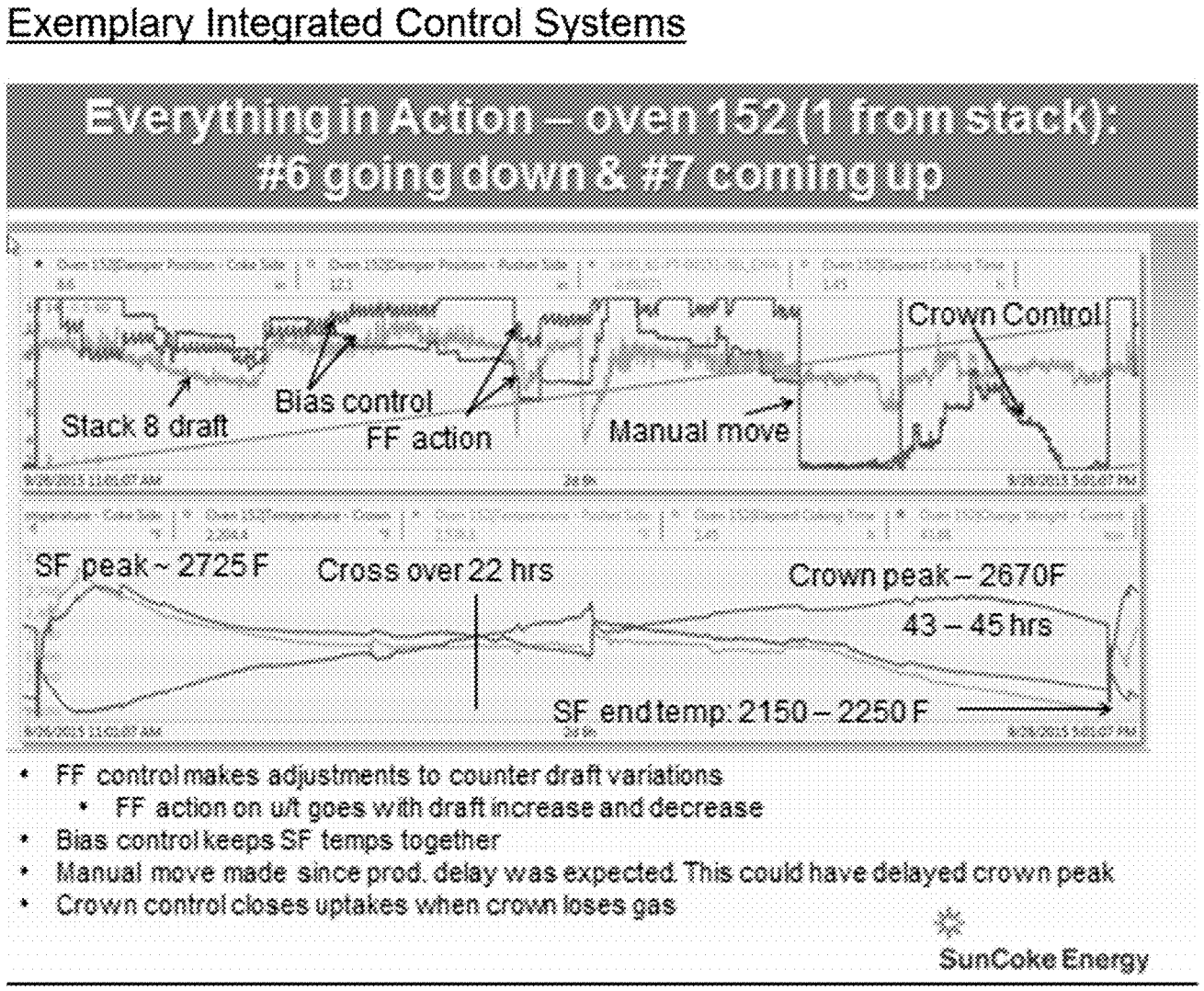
Figure 24I:
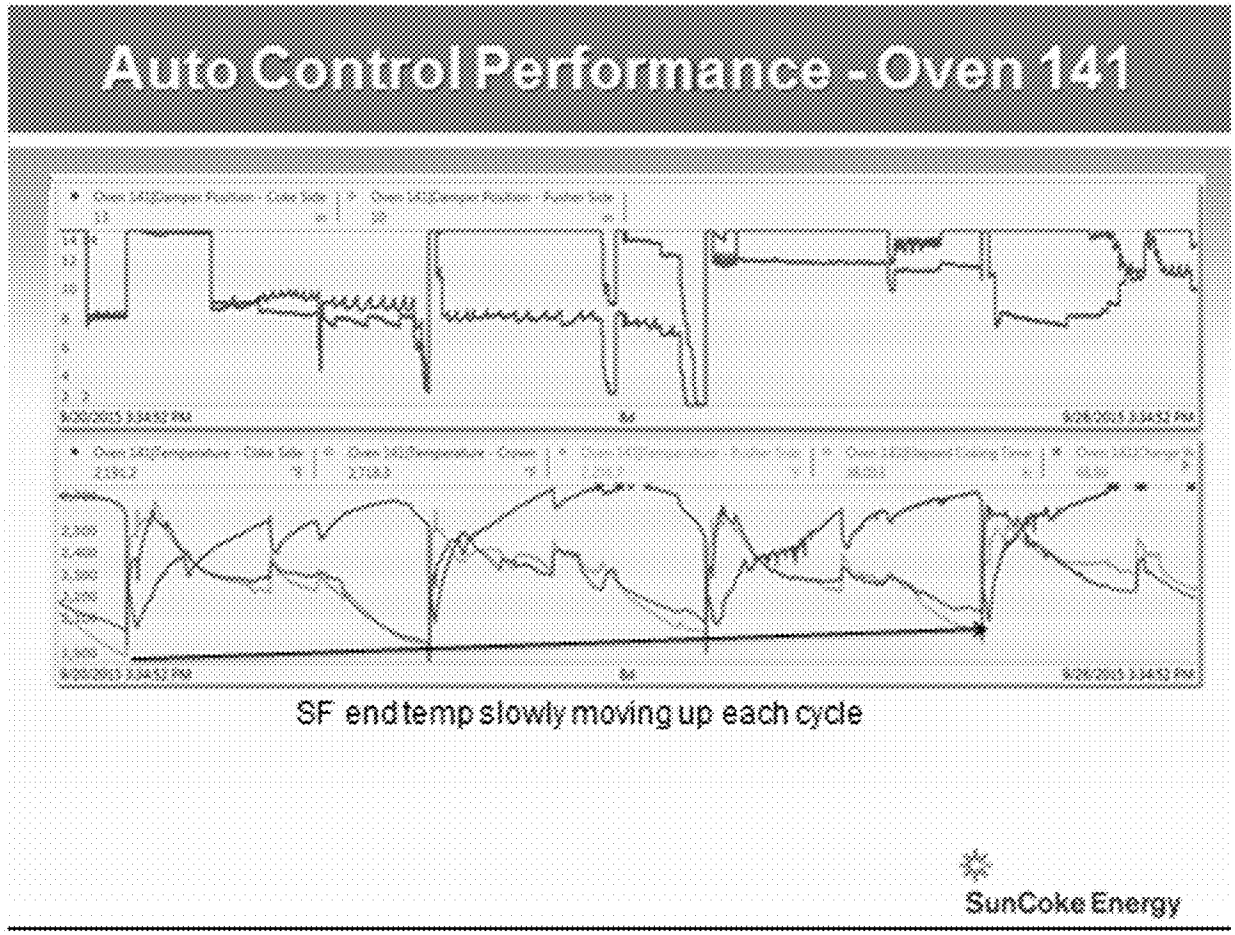
Figure 24J:
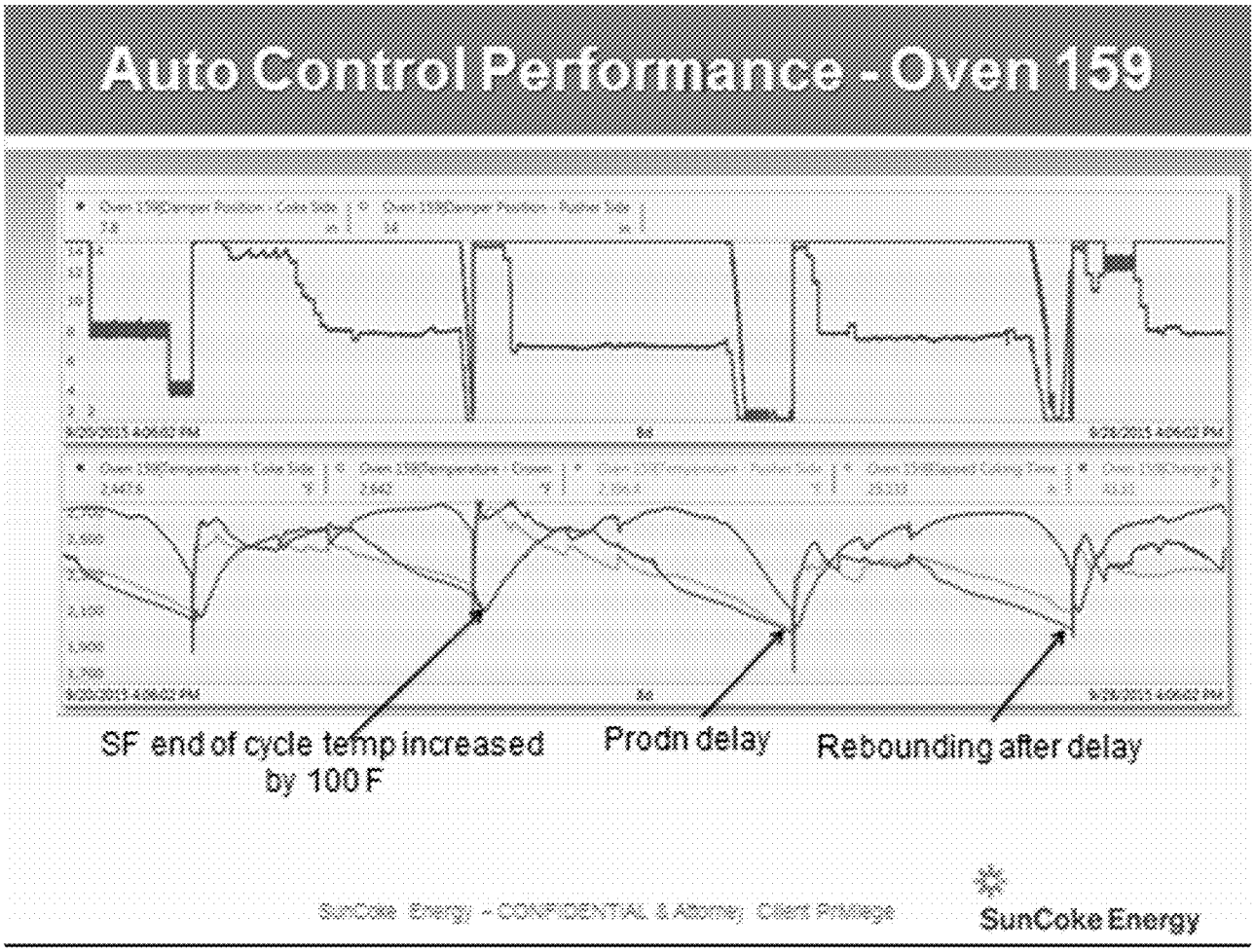
Figure 24L:
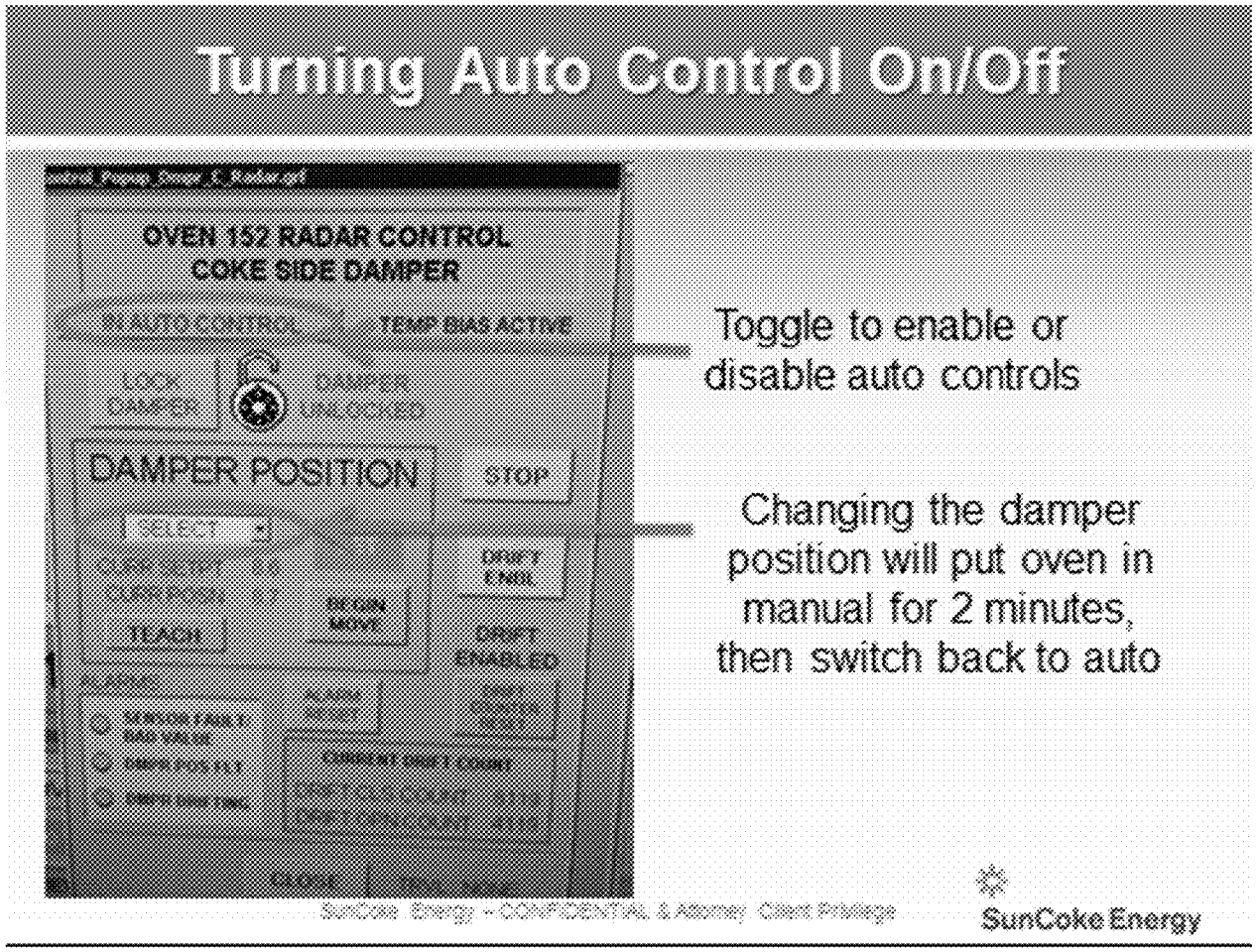
Figure 24M:
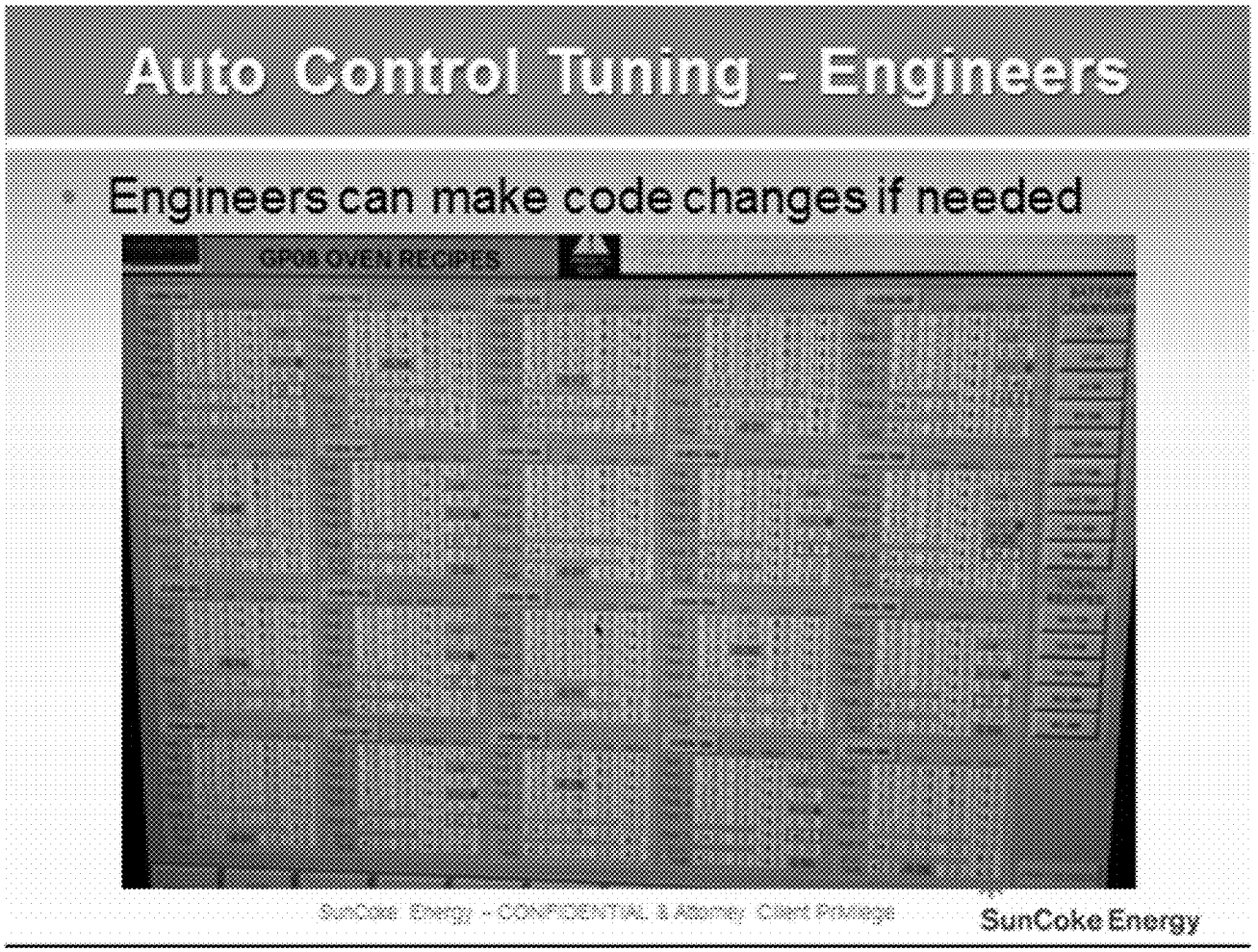

Instead of having one heat recovery steam generator under flow control and all other heat recovery steam generators under pressure control as show in control system H4, one could reverse it and have one heat recovery steam generator under pressure control and all other heat recovery steam generator under flow control. This alternate scheme will help distribute the flow between the heat recovery steam generator to user specified values and allow one heat recovery steam generator to act as a floater to absorb pressure variations. This scheme will be useful when the emergency vent stack is separated from the heat recovery steam generator as shown in FIG. 23.

Primary Air and Secondary Air for Combustion

The location of the holes in the crown and sole flue could vary. For example, if the door design is a two piece design with the top portion being fixed and the bottom removable, then door holes for the primary air could be placed in the top section of the fixed door and hence the damper automation hardware could be easily mounted to control the primary air flow. Alternatively instead of the crown the primary air holes can also be located in the lintels at the top close to the door holes. Similarly, for secondary air, the location of holes in sole flue could be different. For example, one could have the holes at the bottom of the sole flue instead of the end walls. A combination of different locations is also possible. The holes will typically be on any non-removable surface but can it is also possible to have them on removable surfaces and automate them. Irrespective of where the holes are the control scheme described above applies.

Control scheme combinations: The control schemes described above could be combined in different ways. For example, one could have a combination of single loop and multivariable controllers or multivariable controllers at the top layer cascaded to single loop controllers at the bottom layers. Moreover, the transition from fuel rich to fuel lean occurs both in crown and sole flue. Hence the detection scheme for transition applies to both crown and sole flue temperature control.

Also, in the oven control schemes with the top air configurations one can use individual TICs to vary each of the top air hole independently or use a common manifold to control the hole positions the same on each side (as shown in FIGS. 11 and 18) or any combination.

Exemplary Control Data Readings from the Oven

Primary Metrics

| Parameter | End Temp SF C/S (° F.) | End Temp SF P/S (° F.) | End Temp Crown (° F.) | SF Delta (° F.) | % of time in Auto |
|---|---|---|---|---|---|
| Battery Average | 2033 | 2053 | 2398 | 73 | 94.90% |
| Target | >2100 | >2100 | >2350 | <75 | >94% |
| % Ovens within Target | 85% | 95% | 95% | 60% | 100% |

Secondary Metrics

| Parameter | Cycle Charge Weight (Tons) | Cycle Coking Time (hrs) | Peak SF C/S (° F.) | Peak SF P/S (° F.) | Crown Peak Temp (° F.) | Crown Peak Time (hrs) | Crossover time (hrs) | Avg Temp C/S (° F.) | Avg Temp P/S (° F.) | Avg Temp Crown (° F.) |
|---|---|---|---|---|---|---|---|---|---|---|
| Battery Average | 45.4 | 47.6 | 2569 | 2579 | 2645 | 34.3 | 13.5 | 2307 | 2259 | 2499 |
| Target | 42.5-48.5 | 46-48.5 | >2500 | >2500 | >2500 | 30-42 | 5-20 | >2200 | >2200 | >2400 |
| % Ovens within Target | 100% | 100% | 70% | 80% | 95% | 85% | 75% | 100% | 100% | 100% |

TABLE 2

| Actual data collected from the coke ovens over time | | | | | | | | | | | | | | |
|---|---|---|---|---|---|---|---|---|---|---|---|---|---|---|
| | | Priority (1 or 2) | | | | | | | | | | | | |
| | | 2 | 2 | 2 | 1 | 1 | 1 | 1 | 2 | 2 | 2 | 2 | 2 | 2 |
| | | Target | | | | | | | | | | | | |
| | | 94% | 47.5 | 47.5 | 2100 | 2100 | 2350 | 75 | 2550 | 2550 | 38 | 2550 | 15 | 2500 |
| | | Description | | | | | | | | | | | | |
| | | % in Auto Control | Cycle Charge Weight (Tons) | Cycle Coking Time (hrs) | End Temp SF C/S (° F.) | End Temp SF P/S (° F.) | End Temp Crown (° F.) | SF Delta (° F.) | Peak SF C/S (° F.) | Peak SF P/S (° F.) | Crown Peak Time (hrs) | Crown Peak Temp (° F.) | Cross over time (hrs) | Avg Temp Crown (° F.) |
| 141 | One Week Average | 94.71% | 44.99 | 47.26 | 2027.17 | 1990.97 | 2508.13 | 67.20 | 2527.77 | 2510.40 | 30.00 | 2693.13 | 17.50 | 2518 |
| 142 | One Week Average | 94.71% | 46.19 | 48.17 | 1957.00 | 2019.52 | 2477.17 | 67.70 | 2613.00 | 2647.77 | 35.42 | 2642.70 | 18.02 | 2471 |
| 143 | One Week Average | 94.71% | 45.06 | 47.43 | 2136.20 | 2106.65 | 2416.80 | 68.28 | 2605.75 | 2650.77 | 41.78 | 2630.55 | 26.45 | 2424 |
| 144 | One Week Average | 94.71% | 45.61 | 47.70 | 1983.07 | 1958.17 | 2382.00 | 69.83 | 2471.90 | 2497.90 | 30.15 | 2660.90 | 5.19 | 2539 |
| 145 | One Week Average | 94.71% | 45.83 | 47.75 | 2132 | 2119 | 2408 | 67.67 | 2608.65 | 2583.02 | 34.81 | 2650.47 | 14.79 | 2512 |
| 146 | One Week Average | 94.71% | 46.15 | 48.18 | 2007.45 | 2034.75 | 2243.53 | 67.11 | 2500.30 | 2524.07 | 22.64 | 2623.82 | 7.69 | 2492 |
| 147 | One Week Average | 94.71% | 45.15 | 47.35 | 2011.10 | 2037.52 | 2296.92 | 67.37 | 2457.17 | 2666.40 | 25.55 | 2595.60 | 14.50 | 2471 |
| 148 | One Week Average | 94.71% | 44.40 | 46.85 | 2077.38 | 2063.13 | 2261.62 | 71.32 | 2434.82 | 2579.00 | 30.61 | 2661.75 | 4.33 | 2514 |
| 149 | One Week Average | 94.71% | 46.22 | 47.76 | 2107.35 | 2081.97 | 2473.60 | 66.96 | 2579.00 | 2601.23 | 30.57 | 2695.50 | 12.75 | 2588 |
| 150 | One Week Average | 94.71% | 46.37 | 48.20 | 2006.55 | 2107.82 | 2350.10 | 67.96 | 2540.55 | 2584.90 | 32.60 | 2662.30 | 8.98 | 2528 |
| 151 | One Week Average | 94.71% | 45.15 | 47.32 | 1923.32 | 2137.77 | 2177.70 | 66.41 | 2413.00 | 2556.45 | 34.50 | 2607.97 | 4.30 | 2466 |
| 152 | One Week Average | 94.57% | 44.94 | 47.66 | 2265.63 | 2171.40 | 2524.35 | 71.04 | 2764.90 | 2792.02 | 40.74 | 2707.45 | 24.74 | 2509 |
| 153 | One Week Average | 94.67% | 45.92 | 47.74 | 2011.20 | 1977.40 | 2380.60 | 81.27 | 2456.07 | 2436.97 | 29.65 | 2612.27 | 6.95 | 2482 |
| 154 | One Week Average | 94.79% | 46.31 | 48.36 | 2047.47 | 2147.82 | 2447.97 | 81.27 | 2675.70 | 2653.75 | 41.77 | 2640.47 | 18.05 | 2453 |
| 155 | One Week Average | 95.34% | 45.21 | 47.29 | 1940.15 | 1994.00 | 2447.50 | 81.27 | 2616.92 | 2601.95 | 38.10 | 2588.72 | 22.82 | 2442 |
| 156 | One Week Average | 94.65% | 44.21 | 46.98 | 1965.02 | 1977.97 | 2379.97 | 80.94 | 2609.30 | 2534.42 | 35.20 | 2653.17 | 13.90 | 2482 |
| 157 | One Week Average | 95.42% | 44.97 | 47.79 | 2064.25 | 2087.20 | 2508.72 | 81.27 | 2646.60 | 2596.32 | 36.05 | 2679.40 | 11.86 | 2551 |
| 158 | One Week Average | 94.75% | 46.31 | 48.19 | 1960.95 | 1996.67 | 2458.20 | 81.27 | 2591.52 | 2605.88 | 38.60 | 2607.50 | 16.00 | 2539 |
| 159 | One Week Average | 94.68% | 44.94 | 47.25 | 2101.07 | 2153.32 | 2423.95 | 81.27 | 2710.60 | 2501.25 | 34.84 | 2670.97 | 10.88 | 2530 |
| 160 | One Week Average | 97.34% | 44.41 | 47.31 | 1936.42 | 1892.50 | 2396.85 | 81.27 | 2551.15 | 2441.30 | 32.17 | 2613.07 | 11.25 | 2462 |
| | Average | 94.90% | 45.42 | 47.63 | 2033.02 | 2052.77 | 2398.19 | 73.44 | 2568.73 | 2578.74 | 34.27 | 2644.89 | 13.55 | 2498.66 |

Expert Advisory System: An operator can use the information from the temperature trends and uptake positions to create an expert advisory system for the operators to use in taking manual actions either in the current batch or in future batches. This will especially be useful if oven control schemes 1A, 1B or 1C is used. For example, an expert advisory page could look like the one shown below in Table 3.

TABLE 3

| Expert Advisory Systems Chart<br>Expert Advisory Page | | | | |
|---|---|---|---|---|
| Indicator | User Alert | Cycle | Condition(s) for trigger | Recommended User Action |
| ● | Oven ready to check | Current Cycle | Auto control has closed both uptakes and cycle time >42 hrs | Physically go and check oven for no gas in oven indicating end of coking. Green light oven for pushing |

TABLE 3-continued

| Expert Advisory Systems Chart<br>Expert Advisory Page | | | | |
|---|---|---|---|---|
| Indicator | User Alert | Cycle | Condition(s) for trigger | Recommended User Action |
| ● | Extreme uptake separation | Current Cycle & Next cycle | Uptake positions between coke side and push side differs by more than 8. For example, coke side is fully open at position 14 and push side is close more than half and is at 8 | Check for improper coal bed charging, improper sole flue damper hits, leaks, etc. |
| ● | Sole Flue (SF) peak temps low | Current Cycle & Next cycle | SF peak temperature(s) less than 2500 F. in first 5 hours of coking | Check SF damperhits. Check for cracks and/or leaks in SF. |
| ● | Temp cross over <5 hrs | Current Cycle & Next cycle | Crown temp and SF temp profiles crossed each other in less than 5 hrs | Check and close door holes early in next batch if crown temps had rised too fast due to excess air in crown. Check for crown leaks. Check for SF rapid cooling caused by leaks or excessive draft |
| ● | Late Crown peak temp | Next Cycle | Crown temp peaked at >43 hrs in cycle | Check door and SF hits and crown air leaks. Contact controls engineer if auto control needs to be tuned close uptakes earlier to limit draft |
| ● | Low end of cycle SF temps | Next Cycle | SF end of cycle temps <1900 F. | Check for any pushing delays. Check if uptakes has any issues in closing fully (hung uptakes, broken blocks, etc). Check burner hits and temp profiles. |
| ● | Low end of cycle Crown temps | Next Cycle | SF end of cycle temps <2200 F. | Check for any pushing delays. Check if uptakes has any issues in closing fully (hung uptakes, broken blocks, etc). Check burner hits and temp profiles. |

Table 3 illustrates an exemplary expert advisory system to assist burners or operators in making changes to current and future batch based on temperature responses with auto control of uptakes. Optimal control of coke ovens to will allow the operator to minimize the batch to batch quality variations, improve product yield & throughput and maximize the steam/power generation using the flue gas.

In horizontal heat recovery coke ovens with manual control, operators must go out to the coke ovens and manually look at the coke and adjust the door and sole flue dampers. They also take a look at the temperature profile of the crown and sole flues to make some adjustments to the dampers. Uptakes are set to a specific fixed position based on the time in the cycle. This is based on experience to control the draft and temperature profile. However, automatic control removes the inconsistencies caused by burner to burner operations. Moreover automating enables the system to make changes at a higher frequency (for example every minute or so) than it is humanly impossible for operators to make. Additionally when there is interaction between systems (for example, between the ovens and the heat recovery steam generator) it is difficult for operators to calculate the optimal set of moves to make. It is easier for a computerized program to calculate and suggest the optimal moves.

Automatic control further enables operations close to constraints. Operating on the constraint boundary enables increased profitability by having better efficiencies. It also helps improve environmental control. For example, one can easily program variable draft set points for the control system depending on the production cycle to eliminate outgassing caused by positive pressure at a particular point in the cycle.

In accordance with aspects of the disclosure, a coke plant could operate in various modes, for example, an initial mode without a gas sharing system installed, with a normal low draft operation, and using the temperature profile system to optimize the system. Alternatively the coke plant could run in a gas sharing system mode with normal low draft operation wherein the heat recovery steam generator control system is used to balance the draft and the temperature profile system is used to optimize the system. In still further embodiments, the coke plant could operate in gas sharing transition mode wherein the system transitions to high draft gas sharing and has a control system that automatically changes the uptake position. In accordance with this mode, the system kicks in when transitions to gas sharing mode occur, for example in the event of an unplanned loss of a heat recovery steam generator. In still further embodiments, the coke plant could operate in use the gas sharing system to operate in a gas sharing high draft mode using the heat recovery steam generator to balance the draft and using the temperature control system to optimize the temperature.

Experimental results confirm the control effects described herein. The compensation of integrated component control of the sole flue temperature, the crown temperature and the feed forward control on the stack draft combine to yield an optimized system with higher yield, faster throughput and increased by-product.

Experimental Results

Exemplary Control Adjustments for Integrated Components 3 control schemes: sole flue temp bias, crown temp, stack draft
Sole flue temp bias
On all the time to keep sole flues within 50° F.
Crown temperature control
When crown temp starts to break over, uptakes will start to close
Feed forward control for stack draft on all the time
If stack pressure increases, uptakes will close to lower impact of higher draft on oven
SF Biasing and Crown temp are deactivated when neighboring ovens are charged
Controls are deactivated for 1.25 hrs Exemplary Sole Flue Biasing Control for an Integrated Component 0-50 F difference: Do Nothing
50-100 F difference: 1" move in opposite directions
100-150 F difference: 2" move in opposite directions
>150 F difference: 3" move in opposite directions
Max allowable separation between dampers is 6"
If TC reads above 3000 or below 1000, SF biasing will turn off Exemplary Feed Forward Control Uptake move=Gain*e-stack draft change
It aims to reduce the impact of high draft on the ovens when in gas sharing mode
On all the time
Currently applied only on stack and two neighboring ovens (among test ovens only on 150 and 152)
Triggered only if current draft is higher than −0.7
If draft increases (say from −0.6 to −0.75) it will close the uptakes
If draft decreases after increasing it will open the uptakes back (opening the uptakes is disabled after 36 hrs)
Gain: tuning parameter set by engineer based on data from testing. Can be changed only by support engineer As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It should be noted that the orientation of various elements may differ according to other exemplary embodiments, and that such variations are intended to be encompassed by the present disclosure.

EXAMPLES

The following Examples are illustrative of several embodiments of the present technology.

1. A system for integrating control of a coking oven, the system comprising:
an oven chamber having controllable air openings, the oven chamber is configured to operate within a temperature profile, wherein the opening and/or closing of the air openings are controllable as manipulated variables to be responsive to optimal set-point temperature profile trajectories in the oven chamber as a controlled variable in the system;
an uptake in fluid communication with the oven chamber; the uptake damper controllable as a manipulated variable to be responsive to a change in the temperature profile of the oven as a controlled variable;
wherein the controlled variables and the manipulated variables control optimization of a coking rate, an energy efficiency of the system, product yield, and byproducts.

2. The system of example 1 wherein the oven chamber includes a crown and sole flues and the controlled variable includes controlling temperature in the crown, in the sole flues, and/or draft in the crown.

3. The system of example 2 wherein the oven chamber and/or the sole flue includes a push side and a coke side and wherein the controlled variable includes controlling to a temperature differential between the push side and the coke side.

4. The system of example 1 wherein the air openings are at least one of a sole flue damper, door hole damper, or top air hole damper in the crown, wherein the manipulated variables include opening or closing the uptake, sole flue damper, door hole damper or top air hole damper in response to the temperature profile trajectories in the oven chamber.

5. The system of example 1 further comprising a common tunnel, heat recovery steam generators and an emergency vent stack in fluid communication with the oven, the heat recovery steam generators includes a pressure control valve configured to maintain a draft in the system.

6. The system of example 1 further comprising a common tunnel, a gas sharing tunnel, a plurality of heat recovery steam generators and an emergency vent stack in fluid communication with the oven, the plurality of heat recovery steam generators are configured to balance draft in the gas sharing tunnel.

7. The system of example 6 wherein at least one of the heat recovery steam generators include a mass flow meter to measure exhaust gas flow through the heat recovery steam generators.

8. A method of optimizing operation of a coke plant, comprising:
operating a plurality of coke ovens to produce coke and exhaust gases, wherein each coke oven comprises a crown and a sole flue adapted to operate in a determined temperature range, the crown and the sole flue including controllable openings for introducing air, wherein each coke oven comprises an uptake damper adapted to control an oven draft in the coke oven;

directing the exhaust gases from each coke oven to a common tunnel;

fluidly connecting a plurality of heat recovery steam generators to the common tunnel;

operating all of the heat recovery steam generators and dividing the exhaust gases such that a portion of the exhaust gases flows to each of the heat recovery steam generators;

automatically controlling the uptake damper of each coke oven to maintain the oven draft of each coke oven at or within a deadband of a targeted oven draft; and automatically controlling the controllable openings of the crown and/or the sole flue to maintain the oven temperature of each coke oven in the determined temperature range.

9. The method of example 8, further comprising:

in a gas sharing operating mode, stopping operation of one of the heat recovery steam generators and directing the exhaust gases such that a portion of the exhaust gases flows through each of the remaining operating heat recovery steam generators without moving outside the determined temperature range.

10. The method of example 8, further comprising:

automatically controlling the uptake damper, the controllable openings of the crown and/or the sole flue of each coke oven to maintain an oven temperature in each coke oven within the determined temperature range.

11. The method of example 10, further comprising:

automatically controlling the uptake damper, the controllable openings of the crown and/or the sole flue of each coke oven to maintain an uptake duct oxygen concentration near each uptake damper within an oxygen concentration range.

12. The method of example 8, further comprising:

automatically controlling the uptake damper, the controllable openings of the crown and/or the sole flue of each coke oven to maintain an uptake duct oxygen concentration near each uptake damper within an oxygen concentration range.

13. The method of example 8, further comprising:

automatically controlling the uptake damper, the controllable openings of the crown and/or the sole flue of each coke oven to maintain a common tunnel temperature in the common tunnel within the determined temperature range.

14. The method of example 8, further comprising:

determining historical uptake damper, controllable openings of the crown and/or the sole flue positioning related to the elapsed time in previous coking cycles of at least one coke oven; and automatically controlling the uptake damper, the controllable openings of the crown and/or the sole flue of each coke oven based on the historical uptake damper, controllable openings of the crown and/or the sole flue position data in relation to the elapsed time in the current coking cycle.

15. The method of example 8, further comprising:

automatically controlling the controllable openings of the crown and/or the sole flue of each coke oven in response to a temperature sensor input.

16. The method of example 15, further comprising:

automatically controlling the controllable openings of the crown and/or the sole flue of each coke oven in response to an oxygen sensor input.

17. The method of example 16, further comprising:

automatically controlling the uptake damper of each coke oven in response to a temperature sensor input and/or oxygen sensor input.

18. The method of example 15, further comprising:

automatically controlling the uptake damper, the controllable openings of the crown and/or the sole flue of each coke oven to maintain an oven chamber temperature in each coke oven within a temperature range.

19. The method of example 15, further comprising:

automatically controlling the uptake damper of each coke oven to maintain a sole flue temperature in each coke oven within the determined temperature range.

20. The method of example 15, further comprising:

automatically controlling the uptake damper of each coke oven to maintain an uptake duct temperature in each coke oven within the determined temperature range.

21. The method of example 15, further comprising:

providing a plurality of crossover ducts, wherein each crossover duct is connected to one of the heat recovery steam generators and connected to the common tunnel at an intersection.

22. The method of example 21, further comprising:

in a gas sharing operating mode, stopping operation of one of the heat recovery steam generators and directing the exhaust gases such that a portion of the exhaust gases flows through each of the remaining operating heat recovery steam generators.

23. The method of example 22, further comprising:

anticipating a predicted oven draft less than the targeted oven draft prior to automatically controlling the uptake damper of each coke oven to maintain the oven draft at or within a deadband from the targeted oven draft.

24. The method of example 15, further comprising:

providing a heat recovery steam generator damper adapted to control a flow of exhaust gases through the heat recovery steam generator downstream of each heat recovery steam generator; and automatically controlling at least one heat recovery steam generator dampers to maintain the targeted vent stack draft within the draft range.

25. The method of example 15, further comprising:

automatically controlling at least one uptake damper to a fully open position; and providing a heat recovery steam generator damper adapted to control a flow of exhaust gases through the heat recovery steam generator downstream of each heat recovery steam generator; and automatically controlling the heat recovery steam generator dampers to fall within a common tunnel draft range.

26. A coke oven, comprising:

an oven chamber;

an uptake duct in fluid communication with the oven chamber, the uptake duct being configured to receive exhaust gases from the oven chamber;

a common tunnel in fluid communication with the uptake duct, the common tunnel being configured to receive exhaust gases from the uptake duct;

at least one heat recovery steam generator in fluid communication with the common tunnel;

the heat recovery steam generator being configured to provide an uptake damper in fluid communication with the uptake duct, the uptake damper being positioned at any one of a plurality of positions including fully opened and fully closed, the uptake damper configured to control an oven draft;

an actuator configured to alter the position of the uptake damper between the plurality of positions in response to a position instruction;

a heat recovery steam generator damper in fluid communication with the heat recovery steam generator; the heat recovery steam generator damper being positioned at any one of a plurality of positions including fully opened and fully closed, the heat recovery steam generator damper configured to control a common tunnel draft;

a sensor configured to detect an operating condition of the coke oven, wherein the sensor comprises one of a draft sensor configured to detect the oven draft, a temperature sensor configured to detect an oven chamber temperature or a sole flue temperature, and an oxygen sensor configured to detect an uptake duct oxygen concentration in the uptake duct; and a controller in communication with the actuator and with the sensor, the controller being configured to provide a position instruction to an uptake actuator configured to actuate the uptake damper or to a heat recovery steam generator actuator configured to actuate the heat recovery steam generator actuator in response to the operating condition detected by the sensor.

27. The coke oven of example 26, wherein the sensor comprises a temperature sensor configured to detect the oven temperature.

28. The coke oven of example 27, wherein the sensor is positioned in the oven chamber.

29. The coke oven of example 28, wherein the position instruction is configured to allow excess air into the oven in response to an overheat condition detected by the sensor.

30. The coke oven of example 26, wherein the sensor comprises an oxygen sensor configured to detect the uptake duct oxygen concentration in the uptake duct.

31. The coke oven of example 30, wherein the position instruction is configured to maintain the uptake duct oxygen concentration within an oxygen concentration range.

32. The coke oven of example 26, wherein the sensor comprises a temperature sensor configured to detect the sole flue temperature.

33. The coke oven of example 32, wherein the position instruction is configured to allow excess air into the oven in response to an overheat condition detected by the sensor.

34. The coke oven of example 33, further comprising:

a temperature sensor configured to detect an oven temperature in the oven chamber; and wherein the sensor comprises a draft sensor configured to detect an oven draft;

wherein the controller is configured to provide the position instruction to the actuator in response to the oven draft detected by the draft sensor and the oven temperature detected by the temperature sensor.

It is also important to note that the constructions and arrangements of the apparatus, systems, and methods as described and shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Further, although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth). From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A coke oven, comprising:

an oven chamber including a crown and sole flues;

one or more controllable air openings positioned at the crown and/or sole flues and configured to affect temperature of the crown and/or sole flues respectively;

an uptake duct in fluid communication with the oven chamber, the uptake duct being configured to receive exhaust gases from the oven chamber;

an uptake damper in fluid communication with the uptake duct, the uptake damper being positioned at any one of a plurality of positions including fully opened and fully closed, the uptake damper configured to control an oven draft;

a first actuator configured to alter the position of the uptake damper between the plurality of positions in response to a position instruction;

a common tunnel in fluid communication with the uptake duct, the common tunnel being configured to receive exhaust gases from the uptake duct;

at least one heat recovery steam generator in fluid communication with the common tunnel, the heat recovery steam generator including (i) a heat recovery steam generator damper positioned at any one of a plurality of positions including fully opened and fully closed and (ii) and a second actuator configured to alter the position of the heat recovery steam generator damper;

one or more sensors configured to detect an operating condition of the coke oven, wherein the one or more sensors comprises at least one of (i) a draft sensor configured to detect the oven draft, (ii) a temperature sensor configured to detect an oven chamber temperature or a sole flue temperature, or (iii) an oxygen sensor configured to detect an uptake duct oxygen concentration in the uptake duct; and a controller in communication with the controllable air openings, the first actuator and the one or more sensors, the controller being configured to provide position instructions to at least one of (i) the first actuator to actuate the uptake damper over a coking cycle, such that a target oven draft is adjusted at least three times over the coking cycle by actuating the uptake damper, or (ii) the second actuator to actuate the heat recovery steam generator actuator, in response to the operating condition detected by the one or more sensors.

2. The coke oven of claim 1, wherein the one or more sensors comprise at least two of the draft sensor, temperature sensor, or oxygen sensor, and wherein the controller is configured to provide the position instruction based on the operating condition detected by the at least two sensors.

3. The coke oven of claim 1, wherein the one or more sensors comprise the temperature sensor, and wherein the temperature sensor is positioned in the oven chamber.

4. The coke oven of claim 1, wherein the position instruction is configured to allow excess air into the oven in response to an overheat condition detected by the one or more sensors.

5. The coke oven of claim 1, wherein the one or more sensors comprise the draft sensor, temperature sensor, and oxygen sensor, and wherein the controller is configured to provide the position instruction based on the operating condition detected by the three sensors.

6. The coke oven of claim 5, wherein the one or more sensors comprise the oxygen sensor, and wherein the position instruction is configured to maintain the uptake duct oxygen concentration within an oxygen concentration range.

7. The coke oven of claim 1, wherein the one or more sensors comprise the temperature sensor configured to detect the sole flue temperature.

8. The coke oven of claim 7, wherein the position instruction is configured to allow excess air into the oven in response to an overheat condition detected by the one or more sensors.

9. The coke oven of claim 1, wherein the temperature sensor is a first temperature sensor configured to detect an oven temperature in the oven chamber, the coke oven further comprising a second temperature sensor configured to detect a sole flue temperature in the sole flue.

10. A coke plant, comprising:

a plurality of coke ovens each including— an oven chamber including a crown;

one or more controllable air openings positioned at the crown and configured to affect temperature of the crown;

an uptake duct in fluid communication with the oven chamber, the uptake duct being configured to receive exhaust gases from the oven chamber;

an uptake damper in fluid communication with the uptake duct, the uptake damper being positioned at any one of a plurality of positions including fully opened and fully closed, the uptake damper configured to control an oven draft; and an uptake damper actuator configured to alter the position of the uptake damper between the plurality of positions in response to a position instruction; and one or more sensors configured to detect an operating condition of the coke oven, wherein the one or more sensors comprise at least one of (i) a draft sensor configured to detect the oven draft, (ii) a temperature sensor configured to detect an oven chamber temperature or a sole flue temperature, or (iii) an oxygen sensor configured to detect an uptake duct oxygen concentration in the uptake duct;

a common tunnel in fluid communication with the uptake ducts of the coke ovens;

at least one heat recovery steam generator in fluid communication with the common tunnel, the heat recovery steam generator including (i) a heat recovery steam generator damper positioned at any one of a plurality of positions including fully opened and fully closed, and (ii) and a steam generator actuator configured to alter the position of the heat recovery steam generator damper; and a controller in communication with the controllable air openings, the uptake damper actuator and the one or more sensors for each of the coke ovens and the steam generator actuator, the controller being configured to provide position instructions to at least one of (i) the uptake damper actuator over a coking cycle, such that a target oven draft is adjusted at least three times over the coking cycle, or (ii) or the steam generator actuator in response to the operating condition detected by the one or more sensors.

11. The coke plant of claim 10, wherein the one or more sensors of each of the coke ovens comprise at least two of the draft sensor, temperature sensor, or oxygen sensor, and wherein the controller is configured to provide the position instruction based on the operating condition detected by the at least two sensors.

12. The coke plant of claim 10, wherein the one or more sensors of each of the coke ovens comprise the temperature sensor, and wherein the temperature sensor is positioned in the oven chamber.

13. The coke plant of claim 10, wherein the position instruction is configured to allow excess air into each of the coke ovens in response to an overheat condition detected by the one or more sensors of each of the coke ovens.

14. The coke plant of claim 10, wherein the one or more sensors of each of the coke ovens comprise the draft sensor, temperature sensor, and oxygen sensor, and wherein the controller is configured to provide the position instruction based on the operating condition detected by the three sensors.

15. The coke plant of claim 14, wherein the one or more sensors of each of the coke ovens comprise the oxygen sensor, and wherein the position instruction is configured to maintain the uptake duct oxygen concentration of each of the coke ovens within an oxygen concentration range.

16. The coke plant of claim 10, wherein the one or more sensors comprise the temperature sensor configured to detect the sole flue temperature.

17. A coke oven, comprising:

an oven chamber including a crown and sole flues;

one or more controllable air openings positioned at the crown and/or sole flues and configured to affect temperature of the crown and/or sole flues respectively;

an uptake duct in fluid communication with the oven chamber, the uptake duct being configured to receive exhaust gases from the oven chamber;

an uptake damper in fluid communication with the uptake duct, the uptake damper being positioned at any one of a plurality of positions including fully opened and fully closed, the uptake damper configured to control an oven draft;

a first actuator configured to alter the position of the uptake damper between the plurality of positions in response to a position instruction;

a common tunnel in fluid communication with the uptake duct, the common tunnel being configured to receive exhaust gases from the uptake duct;

at least one heat recovery steam generator in fluid communication with the common tunnel, the heat recovery steam generator including (i) a heat recovery steam generator damper positioned at any one of a plurality of positions including fully opened and fully closed and (ii) and a second actuator configured to alter the position of the heat recovery steam generator damper;

one or more sensors configured to detect one or more operating conditions of the coke oven, wherein the one or more sensors comprises at least one of (i) a draft sensor configured to detect the oven draft, (ii) a temperature sensor configured to detect an oven chamber temperature or a sole flue temperature, or (iii) an oxygen sensor configured to detect an uptake duct oxygen concentration in the uptake duct; and a controller in communication with the controllable air openings and the one or more sensors, the controller being configured to provide position instructions to regulate (i) the first actuator to actuate the uptake damper over a coking cycle, such that a target oven draft is adjusted at least three times over the coking cycle by actuating the uptake damper.

* * * * *